US007573451B2

(12) United States Patent
Tobita

(10) Patent No.: US 7,573,451 B2
(45) Date of Patent: Aug. 11, 2009

(54) SAMPLE HOLD CIRCUIT AND IMAGE DISPLAY DEVICE USING THE SAME

(75) Inventor: Youichi Tobita, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 767 days.

(21) Appl. No.: 10/500,702

(22) PCT Filed: Jun. 27, 2003

(86) PCT No.: PCT/JP03/08249

§ 371 (c)(1),
(2), (4) Date: Jul. 6, 2004

(87) PCT Pub. No.: WO2004/042691

PCT Pub. Date: May 21, 2004

(65) Prior Publication Data

US 2005/0088396 A1 Apr. 28, 2005

(30) Foreign Application Priority Data

Nov. 6, 2002 (WO) ..... PCT/JP02/11587
Mar. 7, 2003 (WO) ..... PCT/JP03/02757

(51) Int. Cl.
*G09G 3/36* (2006.01)

(52) U.S. Cl. ..... 345/90; 345/88; 345/93; 345/98; 345/100

(58) Field of Classification Search ..... 345/87–104, 345/204–215, 690–699; 327/94–100
See application file for complete search history.

(56) References Cited

U.S. PATENT DOCUMENTS 4,945,259 A 7/1990 Anderson
5,006,732 A 4/1991 Nakamura
5,206,544 A 4/1993 Chen et al.
6,034,556 A * 3/2000 Koyasu et al. ..... 327/96
6,064,362 A 5/2000 Brownlow et al.
6,980,194 B2 * 12/2005 Tobita ..... 345/100

(Continued)

FOREIGN PATENT DOCUMENTS

DE 10307320 9/2003

(Continued)

OTHER PUBLICATIONS

U. Tietze, Ch. Schenk, Halbleiter-Schaltungstechnik, 7th revised edition, Chapter 5, Feldeffekttransistoren, pp. 83 to 101, Springer-Verlag.

(Continued)

*Primary Examiner*—Vijay Shankar
(74) *Attorney, Agent, or Firm*—McDermott Will & Emery LLP

(57) ABSTRACT

A sample hold circuit includes a first switch connected between a data line and a first node, a second switch connected between first node and a second node, a capacitor connected between the second node and a line of a common potential, and a drive circuit applying a potential equal to that of the second node to the first node and one of the electrodes of the liquid crystal cell. The first and second switches are turned on when a scanning line is at an "H" level.

20 Claims, 73 Drawing Sheets

U.S. PATENT DOCUMENTS

| | | | | |
|---|---|---|---|---|
| 2002/0067328 | A1* | 6/2002 | Yumoto et al. | 345/92 |
| 2004/0252116 | A1* | 12/2004 | Tobita | 345/211 |

FOREIGN PATENT DOCUMENTS

| | | | |
|---|---|---|---|
| EP | 1 170 716 | A1 | 1/2002 |
| EP | 1 223 671 | A2 | 7/2002 |
| JP | 3-293813 | | 12/1991 |
| JP | 4-56888 | | 2/1992 |
| JP | 5-142572 | | 6/1993 |
| JP | 5-142573 | | 6/1993 |
| JP | 05-142573 | A | 6/1993 |
| JP | 5-291917 | | 11/1993 |
| JP | 10-254412 | | 9/1998 |
| JP | 2000-194323 | A | 7/2000 |
| JP | 2001-326545 | A | 11/2001 |
| JP | 2002-517806 | A | 6/2002 |
| WO | WO 99/65011 | | 12/1999 |
| WO | WO 02/45066 | A1 | 6/2002 |

OTHER PUBLICATIONS

German Office Action dated Apr. 11, 2007.

* cited by examiner

SAMPLE HOLD CIRCUIT AND IMAGE DISPLAY DEVICE USING THE SAME

TECHNICAL FIELD

The present invention relates a sample hold circuit and an image display device using the same, and particularly to a sample hold circuit, which samples an input potential, holds the sampled potential and outputs the same, as well as an image forming apparatus using the sample hold circuit.

BACKGROUND ART

FIG. 76 is a circuit diagram showing a major portion of a conventional liquid crystal display device. In the liquid crystal display device shown in FIG. 76, a liquid crystal cell 303 and a sample hold circuit 304 are arranged at a crossing between a scanning line 301 and a data line 302. Sample hold circuit 304 includes a switch 305 and a capacitor 307. Switch 305 is connected between data line 302 and a node N300, and keeps the on position while scanning line 301 is at a selected level of an "H" level. Switch 305 has a parasitic resistance. In FIG. 76, the parasitic resistance is represented as a resistance element 306 connected in parallel with switch 305. Capacitor 307 is connected between node N300 and a line of a common potential VCOM. Liquid crystal cell 303 is connected between node N300 and the line of common potential VCOM.

When scanning line 301 is raised to the selected level of "H", switch 305 is turned on to charge node N300 to attain the potential of data line 302. When scanning line 301 falls to an unselected level of "L", switch 305 is turned off, and capacitor 307 holds the potential of node N300. Liquid crystal cell 303 exhibits a light transmissivity corresponding to the potential of node N300.

In the conventional liquid crystal display device, however, when the potential of data line 302 changes when scanning line 301 is at the "L" level, a leak current flows between node N300 and data line 302 through resistance element 306 so that the potential of node N300 changes. Therefore, the potential of node N300 must be refreshed (rewritten) at predetermined intervals, which consumes a relatively large power.

DISCLOSURE OF THE INVENTION

Accordingly, a major object of the invention is to provide a sample hold circuit, which can suppress changes in held potential, as well as an image display device using the same.

A sample hold circuit according to the invention includes a first switching element receiving an input potential of one of its electrodes, and being turned on for a first period; a second switching element connected at one of its electrodes to the other electrode of the first switching element, and being on for a second period; a first capacitor connected at one of its electrodes to the other electrode of the second switching element, and receiving on the other electrode a predetermined potential; and a drive circuit having an input node connected to the other electrode of the second switching element and an output node connected to the other electrode of the first switching element, and providing a potential corresponding to a potential of the input node to the output node. Therefore, even when the input potential changes after the input potential is sampled by turning on the first and second switching elements for the first and second periods, respectively, the drive circuit holds the potential of the other electrode of the first switching element so that changes in the sampled potential can be suppressed.

An image display device according to the invention includes the sample hold circuit described above, and a liquid crystal cell or a light-emitting element driven by the output potential of the sample hold circuit described above. In this device, refreshing of a gradation potential or a gradation current is required less frequently so that the power consumption can be reduced.

BEST MODES FOR CARRYING OUT THE INVENTION

First Embodiment

Figure 1:
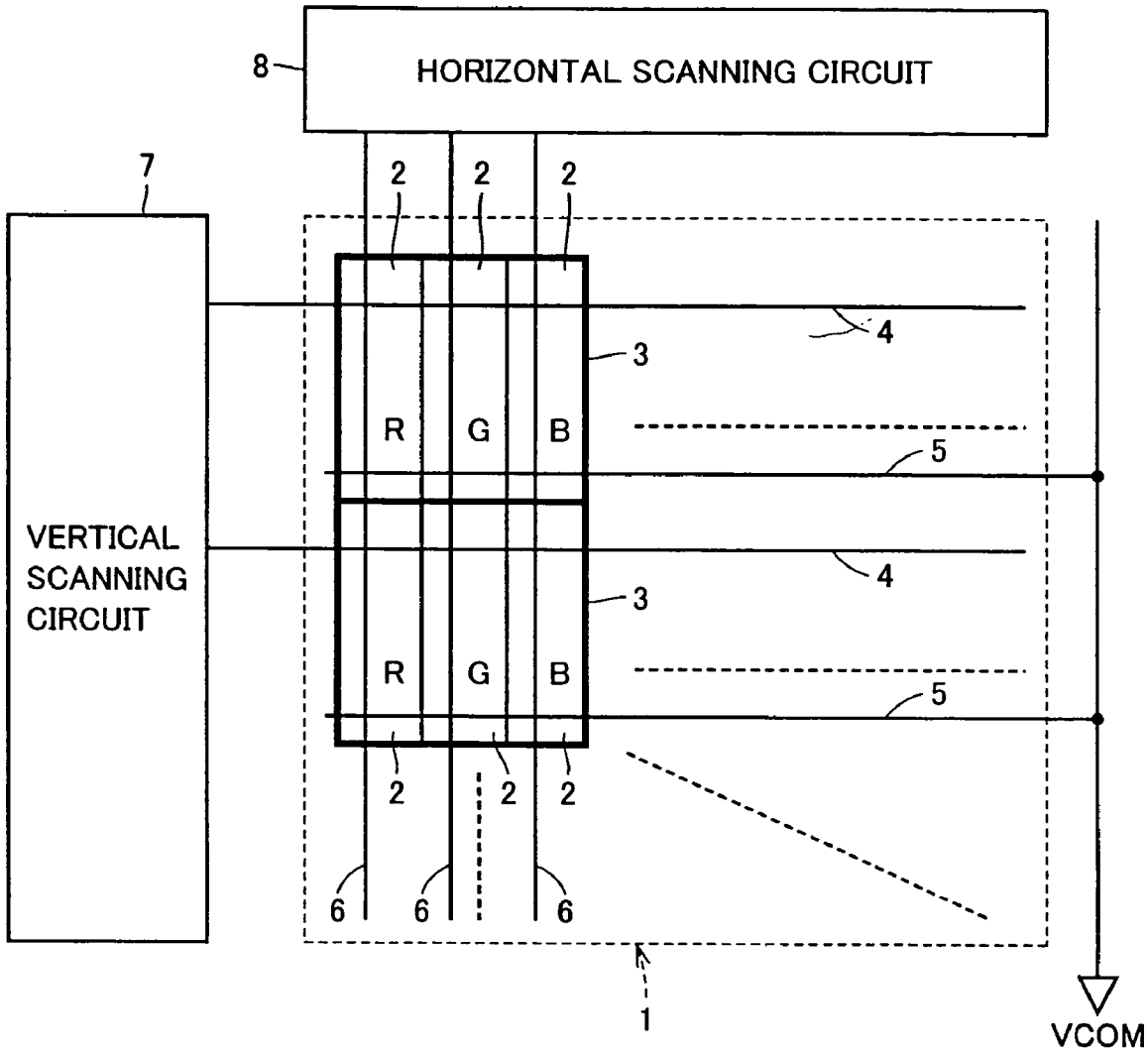
FIG. 1 is a block diagram showing a whole structure of a color liquid crystal display device according to a first embodiment of the invention.

FIG. 1 is a block diagram showing a structure of a color liquid crystal display device according to a first embodiment of the invention. In FIG. 1, the color liquid crystal display device includes a liquid crystal panel 1, a vertical scanning circuit 7 and a horizontal scanning circuit 8, and is arranged, e.g., in a cellular phone.

Liquid crystal panel 1 includes a plurality of liquid crystal cells 2 arranged in multiple rows and multiple columns, scanning lines 4 provided corresponding to the rows, respectively, common potential lines 5 provided corresponding to the rows, respectively, and data lines 6 provided corresponding to the columns, respectively.

Liquid crystal cells 2 in each row are divided into groups each including three liquid crystal cells 2, which are provided with color filters of R, G and B, respectively. Three liquid crystal cells 2 in each group form one pixel 3.

Vertical scanning circuit 7 successively selects the plurality of scanning lines 4 in accordance with an image signal, and keeps each selected scanning line 4 at a selected level of "H" for a predetermined time period. When scanning line 4 is in the selected level of "H", each liquid crystal cell 2 corresponding the selected scanning line 4 is coupled to data line 6 corresponding to liquid crystal cell 2 in question.

Horizontal scanning circuit 8 successively selects, e.g., 12 data lines 6 in accordance with the image signal while vertical scanning circuit 7 is keeping one scanning line 4 in the selected state, and applies a gradation potential VG to each data line 6 thus selected. Liquid crystal cell 2 has a light transmissivity varying in accordance with the level of gradation potential VG.

When vertical and horizontal scanning circuits 7 and 8 scan all liquid crystal cells 2 in liquid crystal panel 1, liquid crystal panel 1 displays one image.

Figure 2:
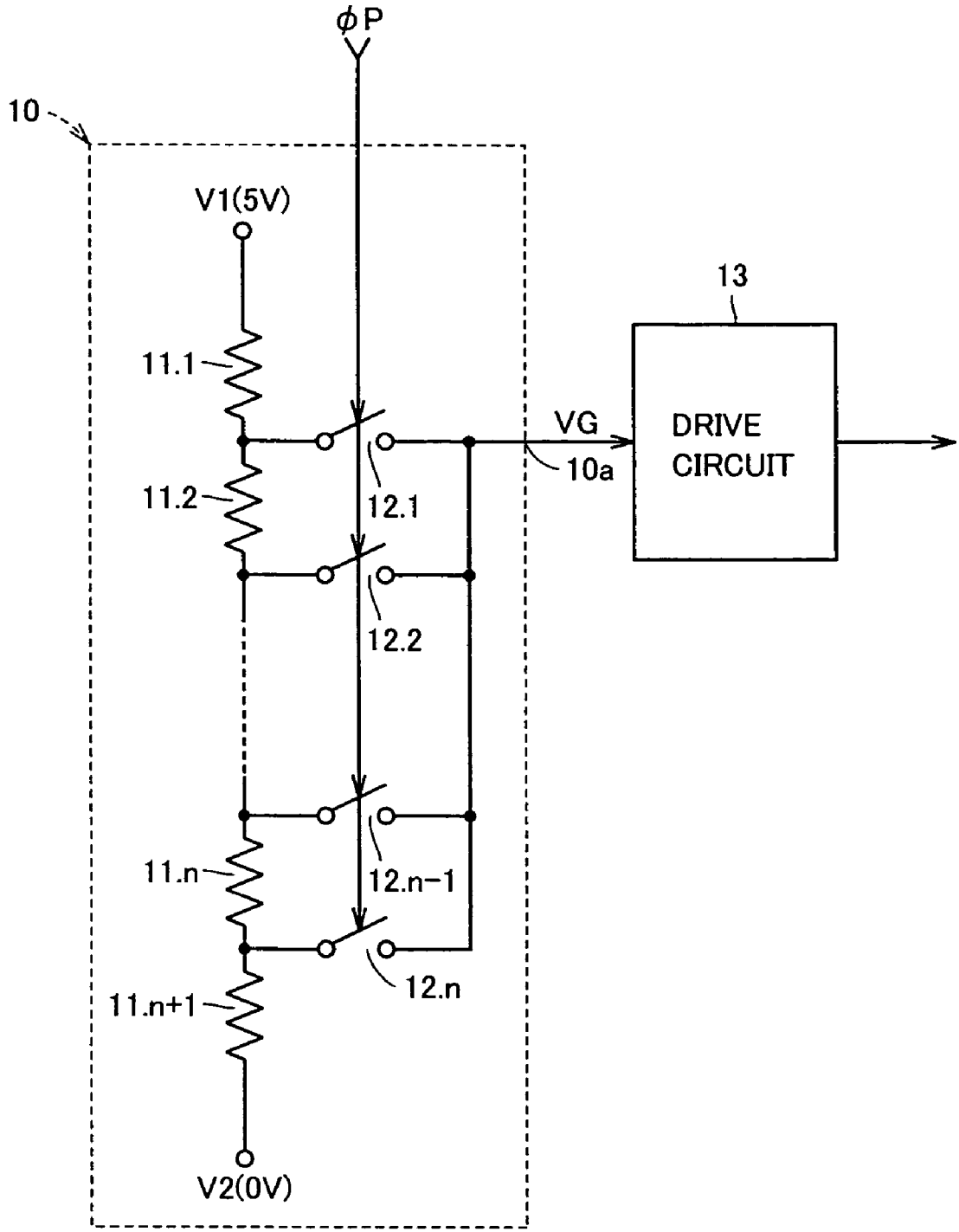
FIG. 2 is a circuit block diagram showing a major portion of a horizontal scanning circuit shown in FIG. 1.

FIG. 2 is a circuit block diagram showing a major portion of horizontal scanning circuit 8 shown in FIG. 1. In FIG. 2, horizontal scanning circuit 8 includes a gradation potential generating circuit 10 and a drive circuit 13. Gradation potential generating circuit 10 and drive circuit 13 are equal in number (i.e., 12 in this structure) to data lines 6, which are simultaneously selected by horizontal scanning circuit 8.

Gradation potential generating circuit 10 includes resistance elements 11.1-11.n+1 of (n+1) in number (where n is a natural number) arranged between a node of a first power supply potential V1 of 5 V and a second power supply potential V2 of 0V, and also includes switches 12.1-12.n of n in number each connected between one of nodes of n in number, which are located between (n+1) resistance elements 11.1-11.n+1, and an output node 10*a*.

Potentials at n levels appear in the n nodes between (n+1) resistance elements 11.1-1-11.n+1, respectively. Switches 12.1-12.n are controlled by an image density signal ϕP so that only one of these switches is turned on. One of the potentials at n levels is provided as gradation potential VG to output node 10*a*. Drive circuit 13 supplies a current to data line 6 so that selected data line 6 may have gradation potential VG.

Figure 3:
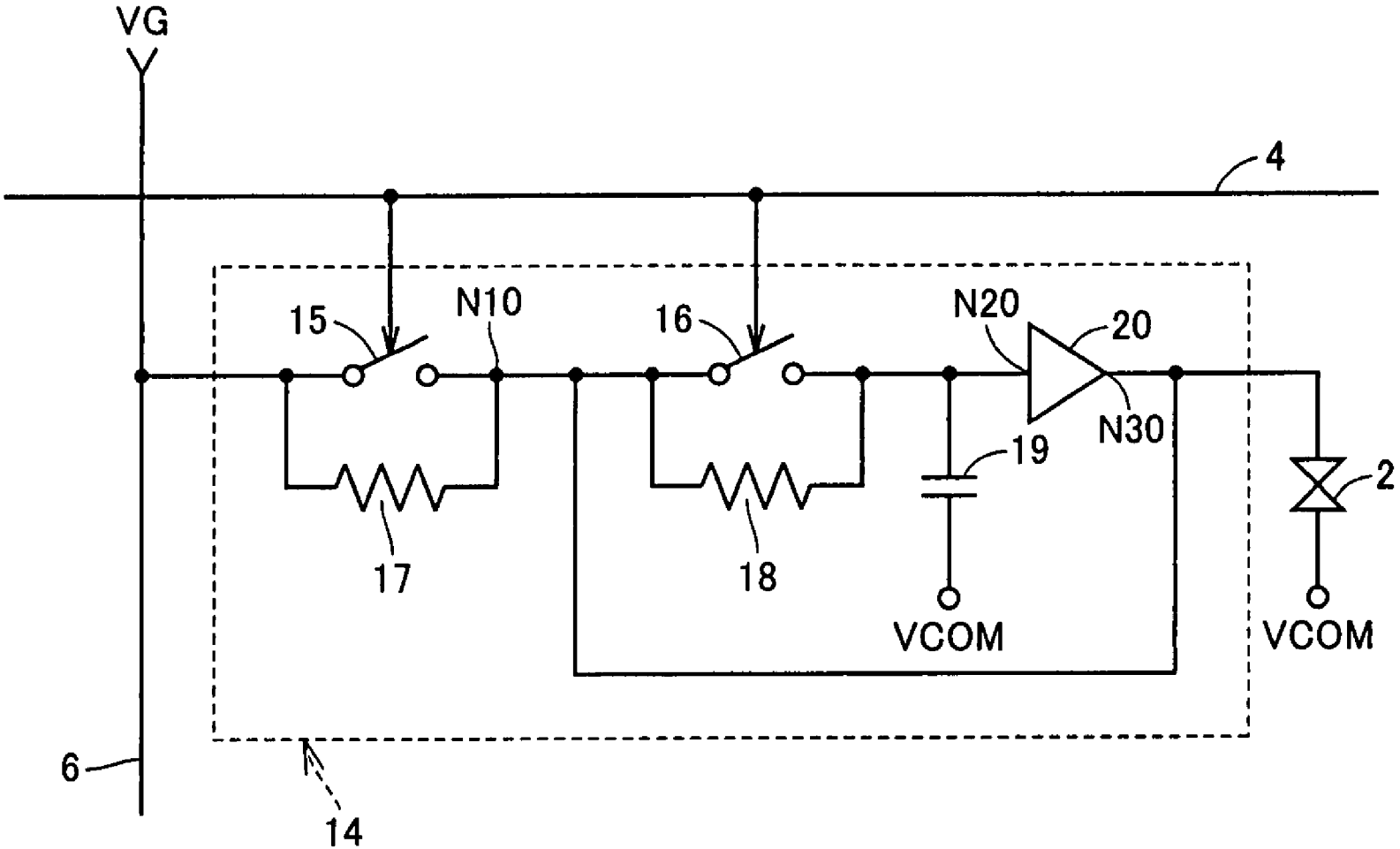
FIG. 3 is a circuit diagram showing a structure of a sample hold circuit provided corresponding to each liquid crystal cell.

FIG. 3 is a circuit diagram showing a structure of a sample hold circuit 14 provided for each liquid crystal cell 2. In FIG. 3, sample hold circuit 14 includes switches 15 and 16, a capacitor 19 and a drive circuit 20. Switches 15 and 16 are connected in series between corresponding data line 6 and an input node N20 of drive circuit 20. Both switches 15 and 16 are turned on when corresponding scanning line 4 is in the selected level of "H", and are turned off when corresponding scanning line 4 is in the unselected level of "L".

A parasitic resistance is present between terminals of each of switches 15 and 16. In FIG. 3, the parasitic resistances of switches 15 and 16 are represented as resistance elements 17 and 18, respectively. Resistance elements 17 and 18 are connected in parallel with switches 15 and 16, respectively. Each of switches 15 and 16 is formed of, e.g., an N-type transistor, a P-type transistor or a combination of N- and P-type transistors connected in parallel with each other. Scanning line 4 is directly connected to gates of the N-type transistors included in switches 15 and 16. Scanning line 4 is connected to gates of the P-type transistors included in switches 15 and 16 through inverters, respectively.

One of electrodes of capacitor 19 is connected to node N20, and the other electrode of capacitor 19 receives common potential VCOM from common potential line 5. Drive circuit 20 provides a potential equal to that of input node N20 to an output node N30. Output node N30 of drive circuit 20 is connected to a node N10 between switches 15 and 16, and is also connected to one of the electrodes of liquid crystal cell 2. The other electrode of liquid crystal cell 2 receives common potential VCOM.

Sample hold circuit 14 operates as follows. When scanning line 4 is set to the selected level of "H", switches 15 and 16 are turned on, and nodes N10, N20 and N30 have the potentials equal to that of data lines 6. When scanning line 4 is set to the unselected level of "L", capacitor 19 holds the potential of node N20. Also, drive circuit 20 holds the potential of node N11 to be equal to that of node N20. The potential of node N20 is affected by changes in potential of data line 6 through resistance elements 17 and 18, and thereby tends to change. However, drive circuit 20 holds the potential of node N10 so that the changes in potential of data line 6 affect the potential of node N10 only to a smaller extent than a conventional structure.

Figure 4:
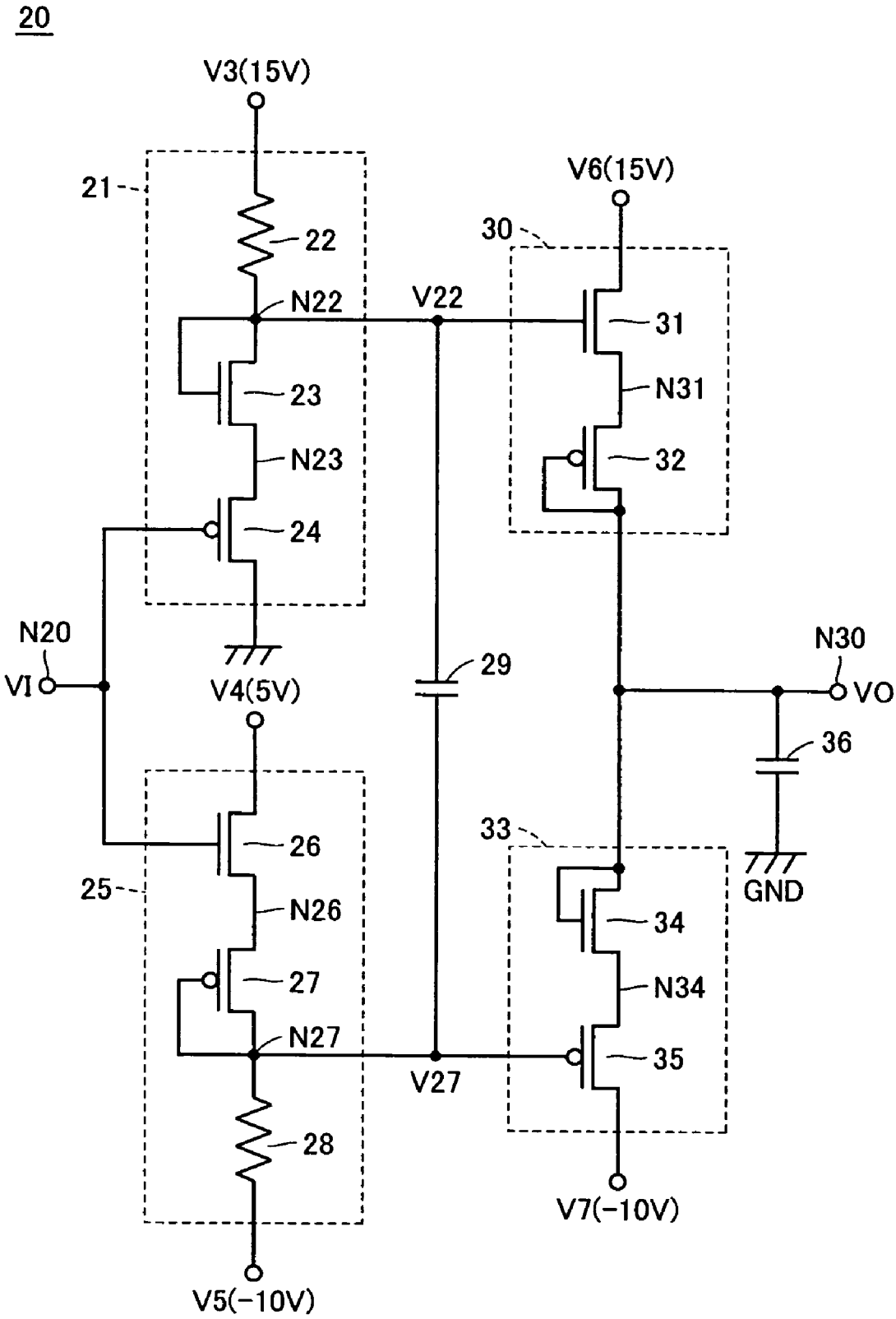
FIG. 4 is a circuit diagram showing a structure of a drive circuit shown in FIG. 3.

FIG. 4 is a circuit diagram showing a structure of drive circuit 20. In FIG. 4, drive circuit 20 includes level shift circuits 21 and 25, a capacitor 29, a pull-up circuit 30 and a pull-down circuit 33.

Level shift circuit 21 includes a resistance element 22 as well as N- and P-type field-effect transistors 23 and 24, which will be merely referred to as "N- and P-type transistors", respectively. These resistance element 22 and N- and P-type field-effect transistors 23 and 24 are connected in series between a node of a third power supply potential V3 of 15V and a node of a ground potential GND. A gate of N-type transistor 23 is connected to its drain (node N22). N-type transistor 23 forms a diode element. A gate of P-type transistor 24 is connected to input node N20. Resistance element 22 has a resistance value sufficiently larger than the on-resistance values of transistors 23 and 24.

Assuming that input node N20 has a potential (gradation potential) VI, the P-type transistor has a threshold voltage VTP and N-type transistor has a threshold voltage VTN, a potential V23 of a source (node N23) of P-type transistor 24 and a potential V22 of a drain (node N22) of N-type transistor 23 are expressed by the following formulas (1) and (2), respectively:

$$V23 = VI + |VTP| \quad \text{(b 1)}$$

$$V22 = VI + |VTP| + VTN \quad (2)$$

Therefore, level shift circuit 21 provides potential V22 by shifting the level of input potential VI by (|VTP|+VTN).

Level shift circuit 25 includes an N-type transistor 26, a P-type transistor 27 and a resistance element 28, which are connected in series between a node of a fourth power supply potential V4 of 5 V and a fifth power supply potential V5 of −10 V. A gate of N-type transistor 26 is connected to input node N20. A gate of P-type transistor 27 is connected to its drain (node N27). P-type transistor 27 forms a diode element. Resistance element 28 has a resistance value sufficiently larger than the on-resistance values of transistors 26 and 27.

A potential V26 of a source (node N26) of N-type transistor 26 and a potential V27 of a drain (node N27) of P-type transistor 27 are expressed by the following formulas (3) and (4), respectively:

$$V26=VI-VTN \quad (3)$$

$$V27=VI-VTN-|VTP| \quad (4)$$

Therefore, level shift circuit 25 provides potential V27 by shifting the level of input potential VI by (−VTN−|VTP|).

Capacitor 29 is connected between output node N22 of level shift circuit 21 and output node N27 of level shift circuit 25. Capacitor 29 transmits potential changes of node N22 to node N27, and transmits potential changes of node N27 to node N22.

Pull-up circuit 30 includes an N-type transistor 31 and a P-type transistor 32 connected in series between a node of a sixth power supply potential V6 of 15 V and output node N30. Output node N30 is connected to a load capacitance (parasitic capacitances of liquid crystal cell 2 and switches 15 and 16) 36. A gate of N-type transistor 31 receives output potential V22 of level shift circuit 21. A gate of P-type transistor 32 is connected to its drain. P-type transistor 32 forms a diode element. Since sixth power supply potential V6 is set to operate N-type transistor 31 in a saturation region, N-type transistor 31 performs a so-called source-follower operation.

Figure 5:
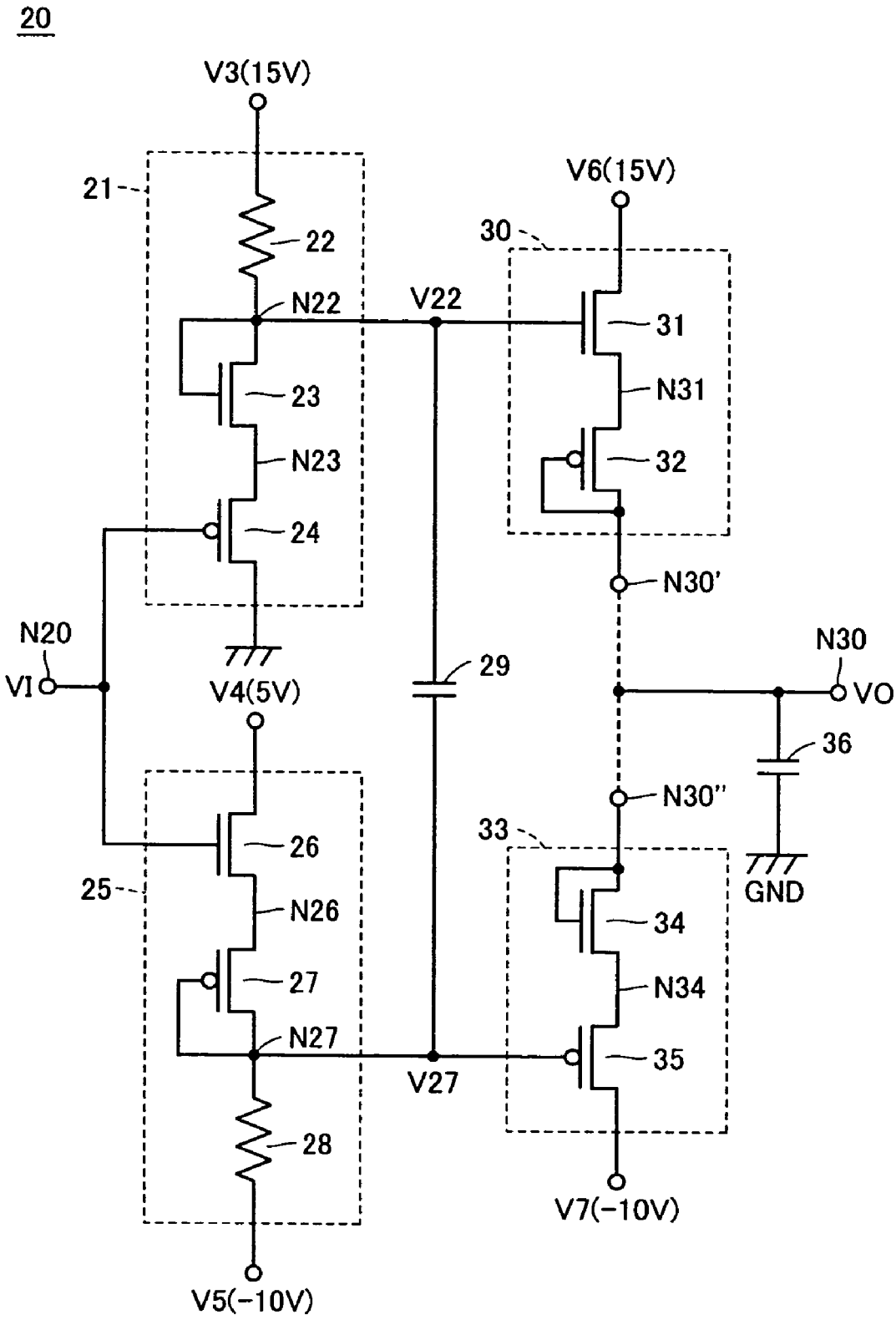
FIG. 5 is a circuit diagram for illustrating an operation of the drive circuit shown in FIG. 4.

For the sake of illustration, it is assumed that a drain (node N30') of P-type transistor 32 is isolated from output node N30 as shown in FIG. 5. In this case, a potential V31 of a source (node N31) of N-type transistor 31 and a potential V30' of a drain (node N30') of P-type transistor 32 are expressed by the following formulas (5) and (6), respectively.

$$V31=V22-VTN=VI+|VTP| \quad (5)$$

$$V30'=V31-|VTP|=VI \quad (6)$$

Returning to FIG. 4, pull-down circuit 33 includes a P-type transistor 35 and an N-type transistor 34 connected in series between a node of a seventh power supply potential V7 of −10 V and output node N30. A gate of P-type transistor 35 receives output potential V27 of level shift circuit 25. A gate of N-type transistor 34 is connected to its drain. N-type transistor 34 forms a diode element. Since seventh power supply potential V7 is set to operate P-type transistor 35 in a saturation region, P-type transistor 35 performs a so-called source-follower operation.

For the sake of illustration, it is assumed that a drain (node N30") of N-type transistor 34 is isolated from output node N30 as shown in FIG. 5. In this case, a potential V34 of a source (node N34) of P-type transistor 35 and a potential V30" of a drain (node N30") of N-type transistor 34 are expressed by the following formulas (7) and (8), respectively.

$$V34=V27+|VTP|=VI-VTN \quad (7)$$

$$V30''=V34+VTN=VI \quad (8)$$

Figure 6:
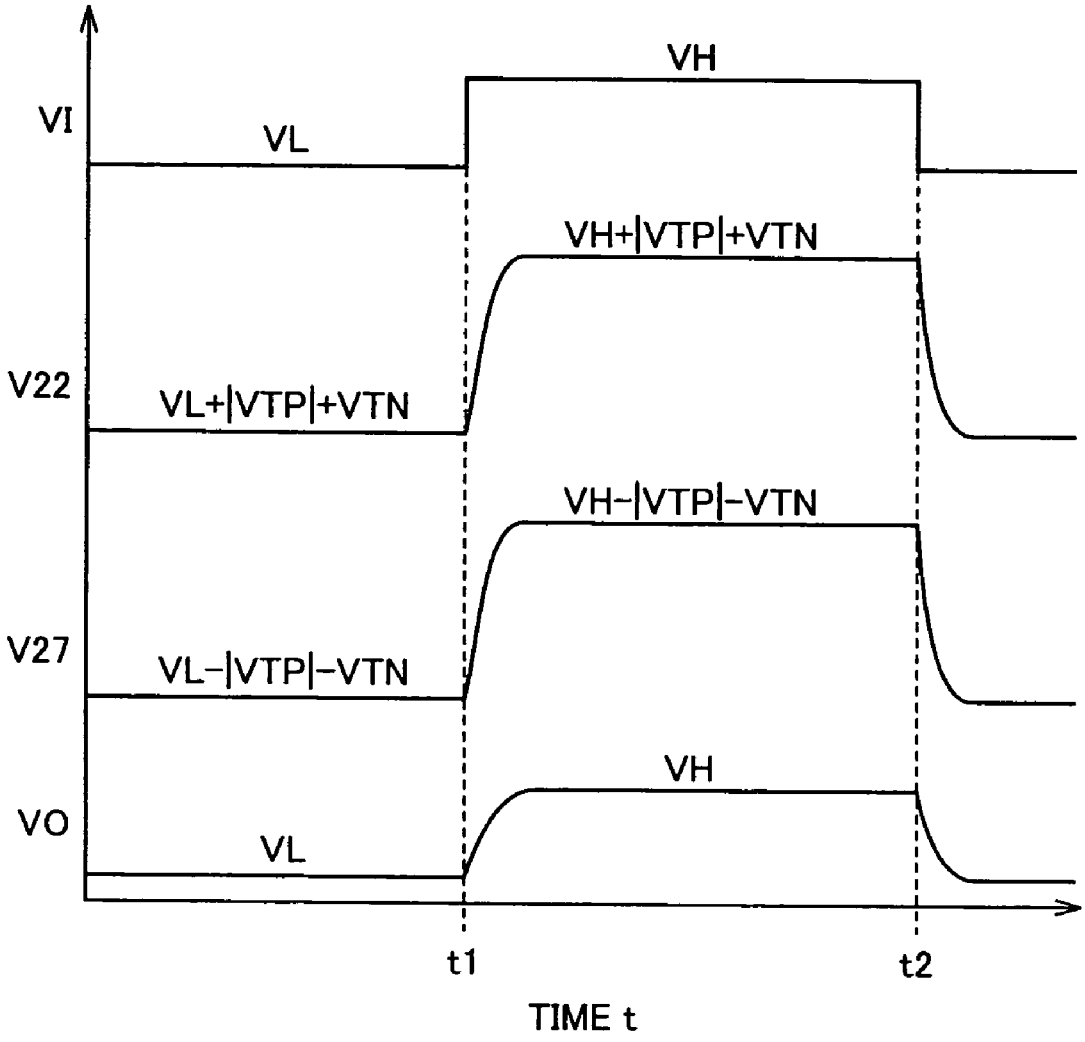
FIG. 6 is a time chart for illustrating the operation of the drive circuit shown in FIG. 4.

The formulas (7) and (8) represent that even if the drain (node N30') of P-type transistor 32 is connected to the drain (node N30") of N-type transistor 34, a current does not flow between the nodes of sixth and seventh power supply potentials V6 and V7, and a potential VO of output node N30 becomes equal to potential VI of input node N20. Therefore, by sufficiently increasing the resistance values of resistance elements 22 and 28, a through-current can be extremely reduced in a steady state of VO=VI FIG. 6 is a time chart for illustrating an AC operation (i.e., operation in a transition) of drive circuit 20. In FIG. 6, VI is initially equal to VL. In the initial state, therefore, V22, V27 and VO can be expressed as follows:

$$V22=VL+|VTP|+VTN$$

$$V27=VL-|VTP|-VTN$$

$$VO=VL$$

When VI rises from VL to VH at a time t1, V22, V27 and VO change as follows when a predetermined time elapses.

$$V22=VH+|VTP|+VTN$$

$$V27=VH-|VTP|-VTN$$

$$VO=VH$$

During the above level changing, the following operation is performed. When input potential VI rises from VL to VH at a time t1, the drive capability of N-type transistor 26 in level shift circuit 25 increases, and potential V26 of node N26 rapidly rises. Thereby, a source-gate voltage (i.e., voltage between the source and gate) of P-type transistor 27 increases so that the drive capability of P-type transistor 27 increases, and potential V27 of node N27 rapidly rises.

When potential V27 of node N27 rapidly rises, the capacity coupling performed through capacitor 29 rapidly raises potential V22 of node N22 by (VH−VL). In accordance with this, potential VO of output node N30 rapidly rises from VL to VH.

When input potential VI falls from VH to VL at a time t2, the drive capability of P-type transistor 24 rises, and potential V23 of node N23 rapidly lowers. Thereby, a gate-source voltage of N-type transistor 23 increases so that the drive capability of N-type transistor 23 rises, and potential V22 of node N22 rapidly lowers.

When potential V22 of node N22 rapidly lowers, the capacity coupling performed through capacitor 29 rapidly lowers potential V27 of node N27 by (VH−VL). In accordance with this, potential VO of output node N30 rapidly falls from VH to VL.

When drive circuit 20 is in the steady state, a through-current does not flow through pull-up circuit 30 and pull-down circuit 33, and the through-currents of level shift circuits 21 and 25 can be sufficiently reduced by sufficiently increasing the on-resistance values of resistance elements 22 and 26, as compared with the on-resistance values of transistors 23, 24, 26 and 27, so that the DC current can be reduced. Since capacitor 29 is employed, it is possible to increase the responsivity to the changes in input potential VI.

In this first embodiment, sample hold circuit 14 employs two switches 15 and 16, which are connected in series between data line 6 and input node N20 of drive circuit 20, and drive circuit 20 holds the potential, which is equal to that of node N20, at node N10 between switches 15 and 16. Therefore, it is possible to suppress changes in potential of nodes N10, N20 and N30 even when the potential of data line 6 changes. Accordingly, it is possible to reduce the frequency of required refreshing of the potentials of nodes N10, N20 and N30, and the power consumption can be reduced.

The polarity of the drive voltage of liquid crystal cell 2 may be switched at predetermined intervals, whereby the power consumption of the liquid crystal display device can be reduced. For example, the polarity of the drive voltage of liquid crystal cell 2 can be switched at predetermined intervals in such a manner that first power supply potential V1 in FIG. 2 is switched between 5 V and 0 V at predetermined intervals, second power supply potential V2 is switched between 0 V and 5 V at the predetermined intervals, and common potential VCOM in FIG. 3 is switched between 0 V and 5 V at the predetermined intervals.

Naturally, sample hold circuit 14 is not restricted to the use for sampling and holding of the gradation potential in the liquid crystal display device or another image display device, and it may be used in various ranges, in which an analog potential is sampled and held for providing it to a load circuit.

Also, drive circuit 20 is not restricted to the use for transmitting the gradation potential in the liquid crystal display device or another image display device, and it may be used in various ranges as an analog buffer for controlling the potential of the output node to be equal to an input analog potential.

Field-effect transistors in drive circuit 20 may be MOS transistors or TFTs (Thin Film Transistors). The resistance element may be made of high-dielectric metal, or may be made of an impurity-diffused layer. Also, it may be made of a field-effect transistor for reducing an occupied area.

If the field-effect transistor is formed of a TFT, the resistance element may be formed of an intrinsic a-Si thin film. More specifically, the TFT may be formed in such a manner that a gate electrode is formed on a surface of the intrinsic a-Si thin film formed on a glass substrate, impurities are introduced from a position above the gate electrode into predetermined regions to form a source and a drain on the opposite sides of the gate electrode. A channel region is formed of a portion, which was masked with the gate electrode and thus is not doped with impurities. A resistance value of the channel region, in which a channel is not formed, and thus a resistance value of the TFT in the off state are on the order of $10^{12}$ Ω.

If the resistance element had the same sizes as the transistor, the resistance element would have the resistance value similar to that of the transistor in the off state, and the resistance elements and the transistors would divide and lower power supply voltages V3 and (V4−V5) of level shift circuits 21 and 25 so that intended potentials could not be achieved. For preventing this, the resistance element must have a smaller resistance value than the transistor. For example, the resistance element may have a width 10 to 100 times larger than the width of the transistor so that the resistance value of the resistance element may be 1/10-1/100 times larger than the resistance value of the transistor. Alternatively, the resistance element may be formed of an a-Si film doped with impurities, whereby the resistance value of the resistance element can be reduced without increasing an area of the resistance element.

Figure 7:
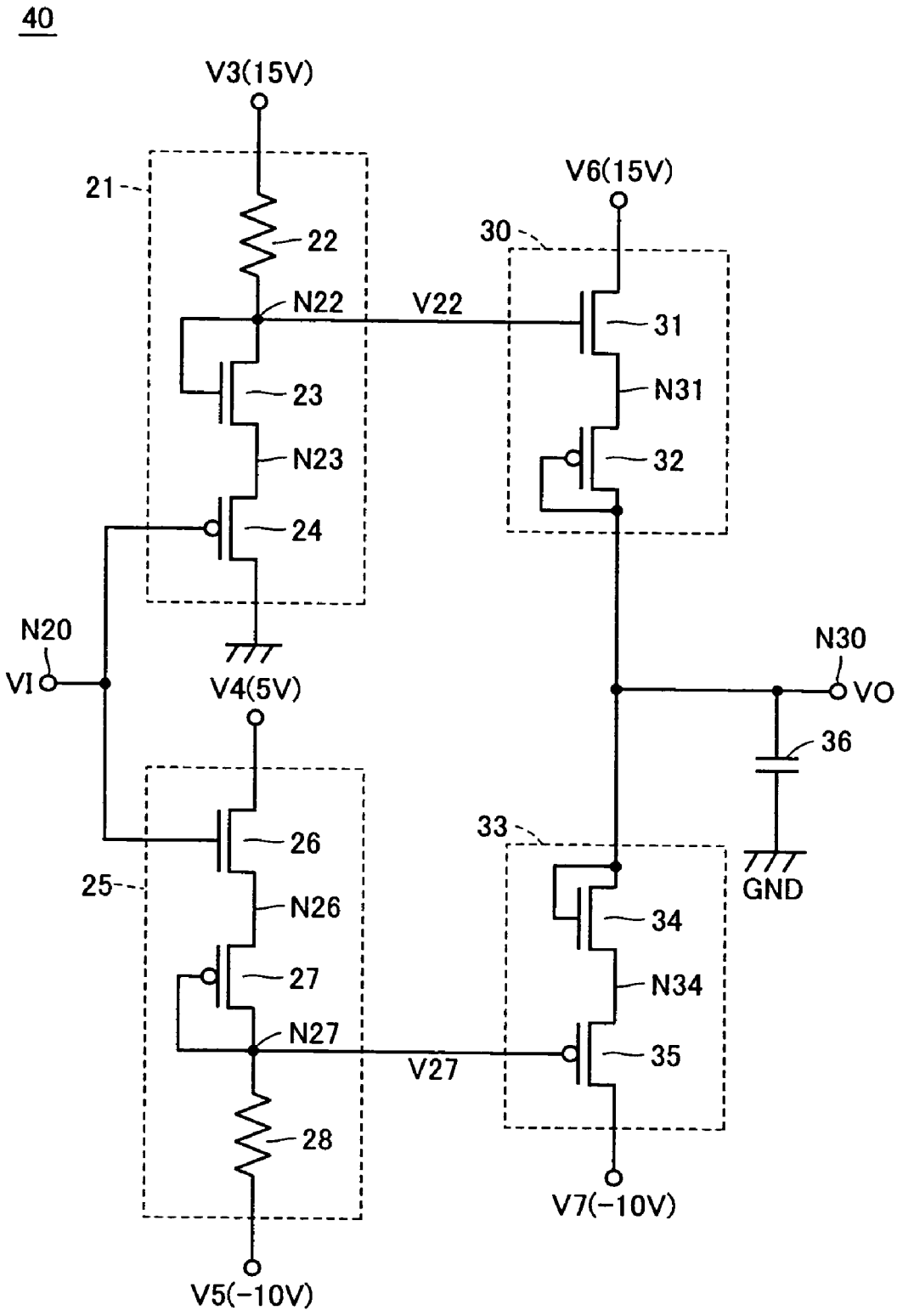
FIG. 7 is a circuit diagram showing a modification of the first embodiment.

Various variations will be described below. A drive circuit 40 in FIG. 7 is substantially the same as drive circuit 20 in FIG. 4 except for that capacitor 29 is eliminated. If load capacitance 36 has a relatively small capacitance value, sizes of transistors 23, 24, 26, 27, 31, 32, 34 and 35 can be reduced. If the sizes of transistors 23, 27, 31 and 35 are reduced, gate capacitances of transistors 23, 27, 31 and 35 decrease, and parasitic capacitances of nodes N22 and N27 decrease. Therefore, potentials V22 and V27 of nodes N22 and N27 can be raised and lowered by the charging and discharging, which are performed through resistance elements 22 and 28, although capacitor 29 is eliminated. In this modification, since capacitor 29 is eliminated, an area occupied by the circuit can be small.

Figure 8:
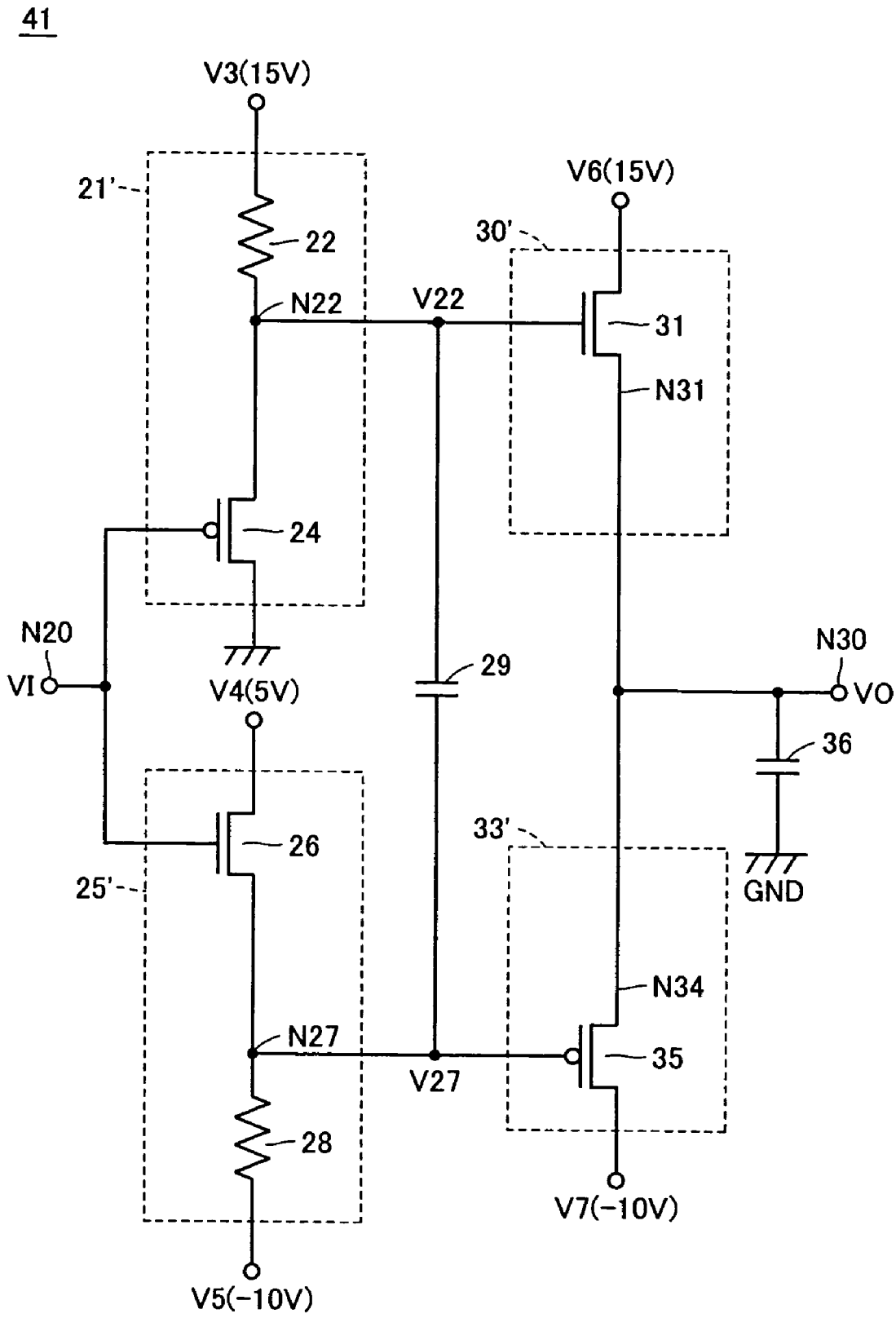
FIG. 8 is a circuit diagram showing another modification of the first embodiment.

A drive circuit 41 in FIG. 8 is substantially the same as drive circuit 20 in FIG. 4 except for that diode-connected transistors 23, 27, 32 and 34 are eliminated. Output potential VO is equal to (VI+|VTP|−VTN). If |VTP| is set nearly equal to VTN, VO is nearly equal to VI. Alternatively, consideration may be given to use the value of (|VTP|−VTN) as an offset value. Thereby, drive circuit 41 can be used similarly to drive circuit 20 in FIG. 4. In this modification, since transistors 23, 27, 32 and 34 are eliminated, an area occupied by the circuit can be small.

Figure 9:
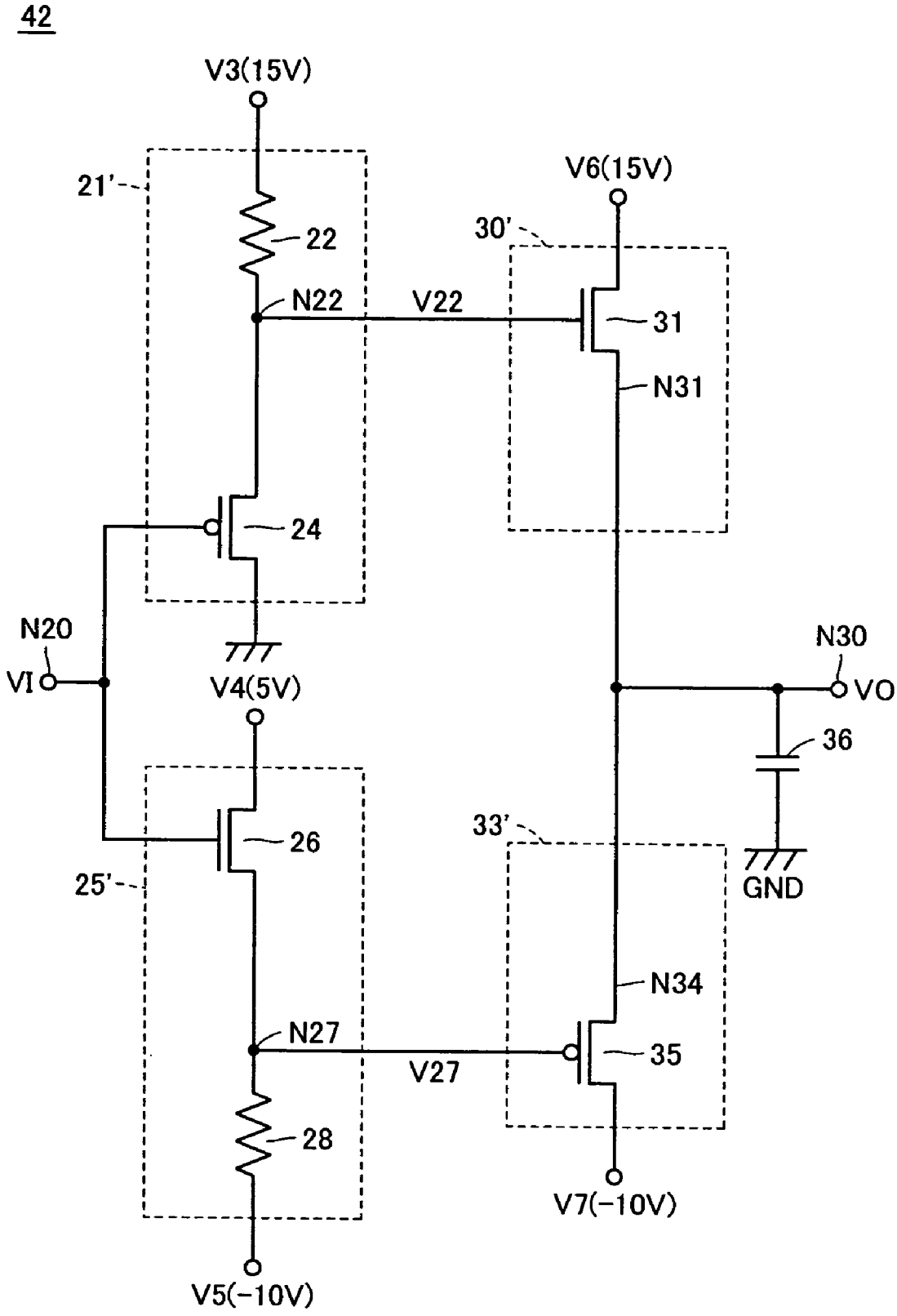
FIG. 9 is a circuit diagram showing still another modification of the first embodiment.

A drive circuit 42 in FIG. 9 is substantially the same as drive circuit 41 in FIG. 8 except for that capacitor 29 is eliminated. If load capacitance 36 has a relatively small capacitance value, the sizes of transistors 24, 26, 31 and 35 can be reduced, and the parasitic capacitances of nodes N22 and N27 can be reduced. Therefore, potentials V22 and V27 of nodes N22 and N27 can be raised and lowered by the charging and discharging performed through resistance elements 22 and 28, although capacitor 29 is eliminated. In this modification, since capacitor 2 is eliminated, the area occupied by the circuit can be further reduced.

Figure 10:
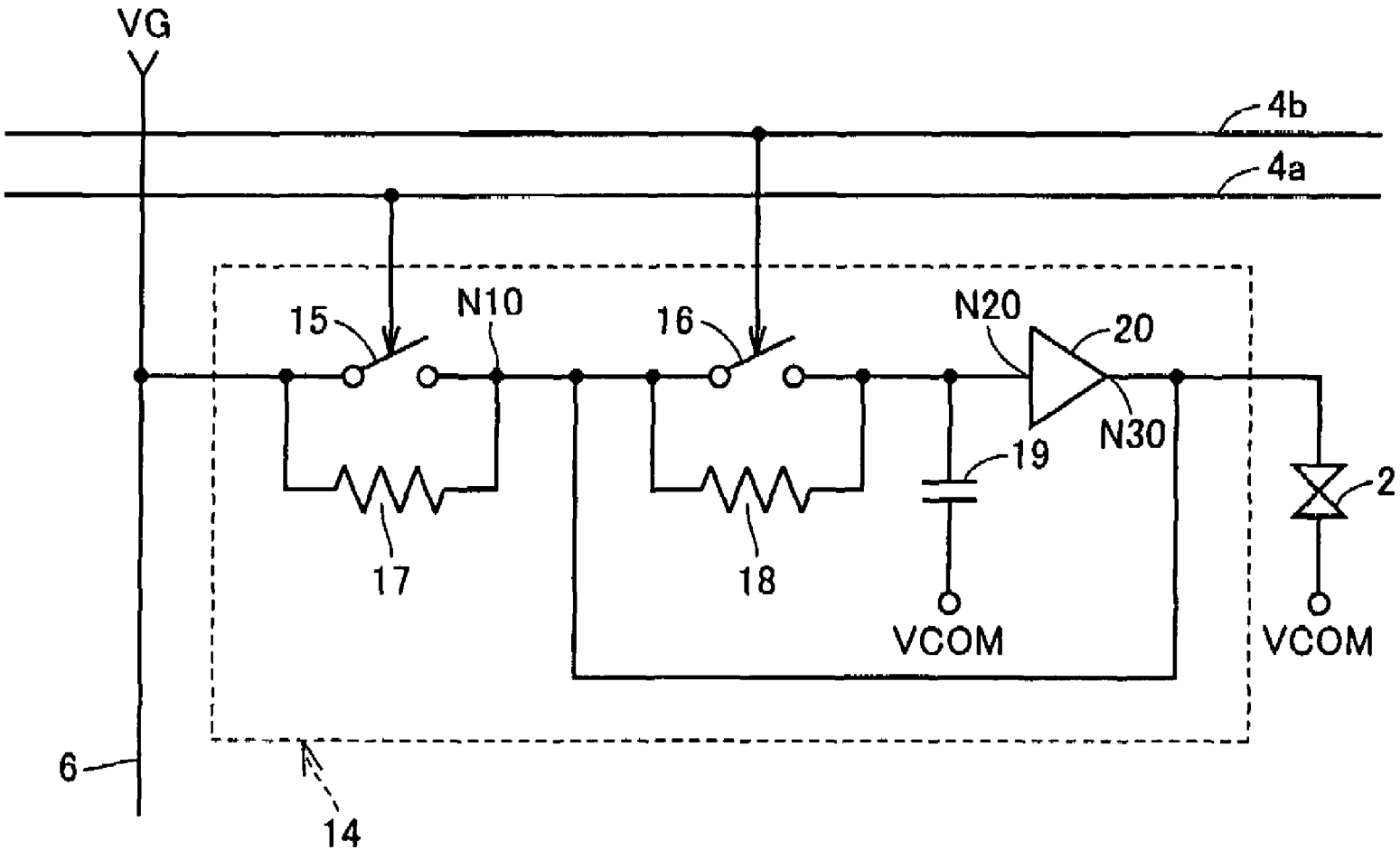
FIG. 10 is a circuit diagram showing yet another modification of the first embodiment.

In a color liquid crystal display device shown in FIG. 10, two scanning lines 4*a* and 4*b* are arranged for each row. Each of switches 15 and 16 is turned on when corresponding scanning line 4*a* or 4*b* is at the selected level of "H". Switches 15 and 16 are simultaneously turned on, and switch 15 will be turned off after switch 16 is turned off. In this case, the stability of the operation of drive circuit 20 can be improved.

Figure 11:
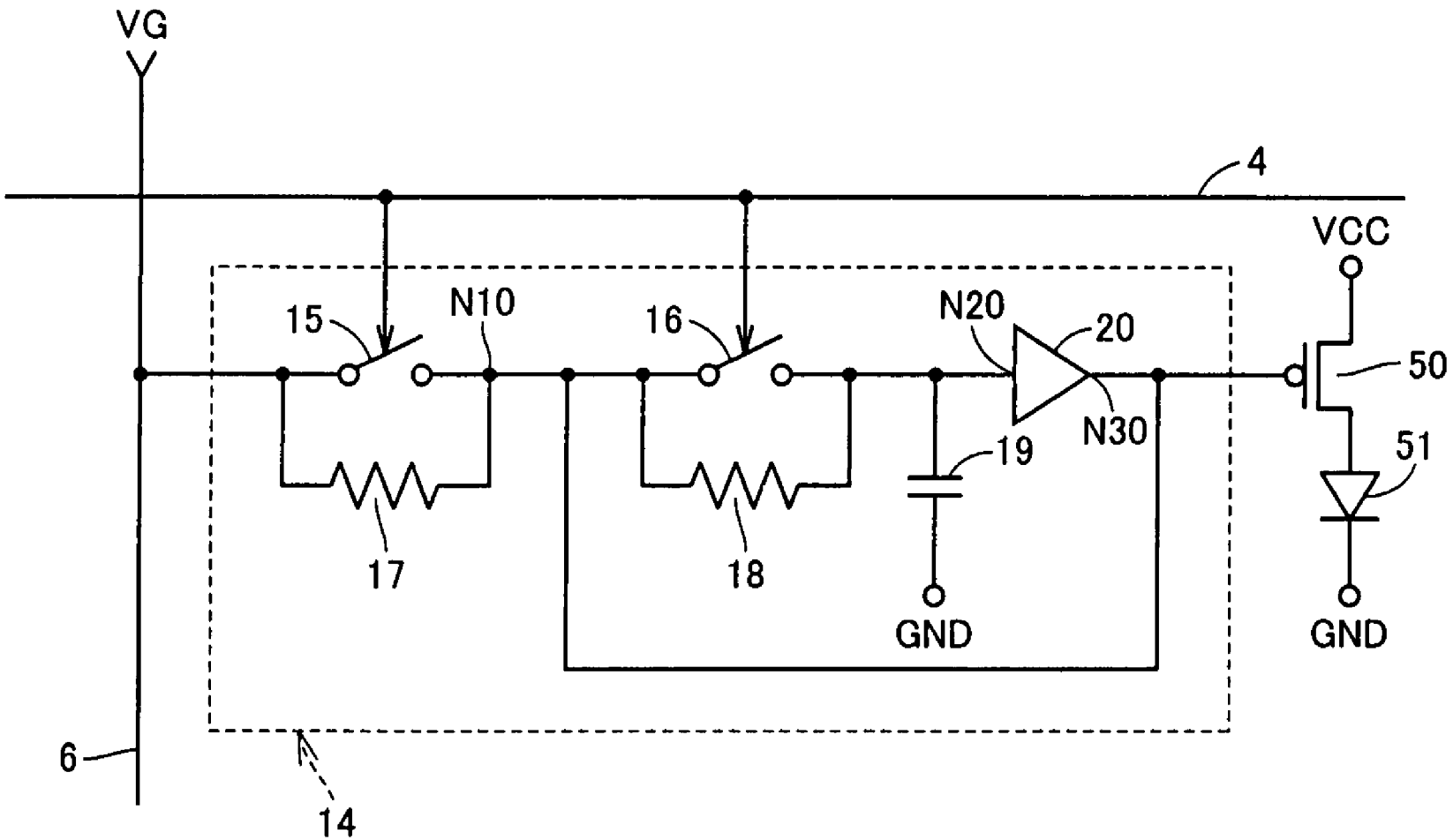
FIG. 11 is a circuit diagram showing further another modification of the first embodiment.

An image display device in FIG. 11 is substantially the same as the color liquid crystal display device of the first embodiment except for that liquid crystal cell 2 is replaced with a P-type transistor 50 and an organic EL (Electro-Luminescence) element 51. P-type transistor 50 and organic EL element 51 are connected in series between a line of a power supply potential VCC and the line of ground potential GND. A gate of P-type transistor 50 is connected to output node N30 of drive circuit 20. In accordance with the output potential of drive circuit 20, the on-resistance value of P-type transistor 50 changes so that the value of current flowing through organic EL element 51 changes. Thereby, brightness of organic EL element 51 changes. Organic EL elements 51 are arranged in rows and columns to form a panel, on which one image is displayed.

Second Embodiment

Figure 12:
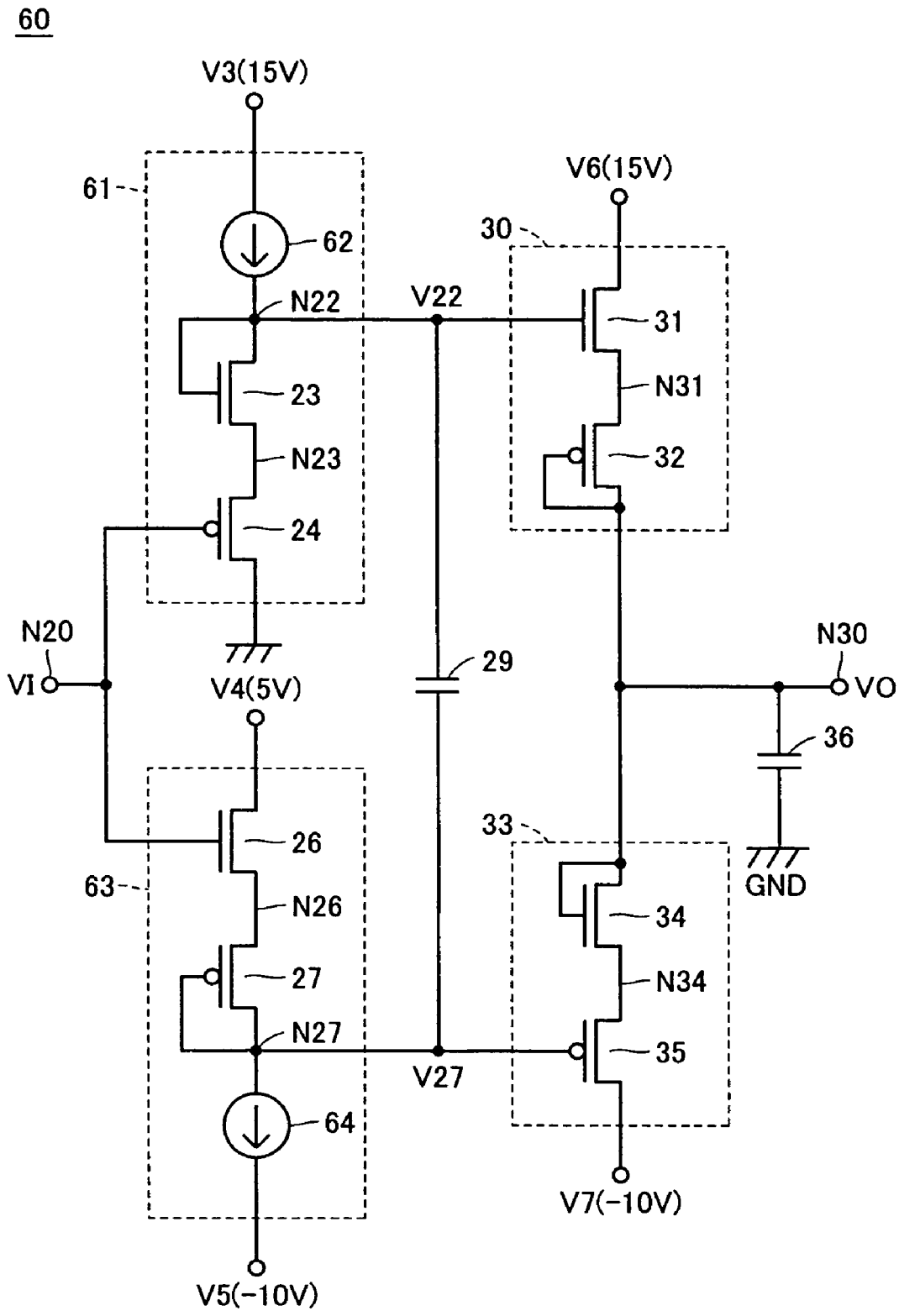
FIG. 12 is a circuit diagram showing a structure of a drive circuit of a sample hold circuit according to a second embodiment of the invention.

FIG. 12 is a circuit diagram showing a structure of a drive circuit 60 of a sample hold circuit according to a second embodiment of the invention. Referring to FIG. 12, drive circuit 60 differs from drive circuit 20 in FIG. 4 in that level shift circuits 21 and 25 are replaced with level shift circuits 61 and 63, respectively. Level shift circuit 61 differs from level shift circuit 21 in that resistance element 22 is replaced with a constant current supply 62. Level shift circuit 63 differs from level shift circuit 25 in that resistance element 28 is replaced with a constant current supply 64.

Figure 13:
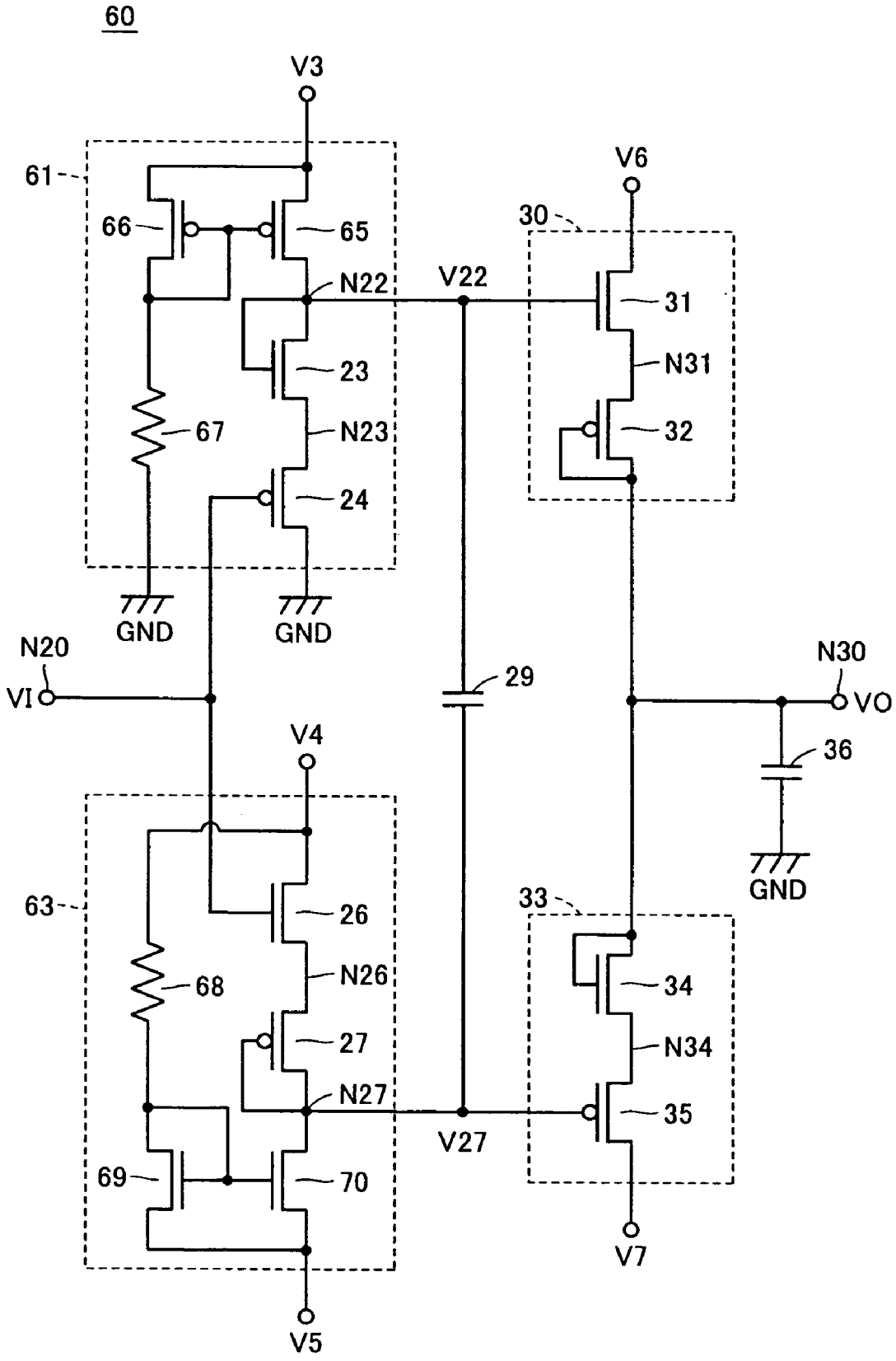
FIG. 13 is a circuit diagram showing more specifically a structure of the drive circuit shown in FIG. 12.

Constant current supply 62 includes P-type transistors 65 and 66 as well as resistance element 67 as shown in FIG. 13. P-type transistor 65 is connected between the line of third power supply potential V3 and node N22, and P-type transistor 66 and resistance element 67 are connected in series between the line of third power supply potential V3 and the line of ground potential GND. The gates of P-type transistors 65 and 66 are both connected to a drain of P-type transistor 66.

P-type transistors 65 and 66 form a current mirror circuit. A constant current of a value corresponding to the resistance value of resistance 67 flows through P-type transistor 66 and resistance element 67, and a constant current of a value corresponding to the value of the constant current flowing through P-type transistor 66 flows through P-type transistor 65. Although one of the electrodes of resistance element 67 is connected to the line of ground potential GND, this electrode of resistance element 67 may be connected to a line of another power supply potential, which is lower than a potential achieved by subtracting an absolute value |VTP| of the threshold voltage of P-type transistor 66 from third power supply potential V3. As a constant current supply, transistors 65 and 66 as well as resistance element 67 may be replaced with a transistor of a depression type, which has a gate and a source connected together, and is arranged between the line of third power supply potential V3 and node N22.

Constant current supply 64 includes a resistance element 68 and N-type transistor 69 and 70. Resistance element 68 and N-type transistor 69 are connected in series between a line of fourth power supply potential V4 and a line of fifth power supply potential V5. N-type transistor 70 is connected between node N27 and the line of the fifth power supply potential V5. Both gates of N-type transistors 69 and 70 are connected to a drain of N-type transistor 69. N-type transistors 69 and 70 form a current mirror circuit. A constant current corresponding to a value of a resistance value of resistance element 68 flows through resistance element 68 and N-type transistor 69, and a constant current of a value corresponding to the value of the constant current flowing through N-type transistor 69 flows through N-type transistor 70. Although one of electrodes of resistance element 68 is connected to fourth power supply potential V4, this electrode of resistance element 68 may be connected to a line of another power supply potential higher than a potential achieved by adding threshold voltage VTN of N-type transistor 69 to fifth power supply potential V5. As a constant current supply, transistors 69 and 70 as well as resistance element 68 may be replaced with a transistor of a depression type, which has a gate and a source connected together, and is arranged between the line of fifth power supply potential V5 and node N27. Structures and operations other than the above are the same as those of drive circuit 20 shown in FIG. 4, and therefore, description thereof is not repeated.

In the second embodiment, since resistance elements 22 and 28 of drive circuit 20 in FIG. 4 are replaced with constant current supplies 62 and 64, output potential VO equal to input potential VI can be obtained regardless of the value of input potential VI.

Figure 14:
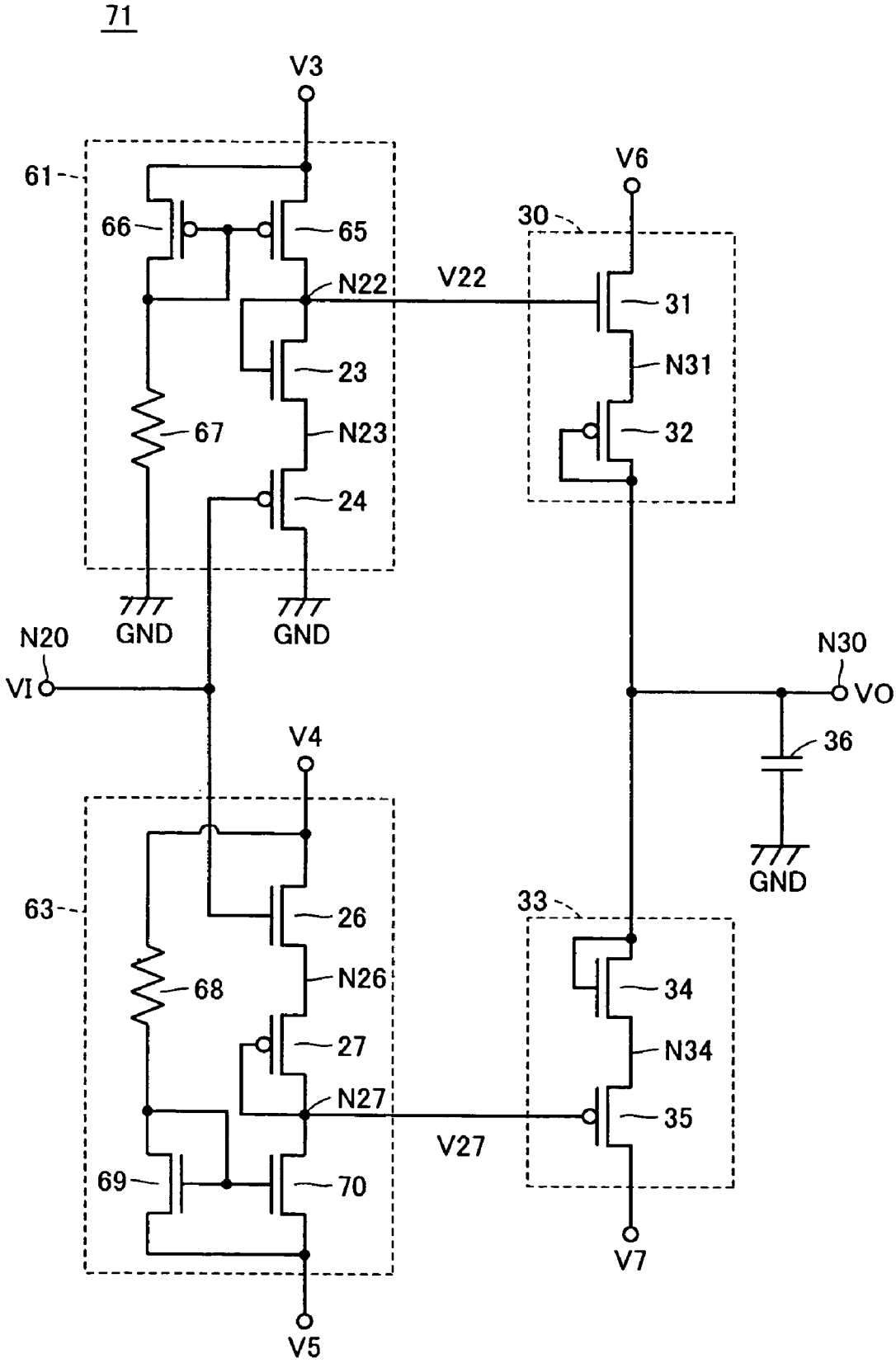
FIG. 14 is a circuit diagram showing a modification of the second embodiment.

Various modifications of the second embodiment will now be described. A drive circuit 71 in FIG. 14 is substantially the same as drive circuit 60 in FIG. 12 except for that capacitor 29 is eliminated. This modification is effective when load capacitance 36 has a relatively small capacitance value. In this modification, since capacitor 29 is eliminated, the area occupied by the circuit can be small.

Figure 15:
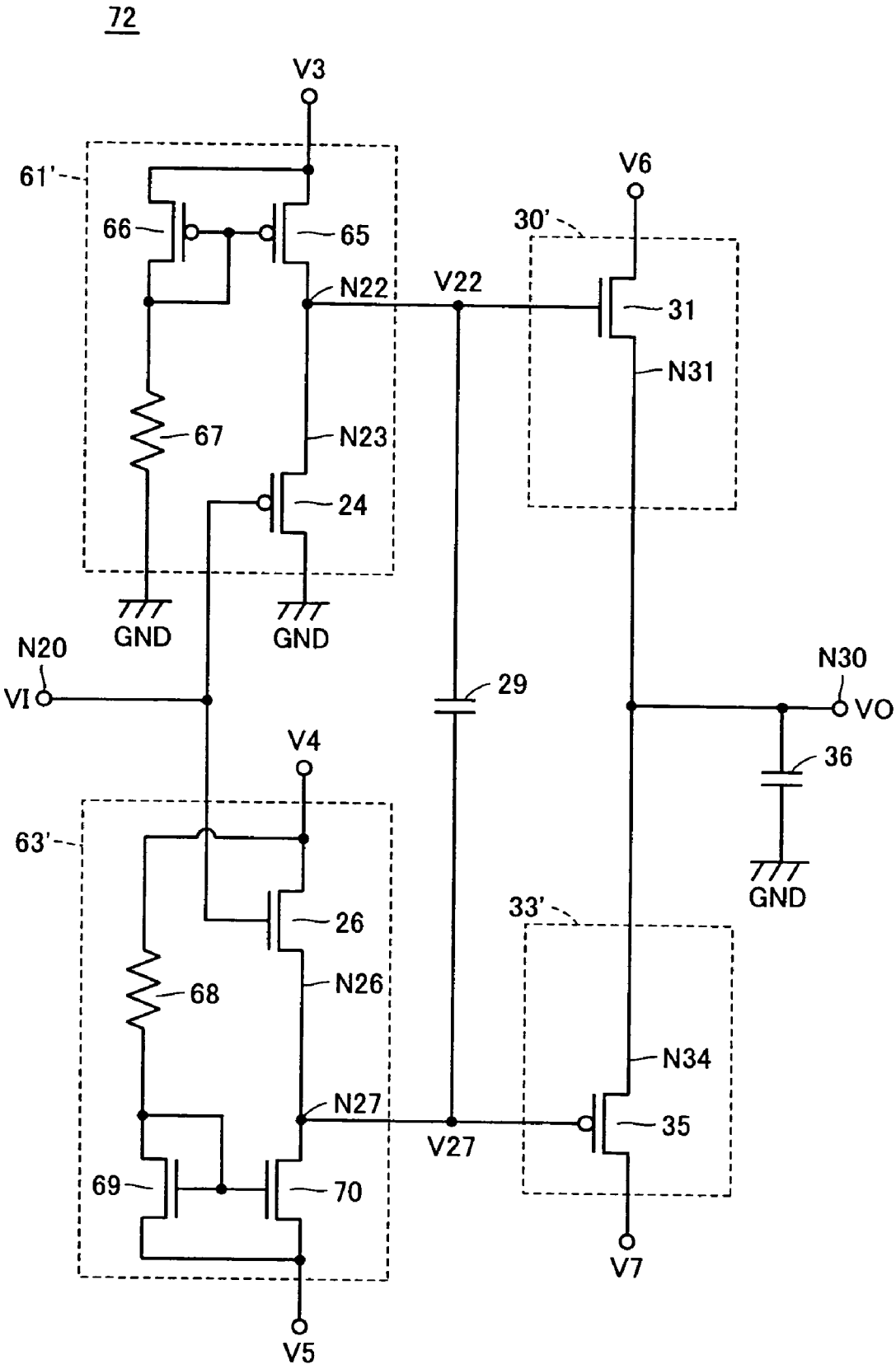
FIG. 15 is a circuit diagram showing another modification of the second embodiment.

A drive circuit 72 in FIG. 15 is substantially the same as drive circuit 60 in FIG. 13 except for that N-type transistors 23 and 34 as well as P-type transistors 27 and 32 are eliminated. In this modification, since transistors 23, 27, 32 and 34 are eliminated, the area occupied by the circuit can be small. However, it should be noted that VO is equal to (VI+|VTP|−VTN).

Figure 16:
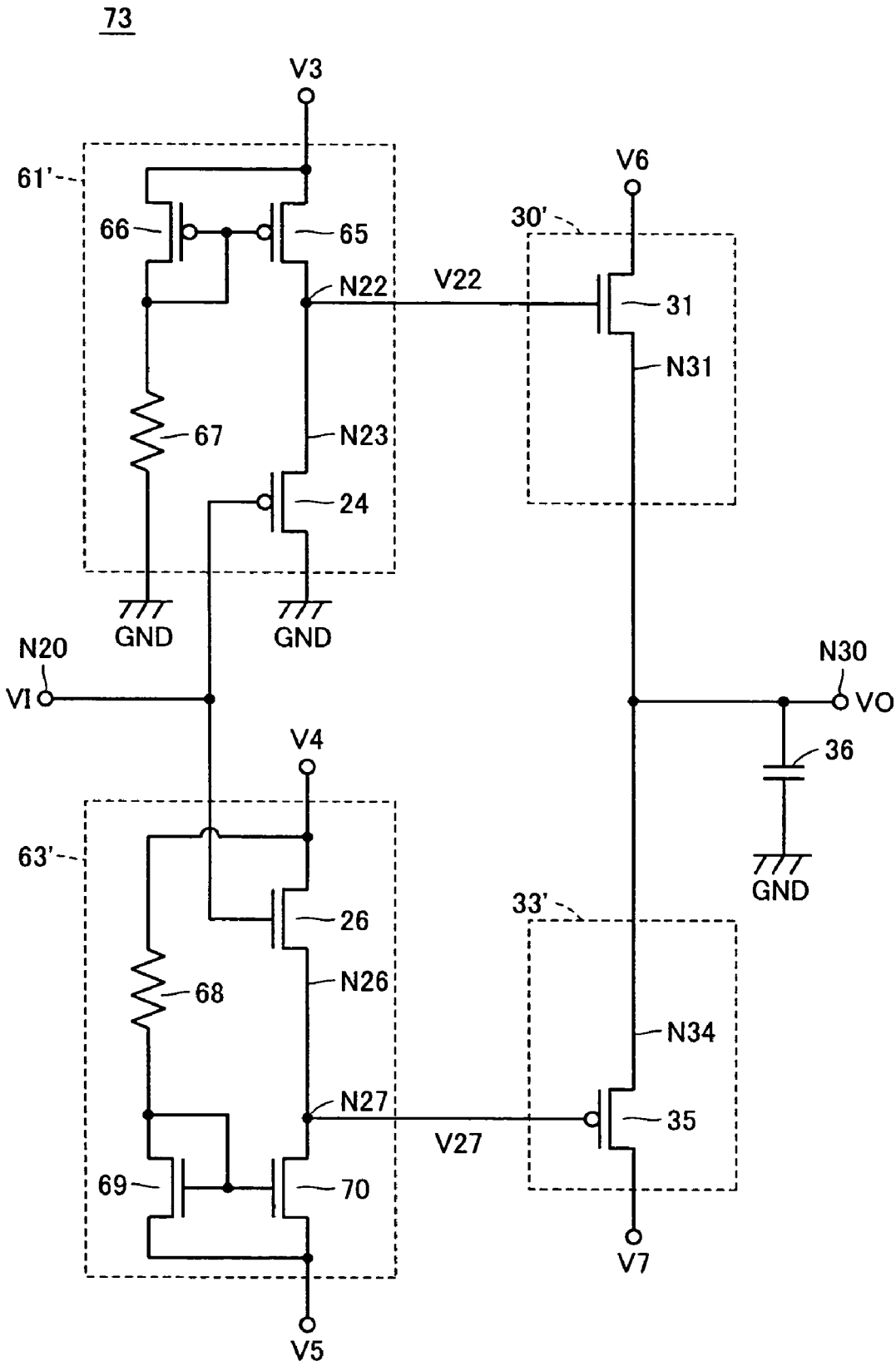
FIG. 16 is a circuit diagram showing still another modification of the second embodiment.

A drive circuit 73 in FIG. 16 is substantially the same as drive circuit 72 in FIG. 15 except for that capacitor 29 is eliminated. This modification is effective when load capacitance 36 has a relatively small capacitance value. In this modification, since capacitor 29 is eliminated, the area occupied by the circuit can be small.

Third Embodiment

For example, when drive circuit 20 shown in FIG. 4 charges or discharges load capacitance 36, each of transistors 31, 32, 34 and 35 performs a so-called source-follower operation. In this operation, as output potential VO approaches input potential VI, a gate-source voltage of each of transistors 31, 32, 34 and 35 decreases, and the current drive capabilities of transistors 31, 32, 34 and 35 lower. Although lowering of the drive capabilities of transistors 32 and 34 can be prevented by increasing the gate electrode widths thereof, the increase in gate electrode width of transistors 31 and 35 results in increase in gate capacitance thereof, and thus lowers the operation speed of drive circuit 20. A third embodiment overcomes this problem.

Figure 17:
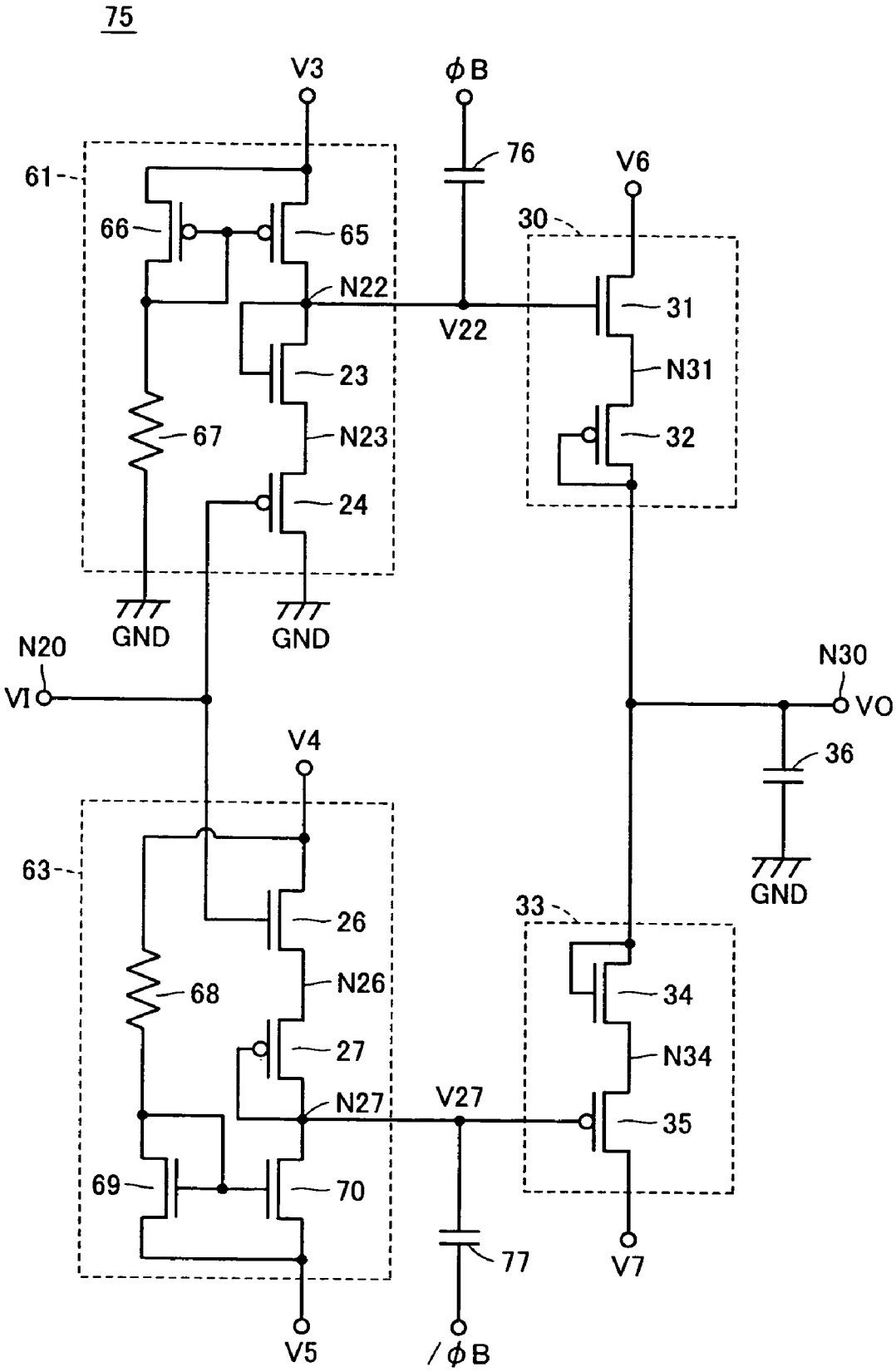
FIG. 17 is a circuit diagram showing a structure of a drive circuit of a sample hold circuit according to a third embodiment of the invention.

FIG. 17 is a circuit diagram showing a structure of a drive circuit 75 of a sample hold circuit according to a third embodiment. Referring to FIG. 17, drive circuit 75 is substantially the same as drive circuit 71 in FIG. 14 except for that capacitors 76 and 77 are additionally employed. One of electrodes of capacitor 76 receives a boost signal ϕB, and the other electrode is connected to node N22. One of electrodes of capacitor 77 receives a complementary signal /ϕB of boost signal ϕB, and the other electrode is connected to node N27.

Figure 18:
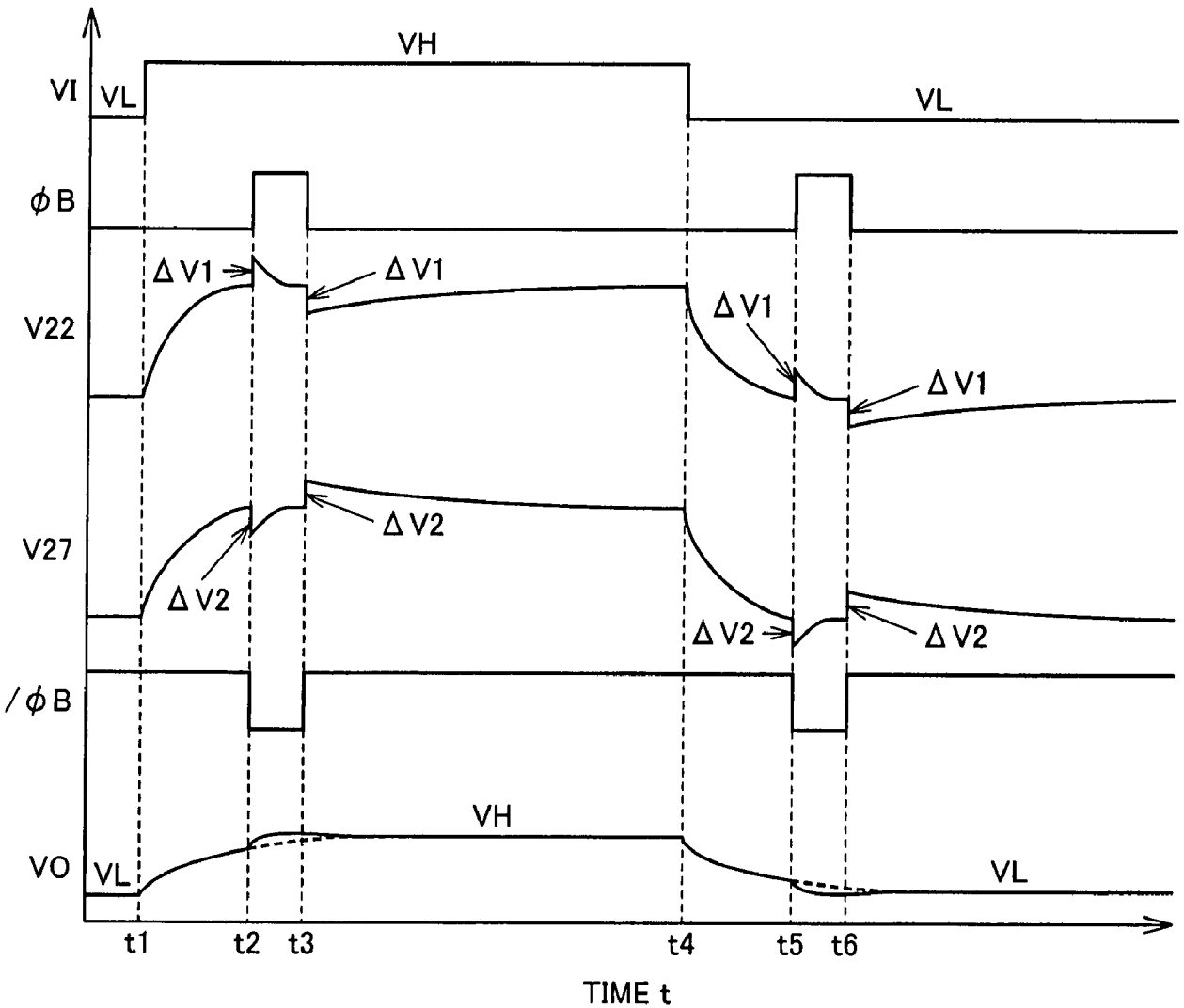
FIG. 18 is a time chart illustrating an operation of the drive circuit shown in FIG. 17.

FIG. 18 is a time chart illustrating an operation of drive circuit 75 shown in FIG. 17. For the sake of illustration, FIG. 18 illustrates as if transition times of potentials V22 and V27 of nodes N22 and N27 as well as output potential VO are longer than actual times. When input potential VI rises from "L" level VL to "H" level VH at time t1, each of potentials V22, V27 and VO gradually rises. As already described, each of potentials V22, V27 and VO rises relatively rapidly, but the rising rate thereof decreases as potentials V22, V27 and VO approach the final levels, respectively.

At time t2 after a predetermined time from time t1, boost signal ϕB rises to the "H" level, and signal /ϕB falls to the "L" level. When signal ϕB rises to the "H" level, the capacity coupling performed through capacitor 76 raises potential V22 of node N22 by a predetermined voltage ΔV1. When signal /ϕB falls to the "L" level, the capacity coupling performed through capacitor 77 lowers potential V27 of node N27 by a predetermined potential ΔV2. In this state, an operation is being performed to provide "H" level VH to output node N30, and the on-resistance value of N-type transistor 31 is lower than the on-resistance value of P-type transistor 35. Therefore, the level-raising operation by potential V22 acts more strongly than the level-lowering operation by potential V27, and output potential VO rapidly rises at and after time t2. If V22 is not raised, a change occurs as illustrated by dotted line.

Raised potential V22 falls to (VI+|VTP|+VTN) because a current flows from node N22 to the line of ground potential GND through transistors 23 and 24. Lowered potential V27 rises to (VI−|VTP|−VTN) because a current flows from the line of fourth power supply potential V4 to node N27 through transistors 26 and 27.

At a time t3, boost signal ϕB falls to the "L" level, and signal /ϕB rises to the "H" level. When signal ϕB falls to the "L" level, the capacity coupling performed through capacitor 76 lowers potential V22 of node N22 by predetermined voltage ΔV1. When signal /ϕB rises to the "H" level, the capacity coupling performed through capacitor 77 raises potential V27 of node N27 by predetermined voltage ΔV2. Even when potential V22 lowers ΔV1, pull-up circuit 30 does not have a capability of lowering output potential VO. Even when potential V27 rises voltage ΔV2, pull-down circuit 33 does not have a capability of raising output potential VO. Therefore, output potential VO does not change.

Lowered potential V22 rises to (VI+|VTP|+VTN) because a current flows from the line of third power supply potential V3 to node N22 through P-type transistor 65. However, P-type transistor 65 is configured to have a small current drive capability for low power consumption. Therefore, a time required for raising potential V22 of node N22 to the original level of (VI+|VTP|+VTN) is longer than a time required for lowering potential V22 to the same level (VI+|VTP|+VTN).

Raised potential V27 falls to (VI−VTN−|VTP|) because a current flows from node N27 to the line of fifth power supply potential V5 through N-type transistor 70. However, N-type transistor 70 is configured to have a small current drive capability for low power consumption. Therefore, a time required for lowering potential V27 of node N27 to the original level of(VI−VTN−|VTP|) is longer than a time required for raising potential V27 to the same level (VI−VTN−|VTP|).

At a time t4, input potential VI falls from the "H" level to the "L" level. Thereby, each of potentials V22, V27 and V4 gradually lowers. Each of potentials V22, V27 and V4 lowers relatively rapidly during an stage of the potential change, and the lowering rate decreases as the level approaches the final level.

At a time t5 after a predetermined time from time t4, boost signal ϕB rises to the "H" level, and signal /ϕB falls to the "L" level. When signal ϕB rises to the "H" level, the capacity coupling performed through capacitor 76 raises potential V22 of node N22 by predetermined voltage ΔV1. When signal /ϕB falls to the "L" level, the capacity coupling performed through capacitor 77 lowers potential V27 of node N27 by predetermined potential ΔV2. During this state, an operation of providing "L" level VL to output node N30 is performed, and the on-resistance value of P-type transistor 35 is lower than the on-resistance value of N-type transistor 31. Therefore, the level-lowering operation by V27 acts more strongly than the level-raising operation by V22 so that output potential VO starts to lower rapidly. If potential V27 is not lowered, a change occurs as illustrated by dotted line.

Raised potential V22 falls to (VI+|VTP|+VTN) owing to a current flowing from node N22 to the line of ground potential GND through transistors 23 and 24. Lowered potential V27 rises to (VI−|VTP|−VTN) owing to a current flowing from the line of fourth power supply potential V4 to node N27 through transistors 26 and 27.

At a time t6, boost signal ϕB falls to the "L" level, and signal /ϕB rises to the "H" level. When signal ϕB falls to the "L" level, capacity coupling performed through capacitor 76 lowers potential V22 of node N22 by predetermined voltage ΔV1. When signal /ϕB rises to the "H" level, capacity coupling performed through capacitor 77 raises potential V27 of node N27 by predetermined potential ΔV2. Even when ΔV1 lowers, pull-up circuit 30 does not have a capability of lowering output potential VO. Even when ΔV2 rises, pull-down circuit 33 does not have a capability of raising output potential VO. Therefore, output potential VO does not changes even in these cases.

Lowered potential V22 rises to (VI+|VTP|+VTN) owing to a current flowing from the line of third power supply potential V3 to node N22 through P-type transistor 65. However, P-type transistor 65 is configured to have a small current drive capability for low power consumption. Therefore, a time required for raising potential V22 of node N22 to the original level of (VI+|VTP|+VTN) is longer than a time required for lowering potential V22 to the same level of (VI+|VTP|+VTN).

Lowered potential V27 falls to (VI−VTN−|VTP|) owing to a current flowing from node N27 to the line of fifth power supply potential V5 through N-type transistor 70. However, N-type transistor 70 is configured to have a small current drive capability for low power consumption. Therefore, a time required for lowering potential V27 of node N27 to the original level of (VI−VTN−|VTP|) is longer than a time required for raising potential V27 to the same level of (VI−VTN−|VTP In this third embodiment, since potential V22 of node N22 is boosted to a potential higher than the potential of (VI+|VTP|+VTN), which is to be originally achieved, in accordance with the rising of input potential VI from "L" level VL to "H" level VH, the rising rate of output potential VO can be increased. Since potential V27 of node N27 falls to the potential lower than the potential of (VI−|VTP|−VTN), which is to be originally achieved, in accordance with the lowering of input potential VI from "H" level VH to "L" level VL, the lowering rate of output potential VO can be increased. Therefore, the responsivity of drive circuit 75 can be increased.

Figure 19:
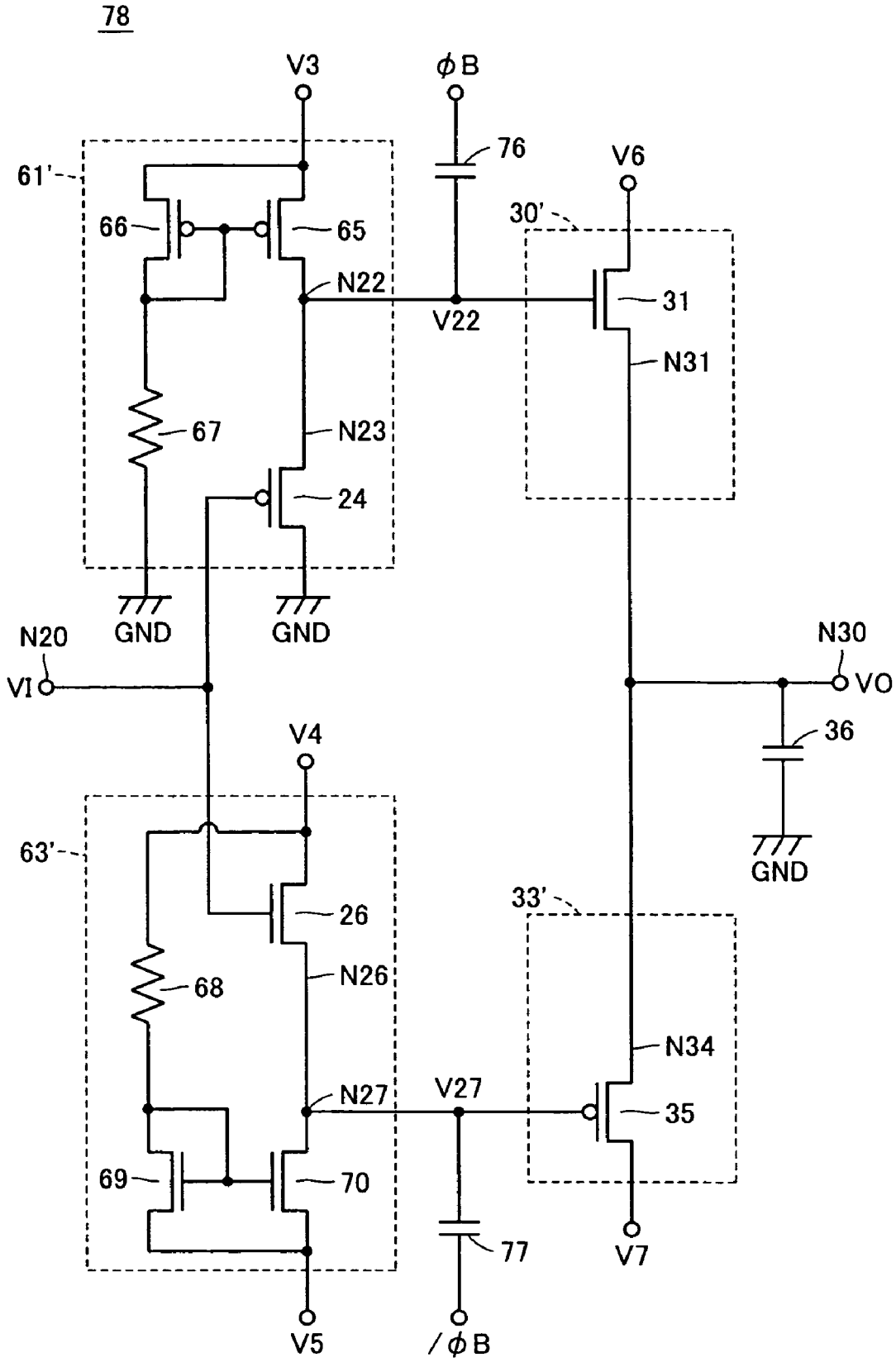
FIG. 19 is a circuit diagram showing a modification of the third embodiment.

FIG. 19 is a circuit diagram showing a structure of a drive circuit 78 according to a modification of the third embodiment. Drive circuit 78 is substantially the same as drive circuit 75 in FIG. 17 except for that transistors 23, 27, 32 and 34 are eliminated. In this modification, since transistors 23, 27, 32 and 34 are eliminated, output potential VO is equal to (VI+|VTP|−VTN), but an area occupied by the circuit can be small.

Fourth Embodiment

Figure 20:
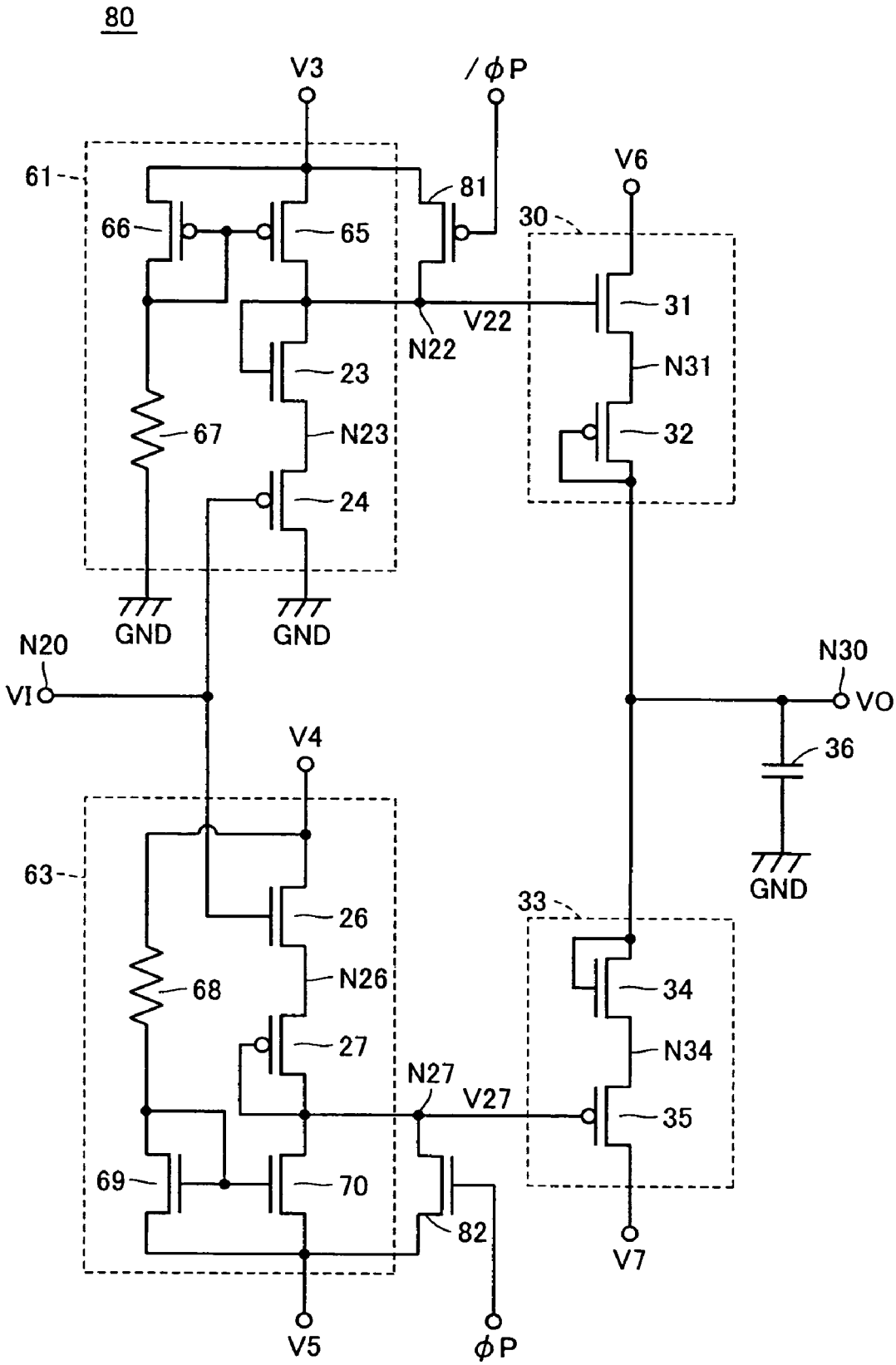
FIG. 20 is a circuit diagram showing a structure of a drive circuit of a sample hold circuit according to a fourth embodiment of the invention.

FIG. 20 is a circuit diagram showing a structure of a drive circuit 80 of a sample hold circuit according to a fourth embodiment of the invention. Referring to FIG. 20, a drive circuit 80 is substantially the same as drive circuit 71 in FIG. 14 except for that P- and N-type transistors 81 and 82 are additionally employed. P-type transistor 81 is connected between the line of third power supply potential V3 and node N22, and has a gate receiving a pull-up signal /ϕP. N-type transistor 82 is connected between node N27 and the line of fifth power supply potential V5, and has a gate receiving complementary signal ϕP of pull-up signal /ϕP.

Signals ϕP and /ϕP change their levels in accordance with the same timing as signals ϕB and /ϕB in the third embodiment. More specifically, when a predetermined time elapses after input signal VI rises from "L" level VL to "H" level VH, signals /ϕP and ϕP change to the "L" and "H" levels in a pulse-like fashion, respectively, and P- and N-type transistors 81 and 82 are turned on in a pulse-like fashion. Thereby, potential V22 of node N22 is boosted to the potential achieved by dividing third power supply potential V3 by transistor 81 and transistors 23 and 24, and then attains a predetermined value of (VI+|VTP|+VTN). Potential V27 of node N27 falls to the potential achieved by dividing a voltage of (V4-V5) between fourth and fifth power supply potentials V4 and V5 by transistors 26 and 27 as well as transistor 82, and then attains a predetermined value of (VI−VTN−|VTP|. As already described in connection with the third embodiment, the charging operation by N-type transistor 31 acts more strongly than the discharging operation by P-type transistor 35, and output potential VO rapidly becomes equal to input potential VI. When input potential VI falls from "H" level VH to "L" level VL, the discharging operation by P-type transistor 35 acts more strongly than the charging operation by N-type transistor 31, and output potential VO rapidly becomes equal to input potential VI.

The fourth embodiment described above can achieve the same effect as the third embodiment.

Figure 21:
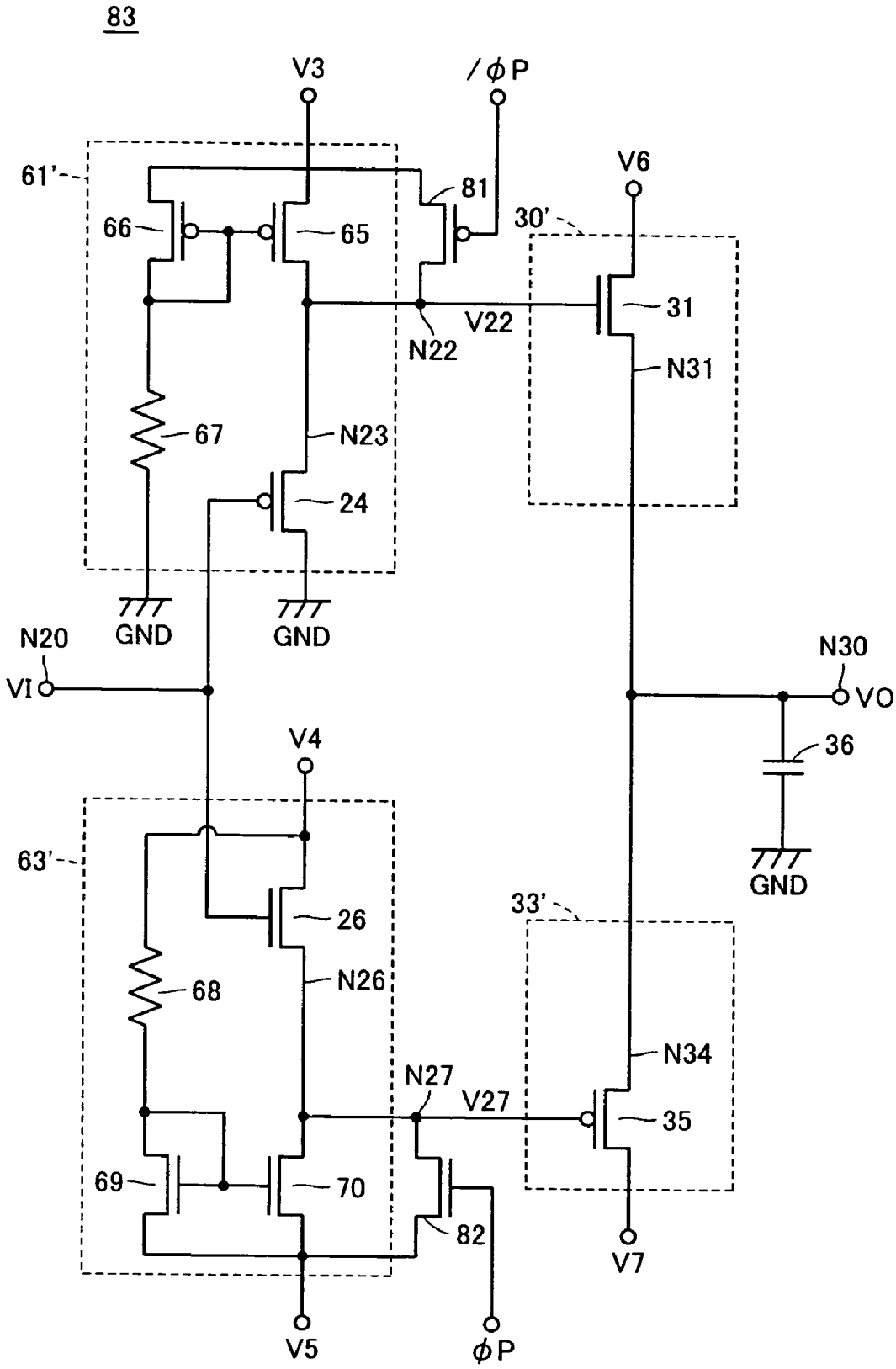
FIG. 21 is a circuit diagram showing a modification of the fourth embodiment.

Various modifications of the fourth embodiment will now be described. A drive circuit 83 in FIG. 21 is substantially the same as drive circuit 80 in FIG. 20 except for that N-type transistors 23 and 34 as well as P-type transistors 27 and 32 are eliminated. In this modification, since transistors 23, 27, 32 and 34 are eliminated, output potential VO is equal to (VI+|VTP|−VTN), but an area occupied by the circuit can be small.

Figure 22:
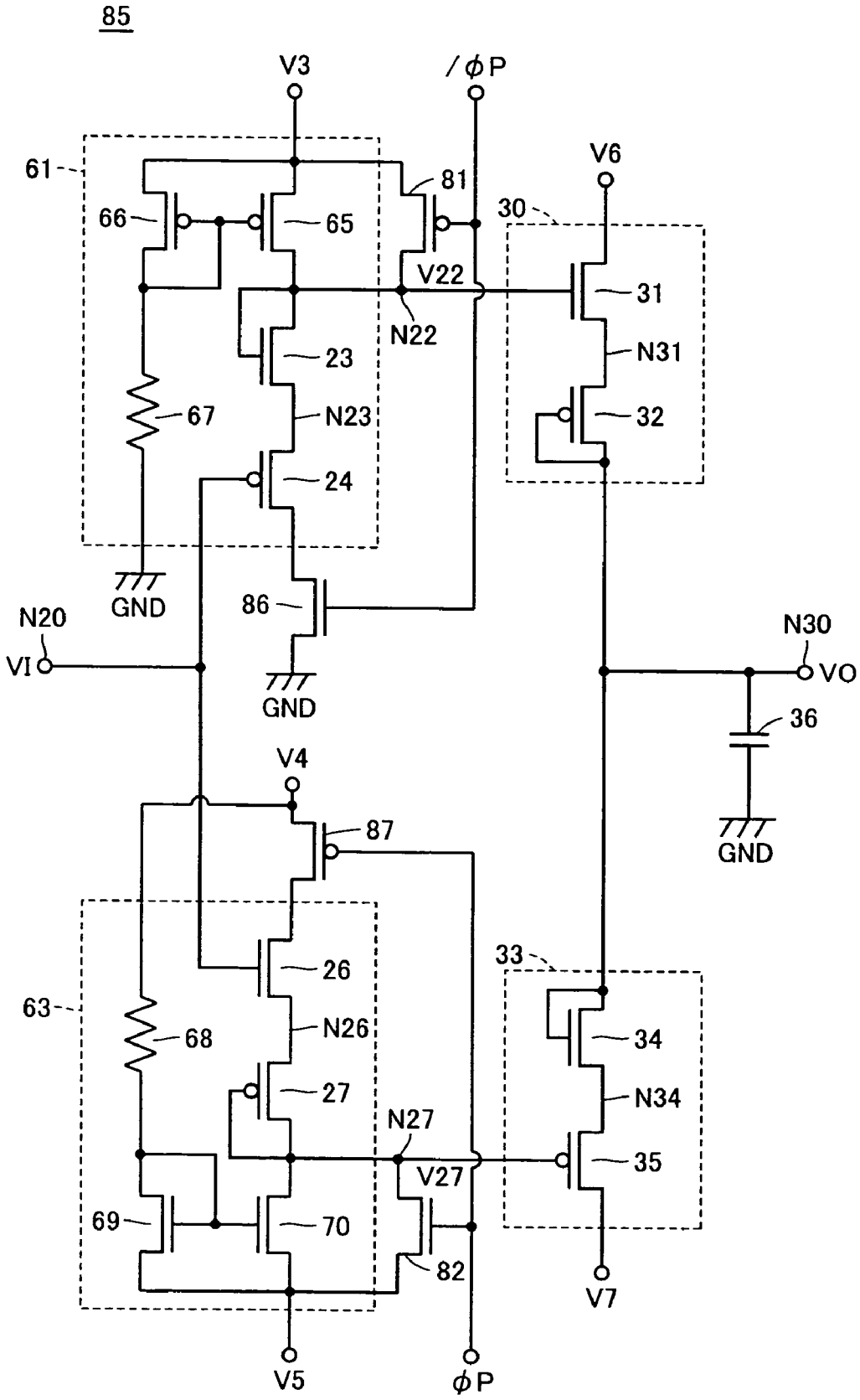
FIG. 22 is a circuit diagram showing another modification of the fourth embodiment.

A drive circuit 85 in FIG. 22 is substantially the same as drive circuit 80 in FIG. 20 except for that N- and P-type transistors 86 and 87 are additionally employed. N-type transistor 86 is connected between a source of P-type transistor 24 and the line of ground potential GND, and has a gate receiving pull-up signal /ϕP. P-type transistor 87 is connected between the line of fourth power supply potential V4 and a drain of N-type transistor 26, and has a gate receiving complementary signal ϕP of pull-up signal /ϕP. In this modification, since N-type transistor 86 is turned off when P-type transistor 81 is turned on, it is possible to prevent flowing of a through-current from the line of third power supply potential V3 to the line of ground potential GND through transistors 81, 23, 24 and 86. Since P-type transistor 87 is turned off when N-type transistor 82 is turned on, it is possible to prevent flowing of a through-current from the line of fourth power supply potential V4 to the line of fifth power supply potential V5 through transistors 87, 26, 27 and 82. Therefore, the current consumption of circuits 61 and 63 can be small.

Figure 23:
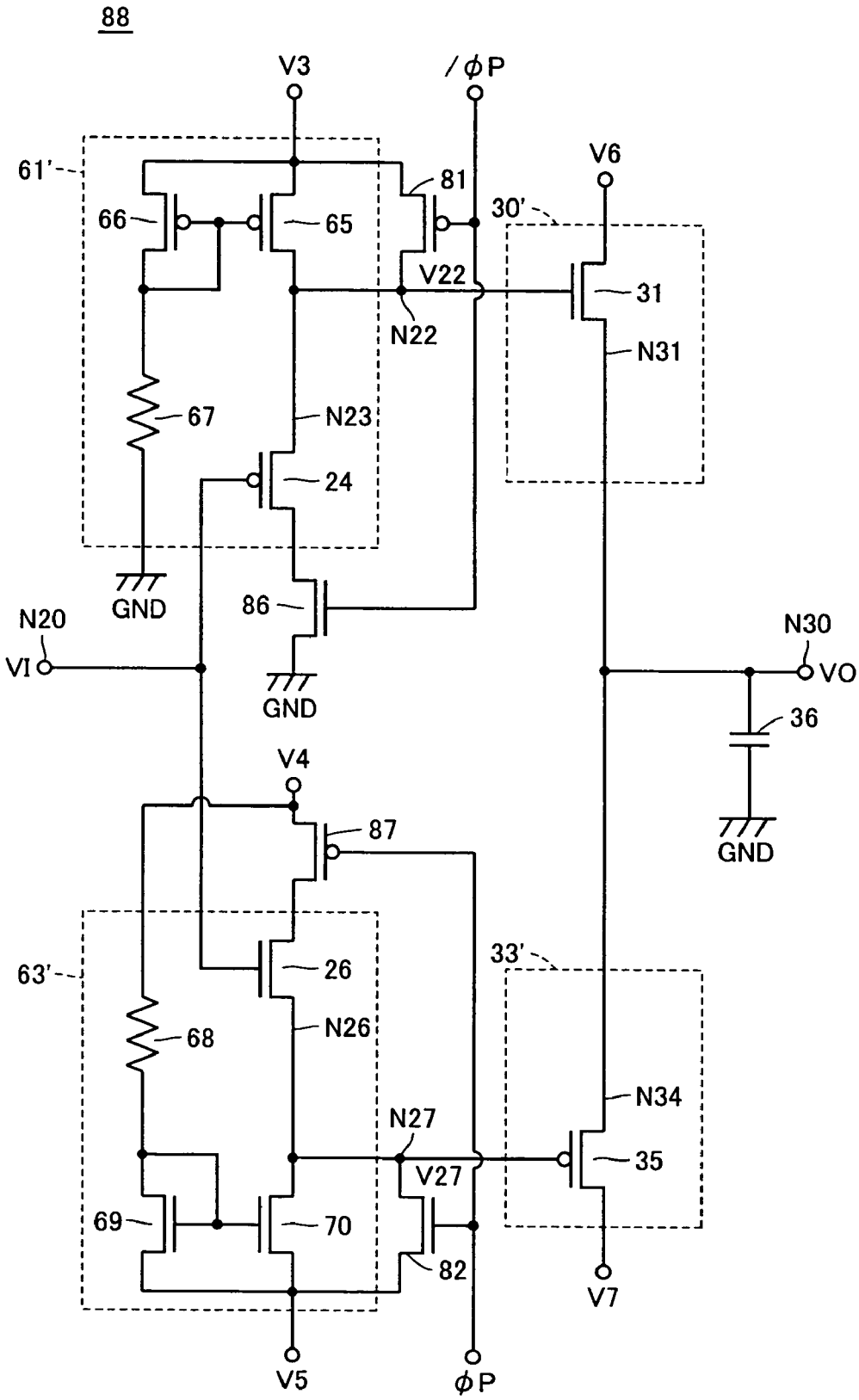
FIG. 23 is a circuit diagram showing still another modification of the fourth embodiment.

A drive circuit 88 in FIG. 23 is substantially the same as drive circuit 85 in FIG. 22 except for that N-type transistors 23 and 34 as well as P-type transistors 27 and 32 are eliminated. In this modification, since transistors 23, 27, 32 and 34 are eliminated, output potential VO is equal to (VI+|VTP|−VTN), but an area occupied by the circuit can be small.

Figure 24:
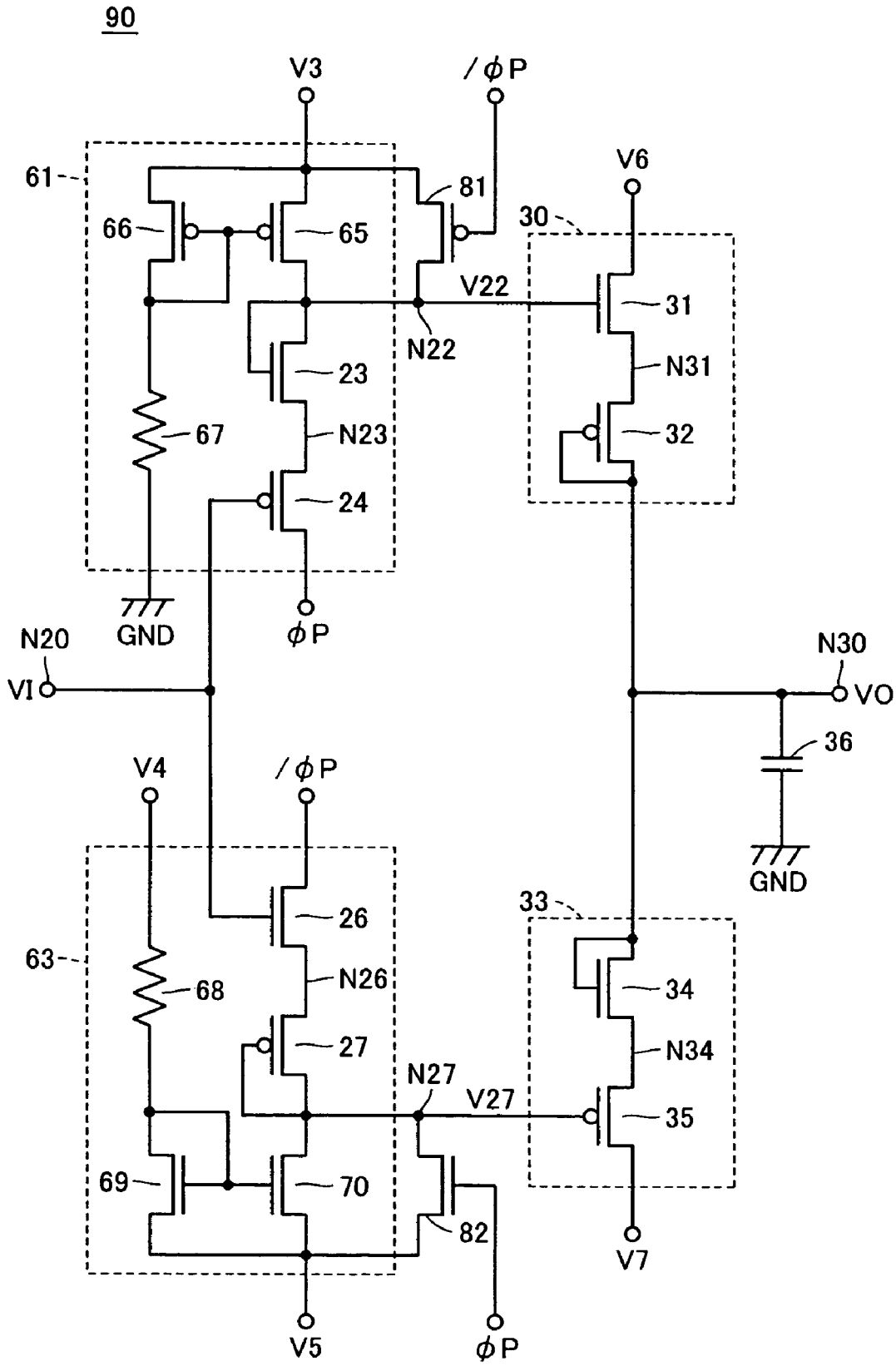
FIG. 24 is a circuit diagram showing yet another modification of the fourth embodiment.

A drive circuit 90 in FIG. 24 is substantially the same as drive circuit 80 in FIG. 20 except for that signal ϕP is applied to the source of P-type transistor 24 instead of ground potential GND, and signal /ϕP is applied to the drain of N-type transistor 26 instead of fourth power supply potential V4. In this modification, when P-type transistor 81 is on, the drain of P-type transistor 24 attains the "H" level so that flowing of a through-current through transistors 81, 23 and 24 can be prevented. Also, when N-type transistor 82 is on, the drain of N-type transistor 26 attains the "L" level so that flowing of a through-current through transistors 26, 27 and 82 can be prevented. Accordingly, current consumption of circuits 61 and 63 can be reduced.

Figure 25:
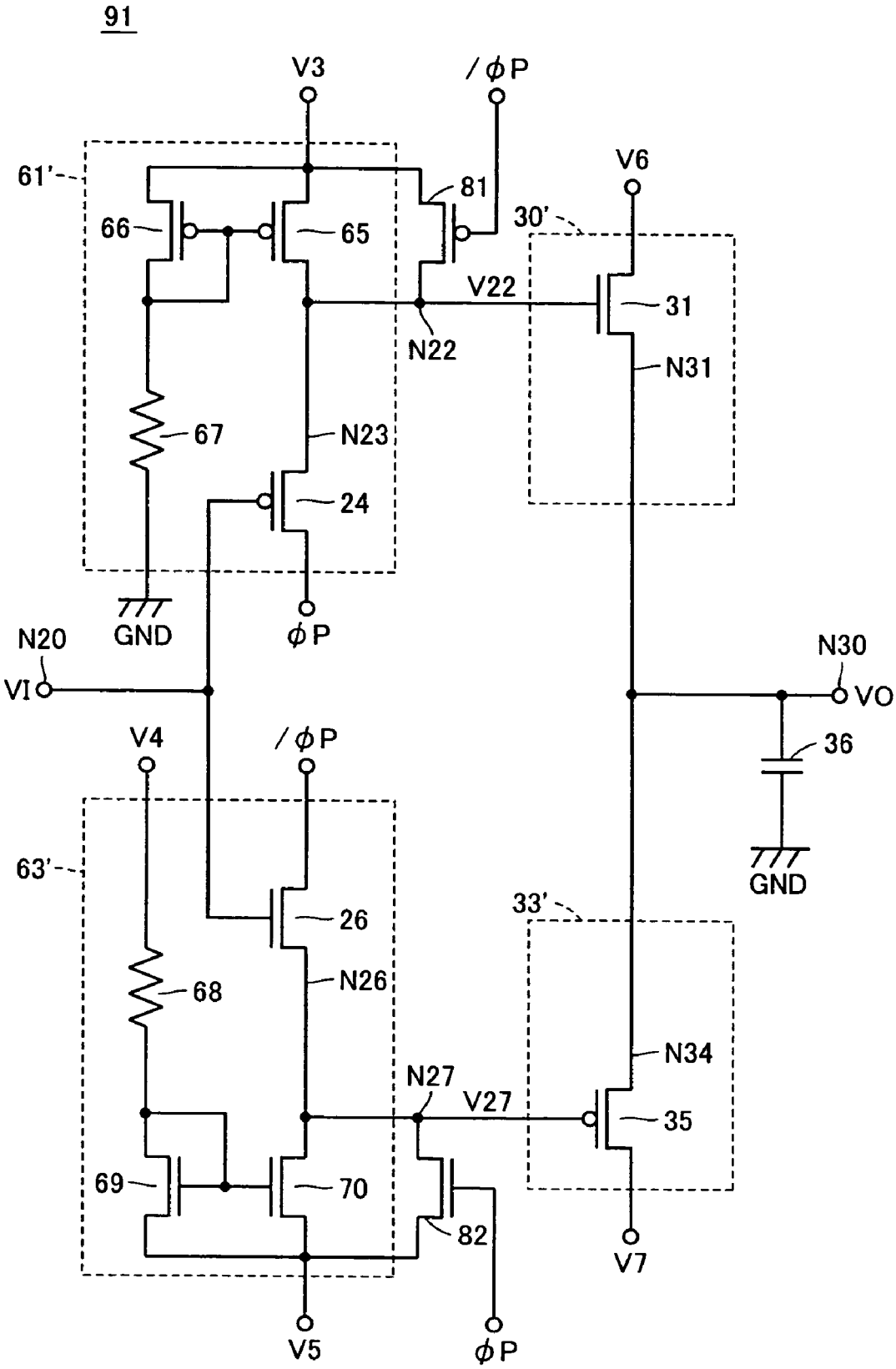
FIG. 25 is a circuit diagram showing further another modification of the fourth embodiment.

A drive circuit 91 in FIG. 25 is substantially the same as drive circuit 90 in FIG. 24 except for that N-type transistors 23 and 34 as well as P-type transistors 27 and 32 are eliminated. In this modification, since transistors 23, 27, 32 and 34 are eliminated, output potential VO is equal to (VI+|VTP|−VTN), but an area occupied by the circuit can be small.

Fifth Embodiment

Figure 26:
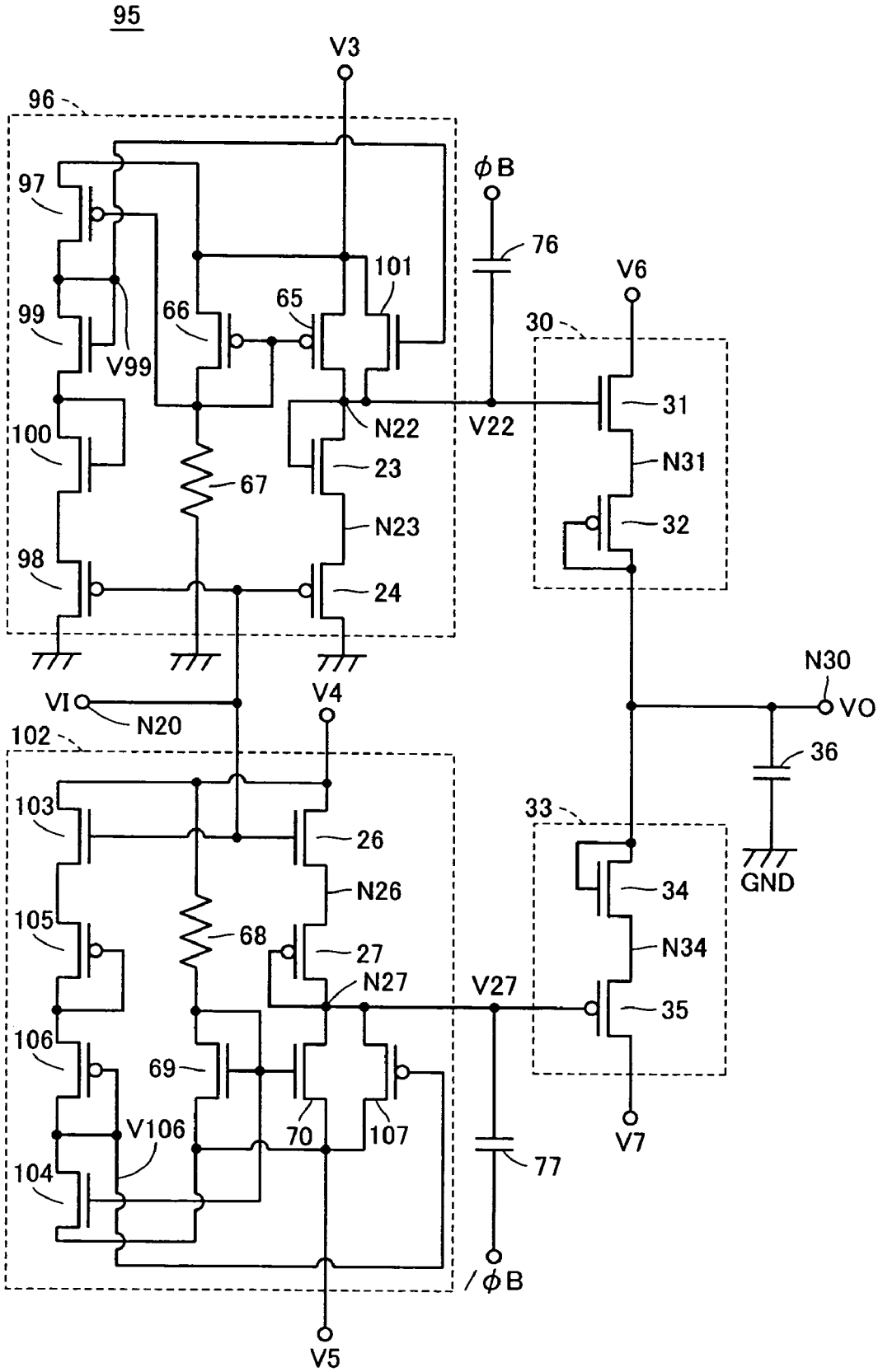
FIG. 26 is a circuit diagram showing a structure of a drive circuit of a sample hold circuit according to a fifth embodiment of the invention.

FIG. 26 is a circuit diagram showing a structure of a drive circuit 95 of a sample hold circuit according to a fifth embodiment of the invention. Referring to FIG. 26, drive circuit 95 differs from drive circuit 75 in FIG. 17 in that level shift circuits 61 and 63 are replaced with level shift circuits 96 and 102, respectively.

Level shift circuit 96 is substantially the same as level shift circuit 61 except for that P-type transistors 97 and 98 as well as N-type transistors 99-101 are additionally employed. P-type transistor 97, N-type transistors 99 and 100, and P-type transistor 98 are connected in series between the line of third power supply potential V3 and the line of ground potential GND, and N-type transistor 101 is connected between the line of third power supply potential V3 and node N22. P-type transistor 97 has a gate connected to a gate of P-type transistor 66. Therefore, a constant current of a value corresponding to the value of the constant current flowing through P-type transistor 66 flows through transistors 97, 99, 100 and 98. Each of N-type transistors 99 and 100 has a gate connected to its drain. Each of N-type transistors 99 and 100 forms a diode. P-type transistor 98 receives input potential VI on its gate. A potential V99 of a node between transistors 97 and 99 is equal to (VI+|VTP|+2VTN). Potential V99 is applied to a gate of N-type transistor 101. N-type transistor 101 charges node N22 to a level of (V99−VTN) equal to (VI+|VTP|+VTN).

Level shift circuit 102 is substantially the same as level shift circuit 63 except for that N-type transistors 103 and 104 as well as P-type transistors 105-107 are additionally employed. N-type transistor 103, P-type transistors 105 and 106, and N-type transistor 104 are connected in series between the lines of fourth and fifth power supply potentials V4 and V5, and P-type transistor 107 is connected between node N27 and the line of fifth power supply potential V5. N-type transistor 103 receives input potential VI on its gate. Each of P-type transistors 105 and 106 has a gate connected to its drain. Each of P-type transistors 105 and 106 forms a diode. N-type transistor 104 has a gate connected to a gate of N-type transistor 69. A constant current of a value corresponding to a value of the constant current flowing through N-type transistor 69 flows through N-type transistor 104. A potential V106 of a node between MOS transistors 106 and 104 is equal to (VI−VTN−2|VTP|). Potential V106 is applied to a gate of P-type transistor 107. P-type transistor 107 discharges node N27 to a level of (V106−VTP|=VI−VTN−|VTP|). Structures and operations other than the above are the same as those of drive circuit 75 in FIG. 17, and therefore, description thereof is not repeated.

Figure 27:
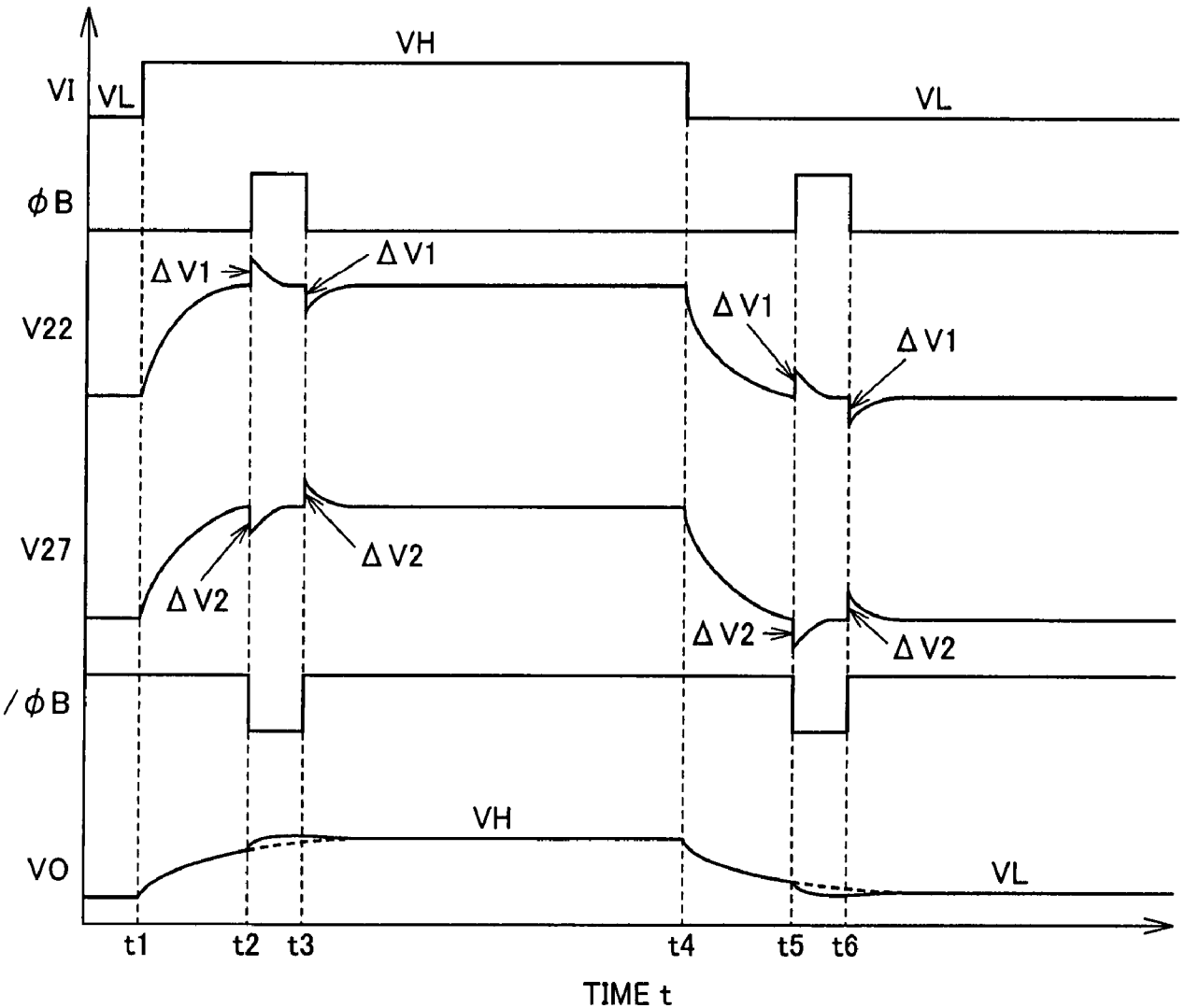
FIG. 27 is a time chart illustrating an operation of the drive circuit shown in FIG. 26.

FIG. 27 is a time chart illustrating an operation of drive circuit 95 shown in FIG. 26, and corresponds to the time chart of FIG. 18. In drive circuit 95, transistors 97-101 charge node N22 to (VI+|VTP|+VTN). Referring to FIG. 27, therefore, potential V22 of node N22 can be rapidly restored to a predetermined value of (VI+|VTP|+VTN) when potential V22 of node N22 lowers below the predetermined value of (VI+|VTP|+VTN) (times t3 and t6). Since transistors 103-107 discharge node N27 to (VI−VTN−|VTP|), potential V27 of node N27 can be rapidly restored to a predetermined value of (VI−VTN−|VTP|) when potential V27 of node N27 rises above the predetermined value of (VI−VTN−|VTP|) (times t3 and t6). Therefore, the responsivity of the circuits can be increased.

Figure 28:
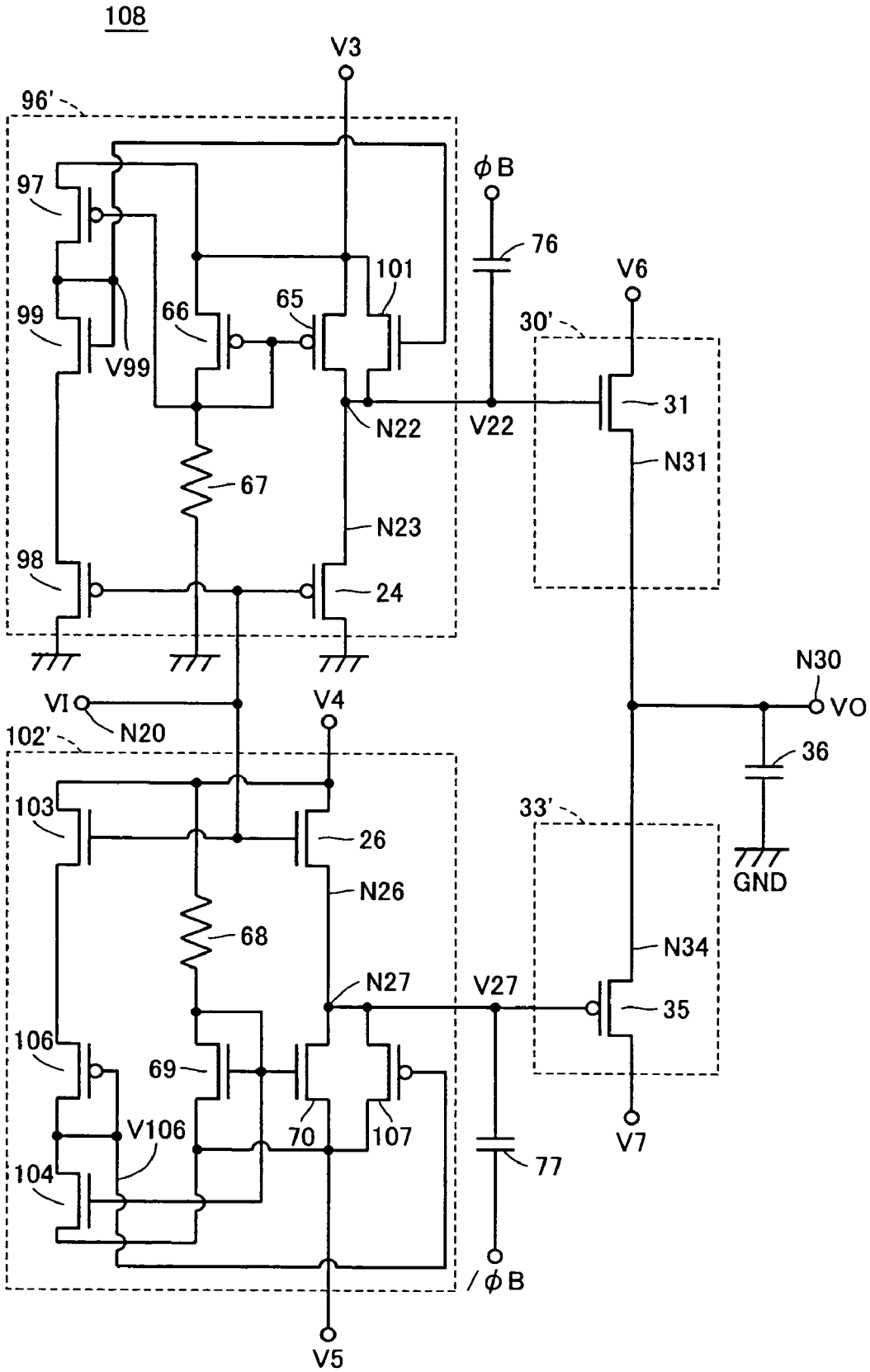
FIG. 28 is a circuit diagram showing a modification of the fifth embodiment.

FIG. 28 is a circuit diagram showing a modification of the fifth embodiment. A drive circuit 108 in FIG. 28 is substantially the same as drive circuit 95 in FIG. 26 except for that N-type transistors 23, 34 and 100 as well as P-type transistors 27, 32 and 105 are eliminated. In this modification, since transistors 23, 27, 32, 34, 100 and 105 are eliminated, output potential VO is equal to (VI+|VTP|−VTN), but an area occupied by the circuit can be small.

Sixth Embodiment

Figure 29:
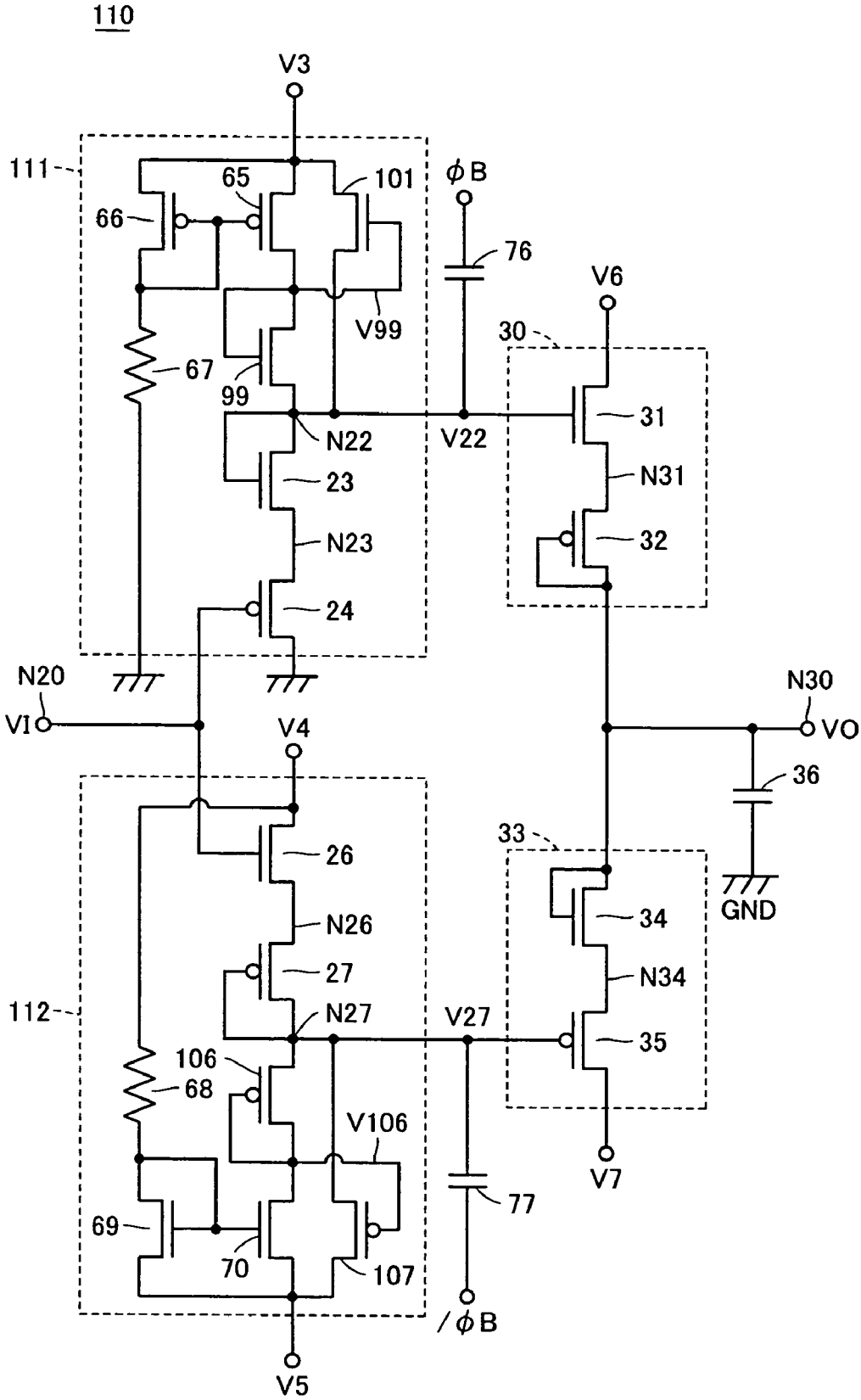
FIG. 29 is a circuit diagram showing a structure of a drive circuit of a sample hold circuit according to a sixth embodiment of the invention.

FIG. 29 is a circuit diagram showing a structure of a drive circuit 110 of a sample hold circuit according to a sixth embodiment of the invention. In FIG. 29, drive circuit 110 differs from drive circuit 95 in FIG. 26 in that level shift circuits 96 and 102 are replaced with level shift circuits 111 and 112.

Level shift circuit 111 is substantially the same as level shift circuit 96 except for that P-type transistors 97 and 98 as well as N-type transistor 100 are eliminated, and N-type transistor 99 is connected between the source of P-type transistor 65 and node N22. A gate of N-type transistor 99 is connected to a drain of N-type transistor 99 and a gate of N-type transistor 101. Gate potential V99 of N-type transistors 99 and 101 is equal to (VI+|VTP|+2VTN). N-type transistor 101 charges node N22 to a level of(V99−VTN=VO+|VTP|+VTN).

Level shift circuit 112 is substantially the same as level shift circuit 102 except for that N-type transistors 103 and 104 as well as P-type transistor 105 are eliminated, and P-type transistor 106 is connected between node N27 and a drain of N-type transistor 70. P-type transistor 106 has a gate connected to its drain and a gate of P-type transistor 107. The gates of P-type transistors 106 and 107 are equal to (VI−VTN−2VTP|). P-type transistor 107 discharges node N27 to (V106+|VTP|=VI−VTN−|VTP|). Structures and operations other than the above are the same as those of drive circuit 95 in FIG. 26, and therefore, description thereof is not repeated.

This sixth embodiment can achieve the same effect as the fifth embodiment, and further can reduce the current consumption because it is possible to reduce the current flowing from the line of third power supply potential V3 to ground potential GND through transistors 97, 99, 100 and 98 as well as the current flowing from the line of fourth power supply potential V4 to the line of fifth power supply potential V5 through transistors 103, 105, 106 and 104. Since transistors 97, 98, 100 and 103-105 are eliminated, an area occupied by the circuit can be small.

Figure 30:
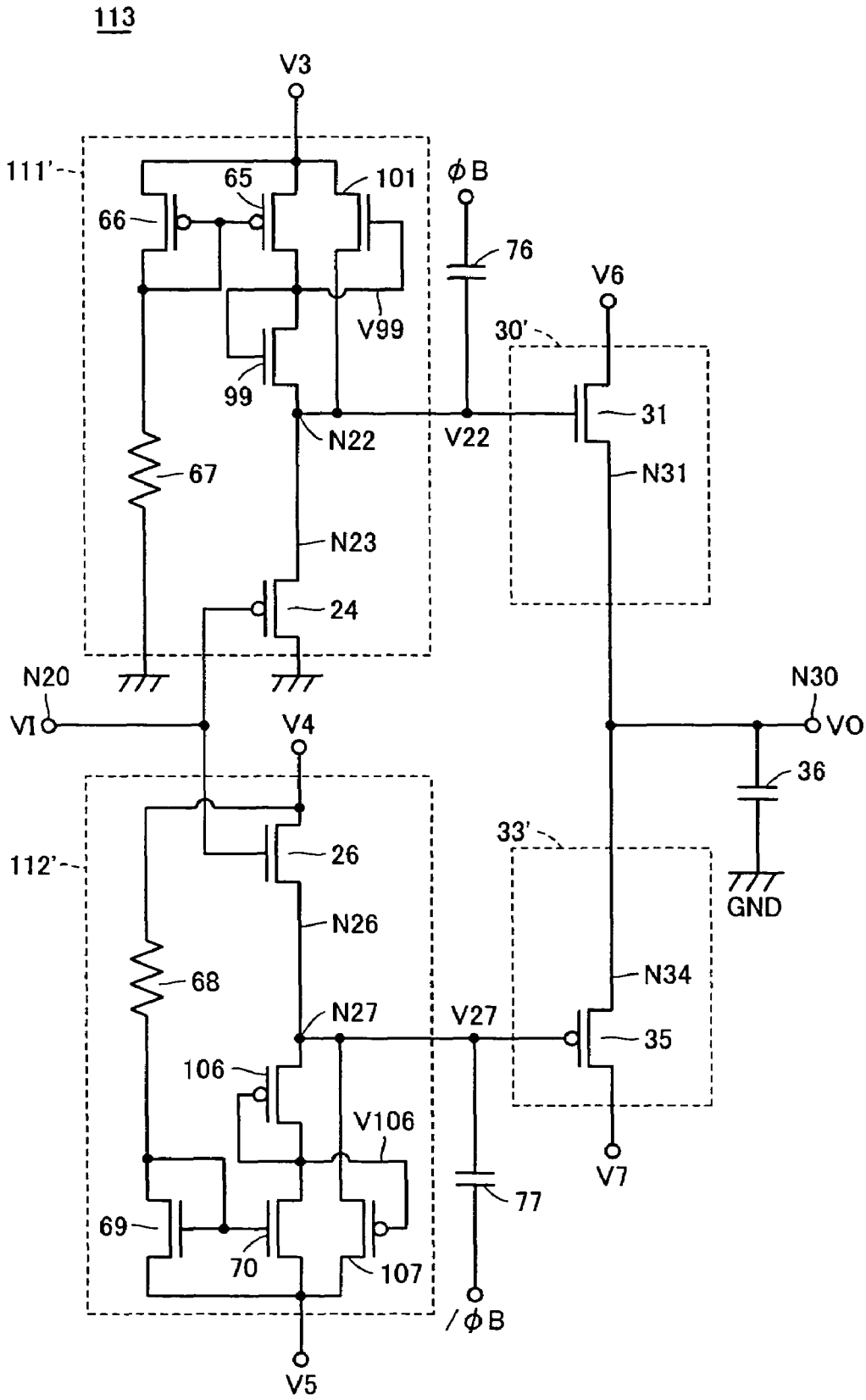
FIG. 30 is a circuit diagram showing a modification of the sixth embodiment.

FIG. 30 is a circuit diagram showing a modification of the sixth embodiment. A drive circuit 113 in FIG. 30 is substantially the same as drive circuit 110 in FIG. 29 except for that N-type transistors 23 and 34 as well as P-type transistors 27 and 32 are eliminated. In this modification, since transistors 23, 27, 32 and 34 are eliminated, output potential VO is equal to (VI+|VTP|−VTN), but an area occupied by the circuit can be small.

Seventh Embodiment

Figure 31:
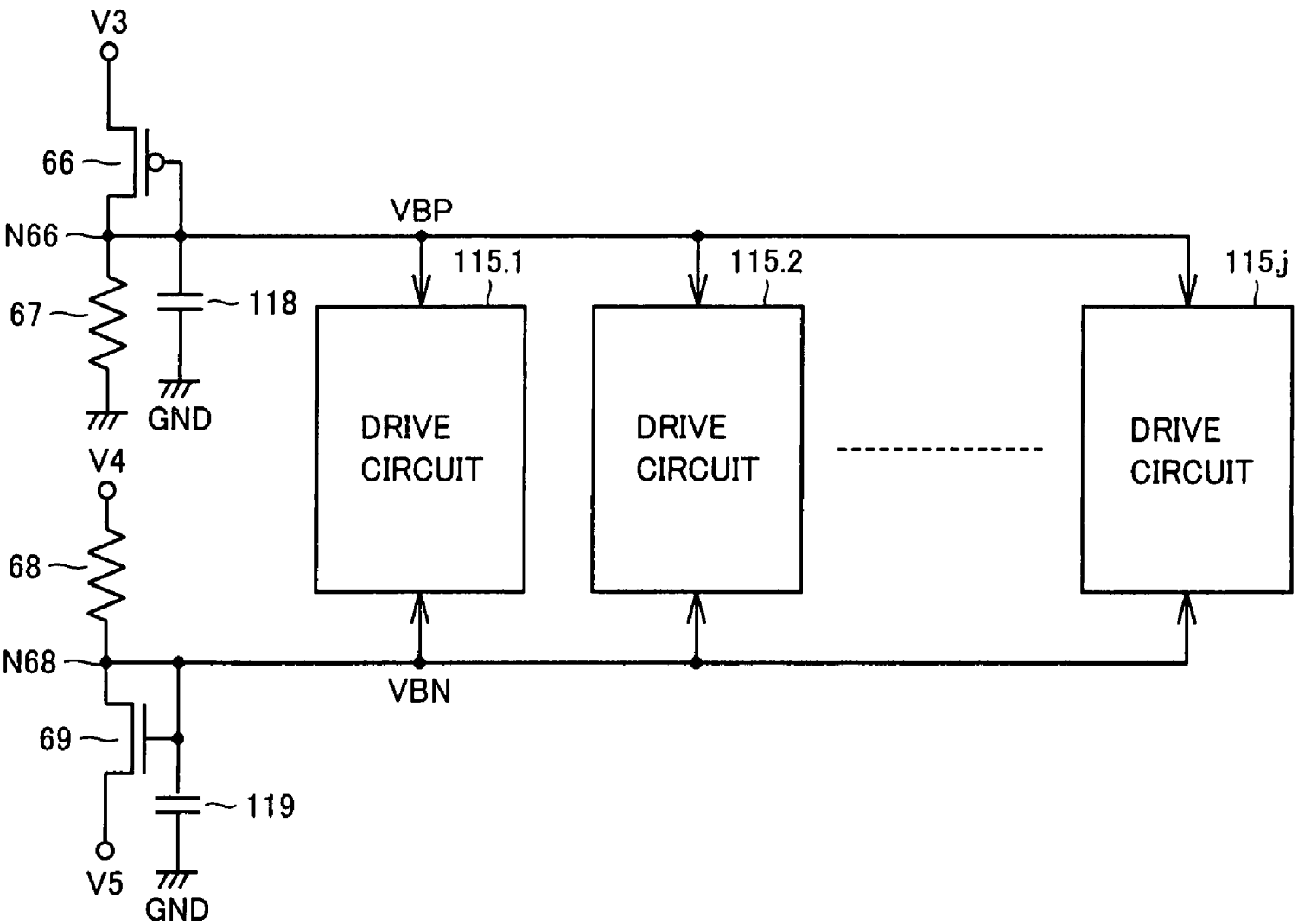
FIG. 31 is a circuit diagram showing a structure of a drive circuit of a sample hold circuit according to a seventh embodiment of the invention.

FIG. 31 is a circuit block diagram showing a major portion of a semiconductor integrated circuit device according to a seventh embodiment of the invention. In FIG. 31, the semiconductor integrated circuit device includes drive circuits 115.1-115.j of j in number, where n is an integer more than one.

Figure 32:
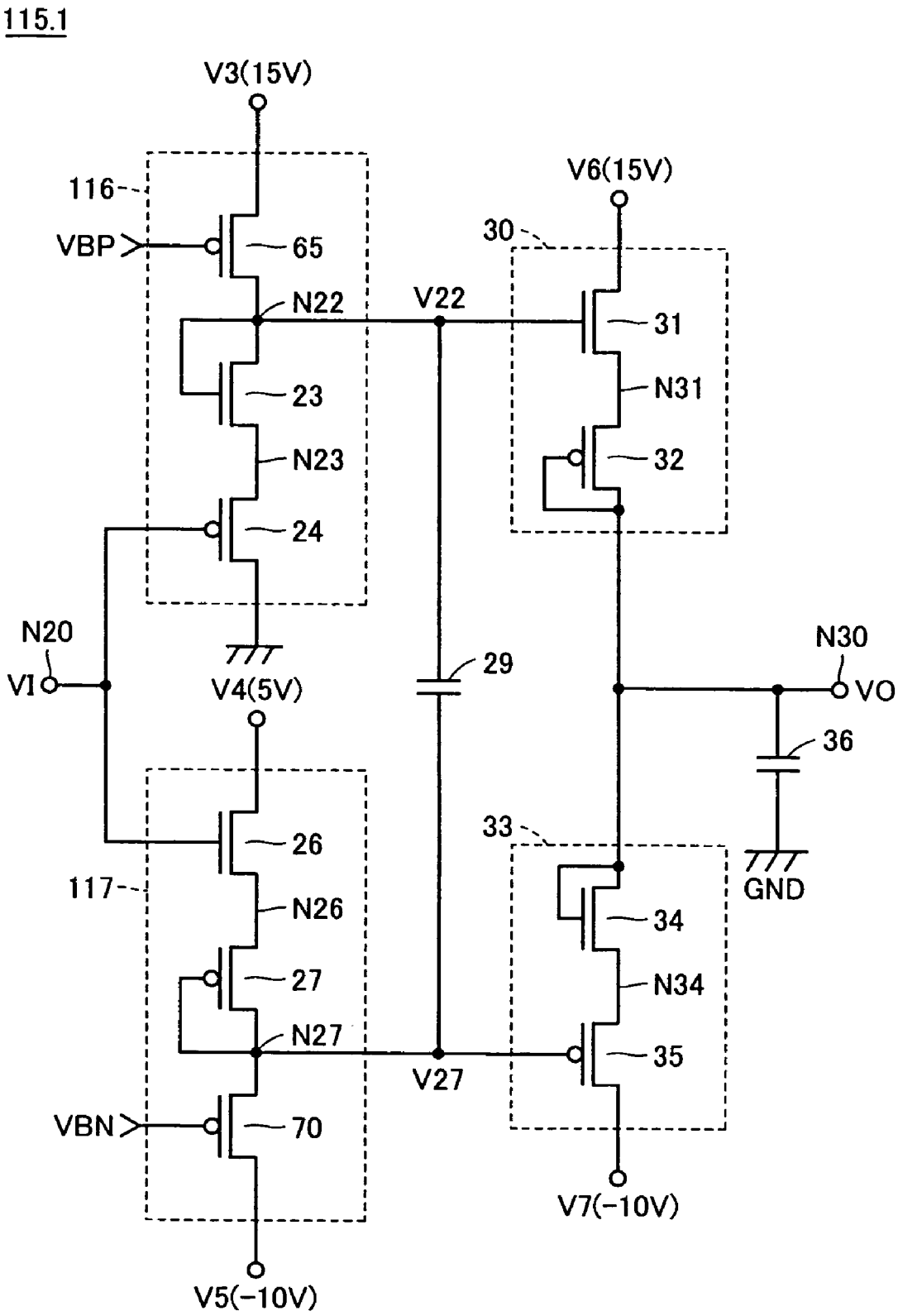
FIG. 32 is a circuit diagram showing a structure of a drive circuit shown in FIG. 31.

As shown in FIG. 32, drive circuit 115.1 is substantially the same as drive circuit 60 in FIG. 13 except for that level shift circuits 61 and 63 are replaced with level shift circuits 116 and 117. Level shift circuit 116 is substantially the same as level shift circuit 61 except for that P-type transistor 66 and resistance element 67 are eliminated. Level shift circuit 117 is substantially the same as level shift circuit 63 except for that resistance element 68 and N-type transistor 69 are eliminated. Transistors 65 and 70 receive bias potentials VBP and VBN on their gates, respectively. Other drive circuits 115.2-115.j have the same structures as drive circuit 115.1.

Returning to FIG. 31, the semiconductor integrated circuit device is configured such that P-type transistor 66 and resistance element 67 for producing bias potential VBP as well as resistance element 68 and N-type transistor 69 for producing bias potential VBN are provided commonly to drive circuits 115.1-115.j.

P-type transistor 66 and resistance element 67 are connected in series between the line of third power supply potential V3 and the line of ground potential GND, and the gate of P-type transistor 66 is connected to its drain (node N66). Bias potential VBP appears at node N66. A capacitor 118 is connected between node N66 and the line of ground potential GND for stabilizing bias potential VBP. A constant current of a value, which corresponds to the constant current flowing through P-type transistor 66, flows through P-type transistor 65 in each of drive circuits 115.1-115.j.

Resistance element 68 and N-type transistor 69 are connected between the lines of fourth and fifth power supply potentials V4 and V5. The gate of N-type transistor 69 is connected to its drain (node N68). Bias potential VBN appears at node N68. A capacitor 119 is connected between node N68 and ground potential GND for stabilizing bias potential VBN. A constant current of a value, which corresponds to the constant current flowing through N-type transistor 69, flows through N-type transistor 70 of each of drive circuits 115.1-115.j.

The seventh embodiment can achieve the same effect as the second embodiment, and further can reduce an occupied area per drive circuit (115.1-115.j) because the circuits for producing bias potentials VBP and VBN are provided commonly to drive circuit 115.1-115.j.

Eighth Embodiment

Figure 33:
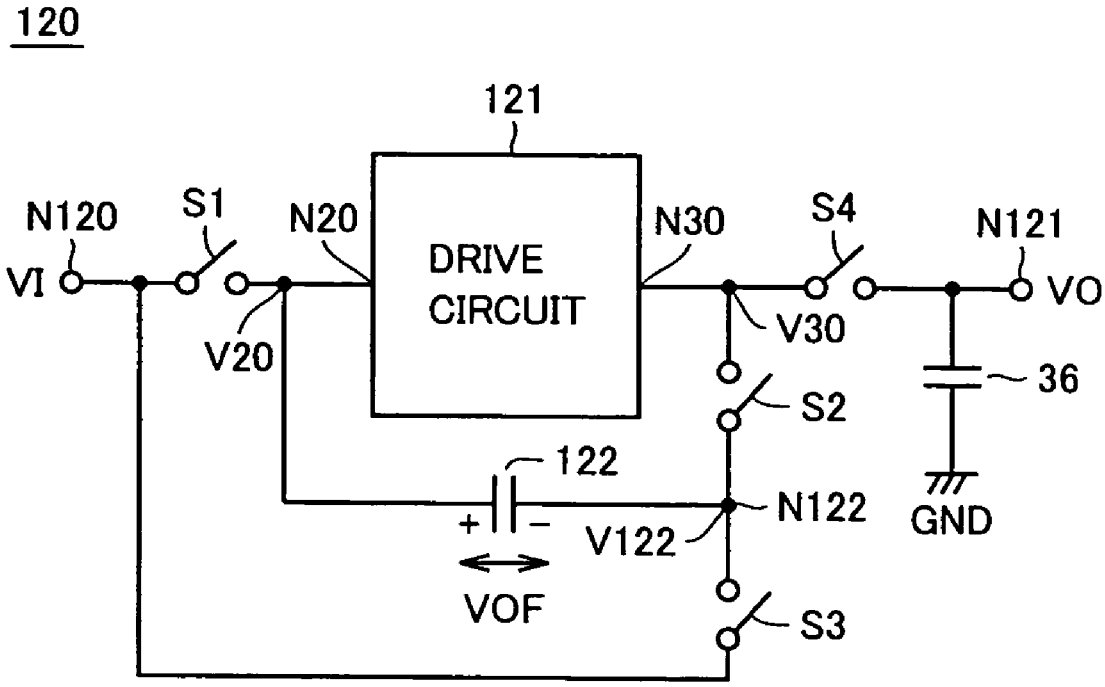
FIG. 33 is a circuit block diagram showing a structure of a drive circuit provided with an offset-compensating function and employed in a sample hold circuit according to an eight embodiment of the invention.

FIG. 33 is a circuit block diagram showing a structure of a drive circuit 120, which has an offset-compensating function, of a sample hold circuit according to an eight embodiment of the invention. In FIG. 33, drive circuit 120 with the offset-compensating function includes a drive circuit 121, a capacitor 122 and switches S1-S4. Drive circuit 121 is the same as any one of the drive circuits in the first to eleventh embodiments. Capacitor 122 and switches S1-S4 form an offset-compensating circuit, which compensates for an offset voltage VOF, i.e., a potential difference, which may appear between the input and output potentials of drive circuit 121 due to variations in threshold voltage of the transistors in drive circuit 121.

Thus, switch S1 is connected between an input node N120 and input node N20 of drive circuit 121, and switch S4 is connected between an output node N121 and output node N30 of drive circuit 121. Capacitor 122 and switch S2 are connected in series between input node N20 of drive circuit 121 and output node N30. Switch S3 is connected between input node N120 and a node N122 located between capacitor 122 and switch S2. Each of switches S1-S4 may be a P-type transistor, an N-type transistor or a parallel connection of P- and N-type transistors. Each of switches S1-S4 is turned on/off under control of a control signal (not shown).

Figure 34:
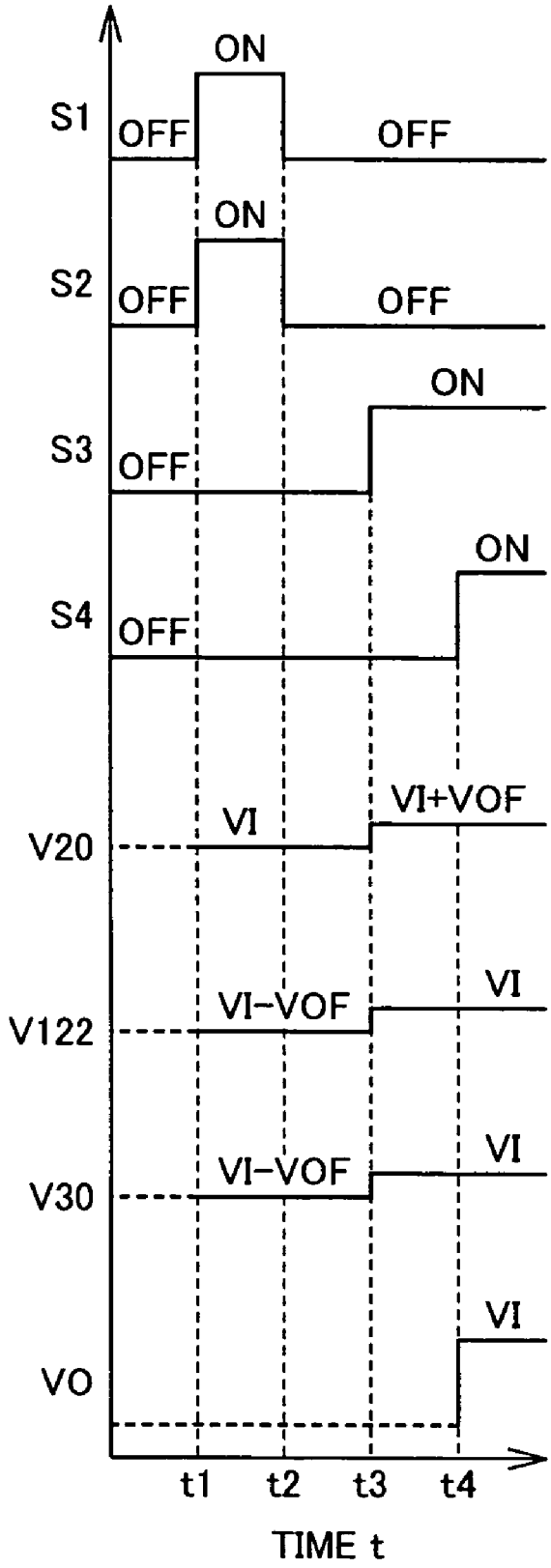
FIG. 34 is a time chart illustrating an operation of the drive circuit with the offset-compensating function shown in FIG. 33.

In the following description, it is assumed that an output potential of drive circuit 121 is lower than its input potential by offset voltage VOF. In the initial state, as shown in FIG. 34, all switches S1-S4 are off. When switches S1 and S2 are turned on at certain time t1, potential V20 of input node N20 of drive circuit 121 becomes equal to VI, and output potential V30 of drive circuit 121 and a potential V122 of node N122 become equal to (VI−VOF) so that capacitor 122 is charged to offset voltage VOF.

When switches S1 and S2 are turned off at time t2, capacitor 122 holds offset voltage VOF. When switch S3 is turned on at subsequent time t3, potential V122 of node N122 becomes equal to VI, input potential V20 of drive circuit 121 becomes equal to (VI+VOF). Consequently, output potential V30 of drive circuit 121 becomes equal to (V20−VOF=VI) so that offset voltage VOF of drive circuit 121 is canceled. When switch S4 is turned on at subsequent time t4, output potential VO becomes equal to VI, and is applied to a load.

In this eighth embodiment, offset voltage VOF of drive circuit 121 can be canceled to provide output potential VO equal to input potential VI.

Switch S4 is not essential. However, if load capacitance 36 has a large capacitance value in a structure not provided with switch S4, a long time is required until voltage VOF between terminals of capacitor 122 becomes stable after switches S1 and S2 are turned on at time t1.

Ninth Embodiment

Figure 35:
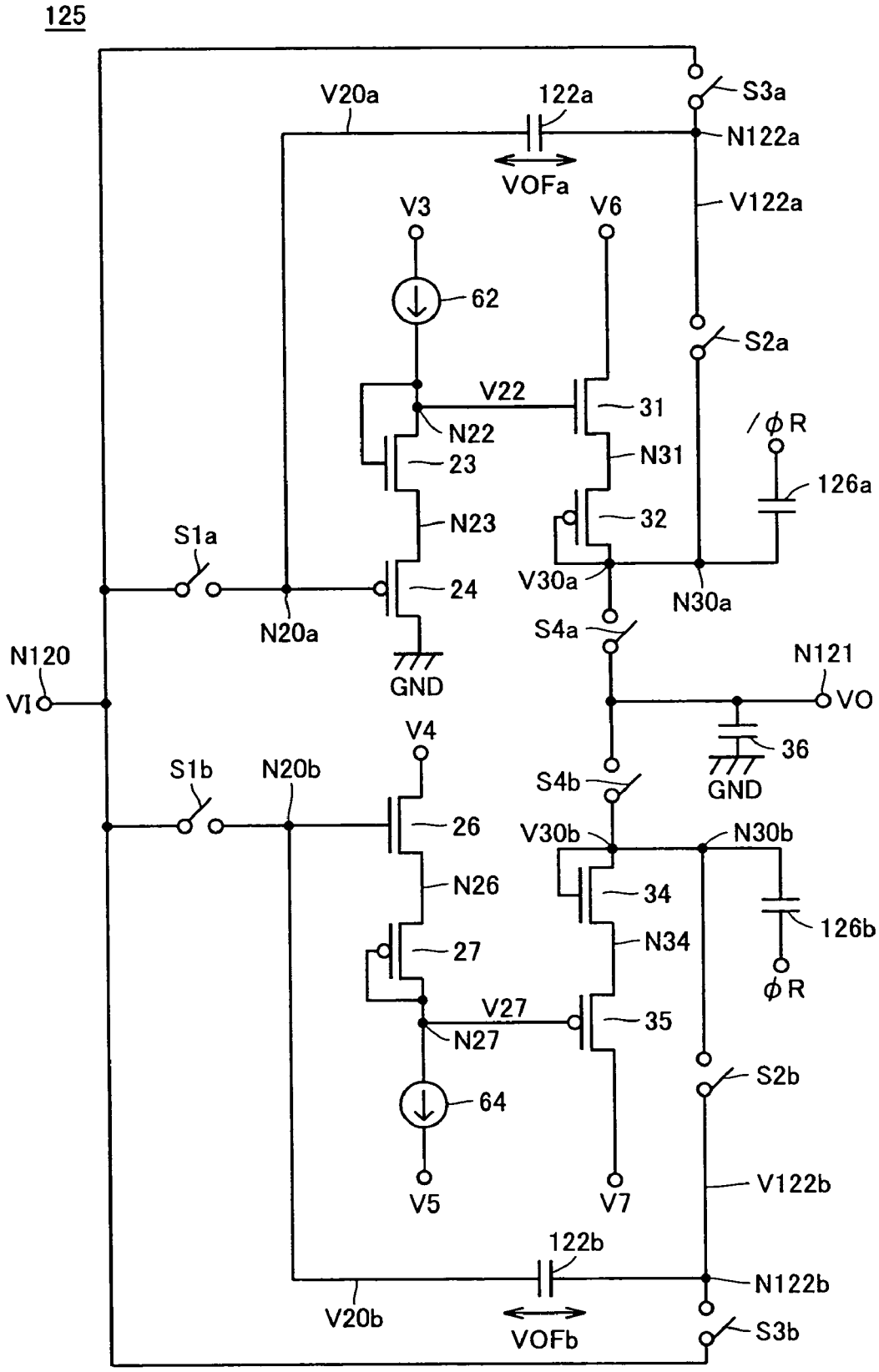
FIG. 35 is a circuit block diagram showing a structure of a drive circuit provided with an offset-compensating function and employed in a sample hold circuit according to a ninth embodiment of the invention.

FIG. 35 is a circuit block diagram showing a structure of a drive circuit 125 with the offset-compensating function in a sample hold circuit according to a ninth embodiment of the invention. In FIG. 35, drive circuit 125 with the offset-compensating function is substantially the same as drive circuit 60 in FIG. 12 except for that drive circuit 125 additionally includes capacitors 122*a*, 122*b*, 126*a* and 126*b* as well as switches S1*a*-S4*a* and S1*b*-S4*b*.

Switches S1*a* and S1*b* are connected between input node N120 and gates (nodes N20*a* and N20*b*) of transistors 24 and 26, respectively. Switches S4*a* and S4*b* are connected between output node N121 and drains (nodes N30*a* and N30*b*) of transistors 32 and 34, respectively. Capacitor 122*a* and switch S2*a* are connected in series between nodes N20*a* and N30*a*. Capacitor 122*b* and switch S2*b* are connected in series between nodes N20*b* and N30*b*. Switch 3*a* is connected between input node N120 and node N122*a* located between capacitor 122*a* and switch S2*a*. Switch 3*b* is connected between input node N120 and node N122*b* located between capacitor 122*b* and switch S2*b*. One of electrodes of each of capacitors 126*a* and 126*b* is connected to node N30*a* or N30*b*, and the other electrode receives a reset signal /ϕR or its complementary signal ϕR.

Figure 36:
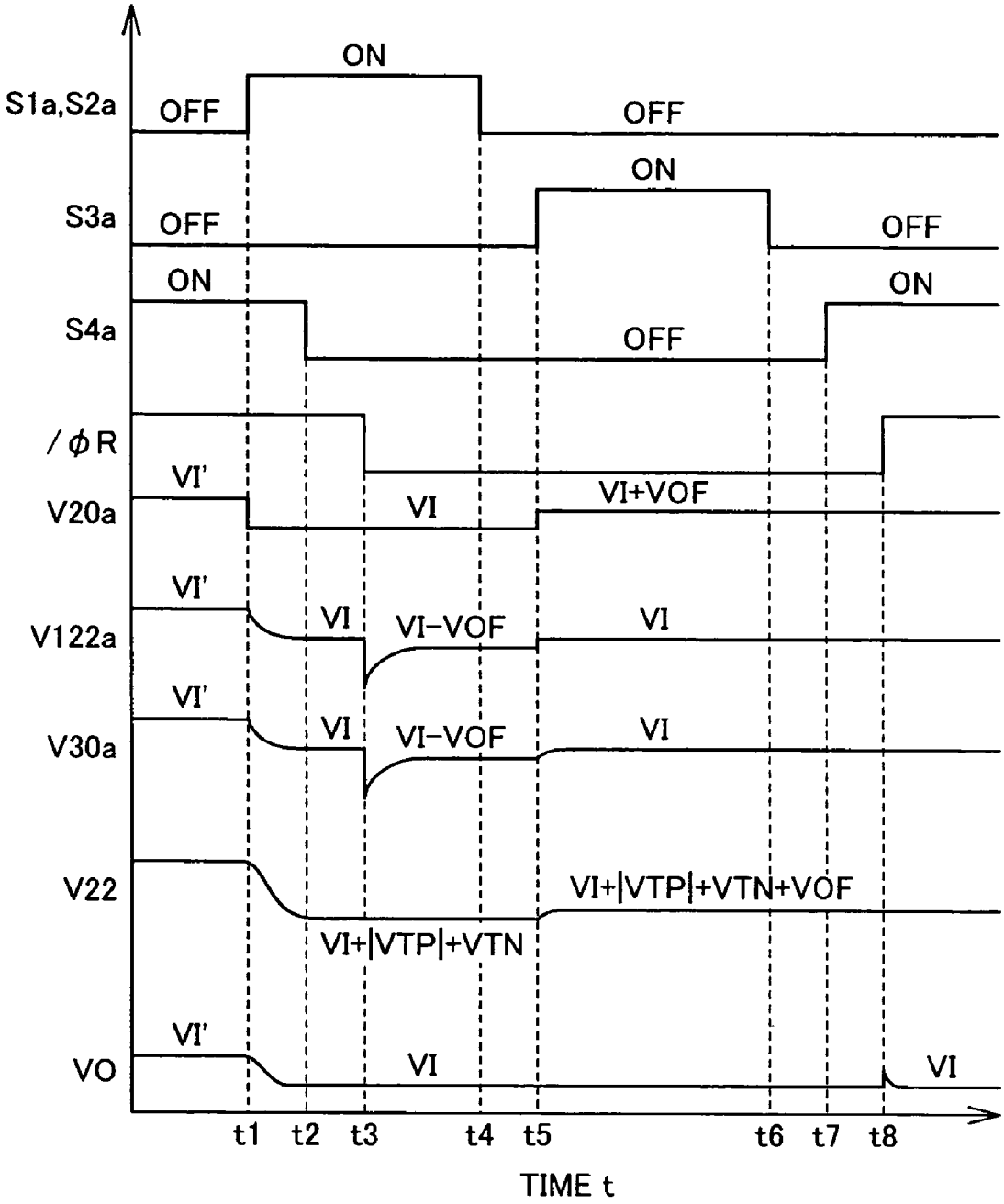
FIG. 36 is a time chart illustrating an operation of the drive circuit with the offset-compensating function shown in FIG. 35.

FIG. 36 is a time chart illustrating an operation of drive circuit 125 with the offset-compensating function shown in FIG. 35. A charging circuit formed of constant current supply 62 and transistors 23, 24, 31 and 32 perform substantially the same operations as a discharging circuit formed of constant current supply 64 and transistors 26, 27, 34 and 35 except for a difference between charging and discharging. Therefore, the operation of only the charging circuit will now be described with reference to FIG. 36. It is now assumed that threshold voltage VTN of N-type transistor 31 is larger than threshold voltage VTN of the N-type transistor by VOFa so that offset voltage VOFa is present on the charging circuit side, and an offset voltage VOFb is not present on the discharging circuit side.

In the initial state, switches S1*a*-S3*a* are off, and switch S4*a* is on so that nodes N20*a*, N122*a*, N30*a* and N121 hold a last potential VI'. When switches S1*a* and S2*a* are turned on at time t1, all potentials V20*a*, V122*a*, V30*a* and VO of nodes N20*a*, N122*a*, N30*a* and N121 become equal to input potential VI. Potential V22 of node N22 becomes equal to (VI+|VTP|+VTN). Although threshold voltage VTN' of N-type transistor 31 is higher than threshold voltage VTN of N-type transistor 23 by VOFa, all potentials V20*a*, V122*a*, V30*a* and VO can become equal to input potential VI. This is because output node N121 is discharged by the discharging circuit to the level of input potential VI, but is no longer discharged.

At time t2, switch S4*a* is turned off to isolate electrically output node N30*a* of the charging circuit from output node N30*b* of the discharging circuit. At subsequent time t3, reset signal /ϕR falls from the "H" level to the "L" level so that capacity coupling performed through capacitor 126*a* lowers potentials V30*a* and V122*a* of nodes N30*a* and N122*a* by a predetermined voltage. Thereby, transistors 31 and 32 are turned on to raise potentials V30*a* and V122*a* of nodes N30*a* and N122*a* to (VI−VOFa), and capacitor 122*a* is charged to VOFa.

After potentials V30*a* and V122*a* of nodes N30*a* and N122*a* become stable, switches S1*a* and S2*a* are turned off at time t4, and thereafter, switch S3*a* is turned on at time t5. Thereby, a potential of (VI+VOFa) equal to a sum of input potential VI and offset voltage VOFa is applied to node N20*a*. Therefore, potential V22 of node N22 becomes equal to (VI+|VTP|+VTN+VOFa), and potentials V30*a* and V122*a* of nodes N30*a* and N122*a* attain the same level as input potential VI.

Output potential V30*a* of the charging circuit becomes equal to VI at time t1. During a period between times t1 and t2, however, potential V30*a* of VI is held merely by line capacitances and others, and will lower to (VI−VOF) when negative noises occur. At and after time t5, however, transistors 31 and 32 perform the charging even when negative noises occur so that potential V30*a* is kept at VI.

At a time t6, switch S3*a* is turned off, and then, switch S4*a* is turned on at a time t7 so that the drive circuit drives load capacitance 36. At a time t8, reset signal /ϕR rises to the "H" level so that the circuits return to the initial state. At time t8, an output impedance is sufficiently low so that output potential VO hardly change even when reset signal /ϕR rises to the "H" level. Similar operations are performed on the discharging circuit side so that output potential VO is kept at VI.

Figure 37:
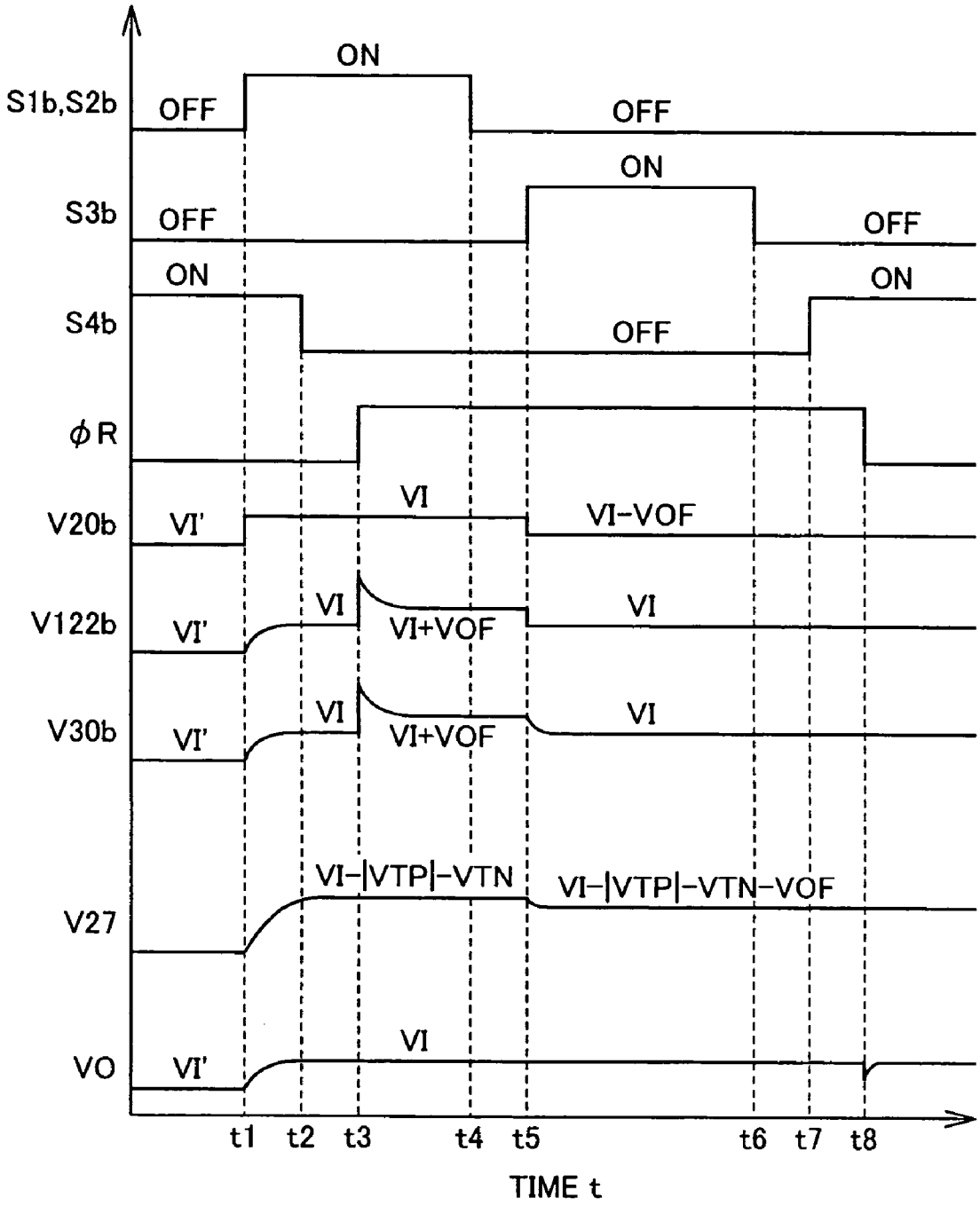
FIG. 37 is another time chart illustrating the operation of the drive circuit with the offset-compensating function shown in FIG. 35.

FIG. 37 is another time chart illustrating an operation of drive circuit 125 with the offset-compensating function shown in FIG. 35. A charging circuit formed of constant current supply 62 and transistors 23, 24, 31 and 32 perform substantially the same operations as a discharging circuit formed of constant current supply 64 and transistors 26, 27, 34 and 35 except for a difference between charging and discharging. Therefore, the operation of only the discharging circuit will now be described with reference to FIG. 37. It is now assumed that an absolute value |VTP'| of the threshold voltage of P-type transistor 35 is larger than an absolute value |VTP| of the threshold voltage of P-type transistor 27 by VOFb so that offset voltage VOFb is present on the discharging circuit side, and offset voltage VOFa is not present on the charging circuit side.

In the initial state, switches S1*b*-S3*b* are off, and switch S4*b* is on so that nodes N20*b*, N122*b*, N30*b* and N121 hold last potential VI'. When switches S1*b* and S2*b* are turned on at time t1, all potentials V20*b*, V122*b*, V30*b* and VO of nodes N20*b*, N122*b*, N30*b* and N121 become equal to input potential VI. Potential V27 of node N27 becomes equal to (VI−|VTP|−VTN). Although the absolute value |VTP'| of the threshold voltage of P-type transistor 35 is higher than the absolute value |VTP| of the threshold voltage of P-type transistor 27 by VOFb, all potentials V20*b*, V122*b*, V30*b* and VO can become equal to potential VI. This is because output node N121 is charged by the charging circuit to the level of input potential VI, but is no longer discharged.

At time t2, switch S4*b* is turned off to isolate electrically output node N30*a* of the charging circuit from output node N30*b* of the discharging circuit. At subsequent time t3, reset signal /ϕR rises from the "L" level to the "H" level so that capacity coupling performed through capacitor 126*b* lowers potentials V30*b* and V122*b* of nodes N30*b* and N122*b* by a predetermined voltage. Thereby, transistors 34 and 35 are turned on to raise potentials V30*b* and V122*b* of nodes N30*b* and N122*b* to (VI+VOFb), and capacitor 122*b* is charged to VOFb.

After potentials V30*b* and V122*b* of nodes N30*b* and N122*b* become stable, switches S1*b* and S2*b* are turned off at time t4, and thereafter, switch S3*b* is turned on at time t5. Thereby, a potential of (VI−VOF) equal to a difference between input potential VI and offset voltage VOFb is applied to node N20*b*. Therefore, potential V27 of node N27 becomes equal to (VI−VTN|VTP|−VOFb), and potentials V30*b* and V122*b* of nodes N30*b* and N122*b* attain the same level as input potential VI.

Output potential V30*b* of the discharging circuit becomes equal to VI at time t1. During a period between times t1 and t2, however, potential V30*b* of VI is held merely, by line capacitances and others, and will rise to (VI+VOF) when positive noises occur. At and after time t5, however, transistors 34 and 35 perform the discharging even when positive noises occur so that potential V30*b* is kept at VI.

At time t6, switch S3*b* is turned off, and switch S4*b* is turned on at time t7 so that the drive circuit drives load capacitance 36. At time t8, signal ϕR falls to the "L" level so that the circuits return to the initial state. At time t8, the output impedance is low so that output potential VO hardly change even when signal ϕR falls to the "L" level. Similar operations are performed on the discharging circuit side so that output potential VO is kept at VI.

Figure 38:
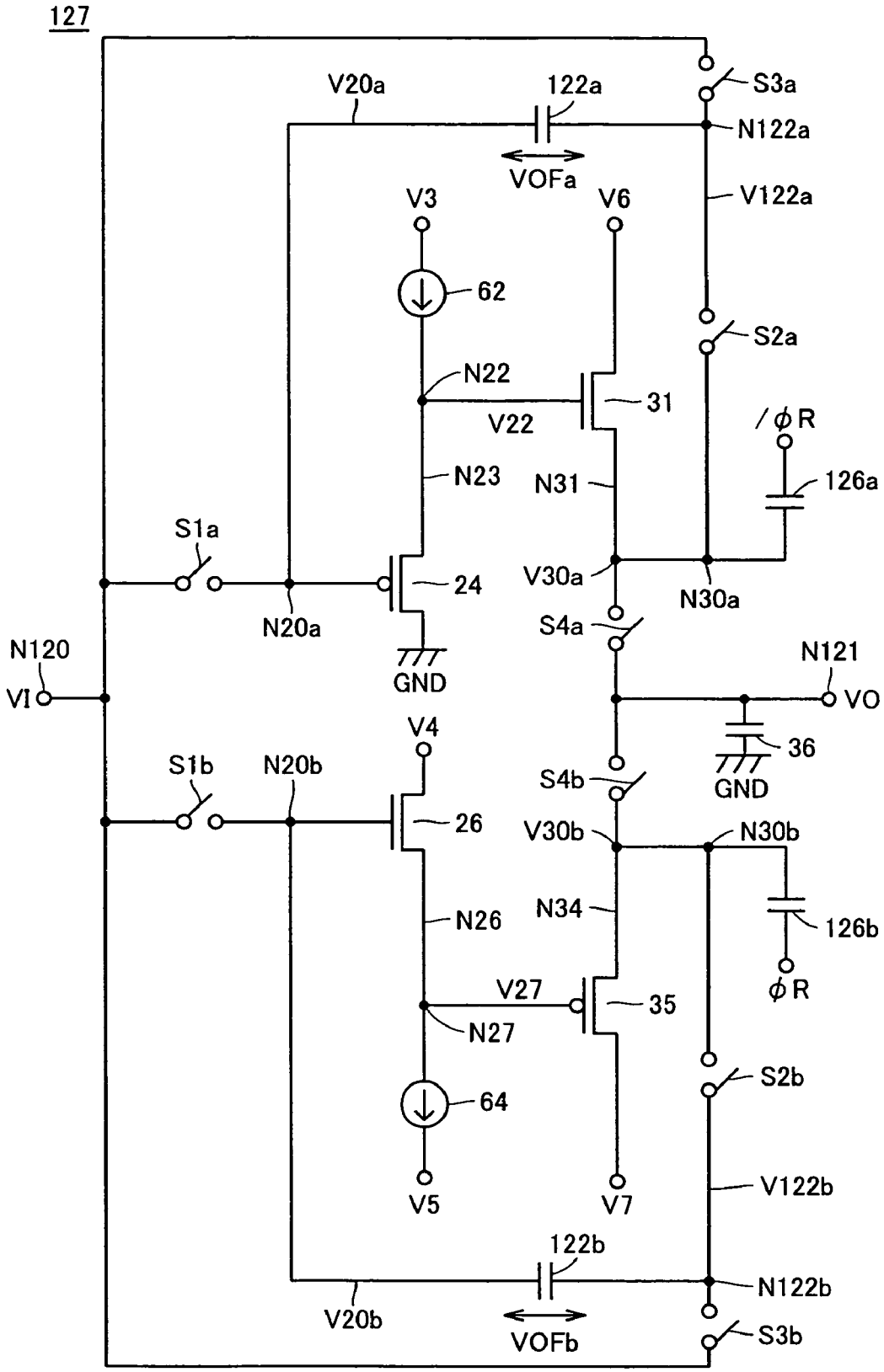
FIG. 38 is a circuit diagram showing a modification of the ninth embodiment.

Various modifications of the ninth embodiment will now be described. A drive circuit 127 with the offset-compensating function shown in FIG. 38 is substantially the same as drive circuit 125 with the offset-compensating function in FIG. 35 except for that N-type transistors 23 and 34 as well as P-type transistors 27 and 32 are eliminated. This modification can reduce an area occupied by the circuit.

Figure 39:
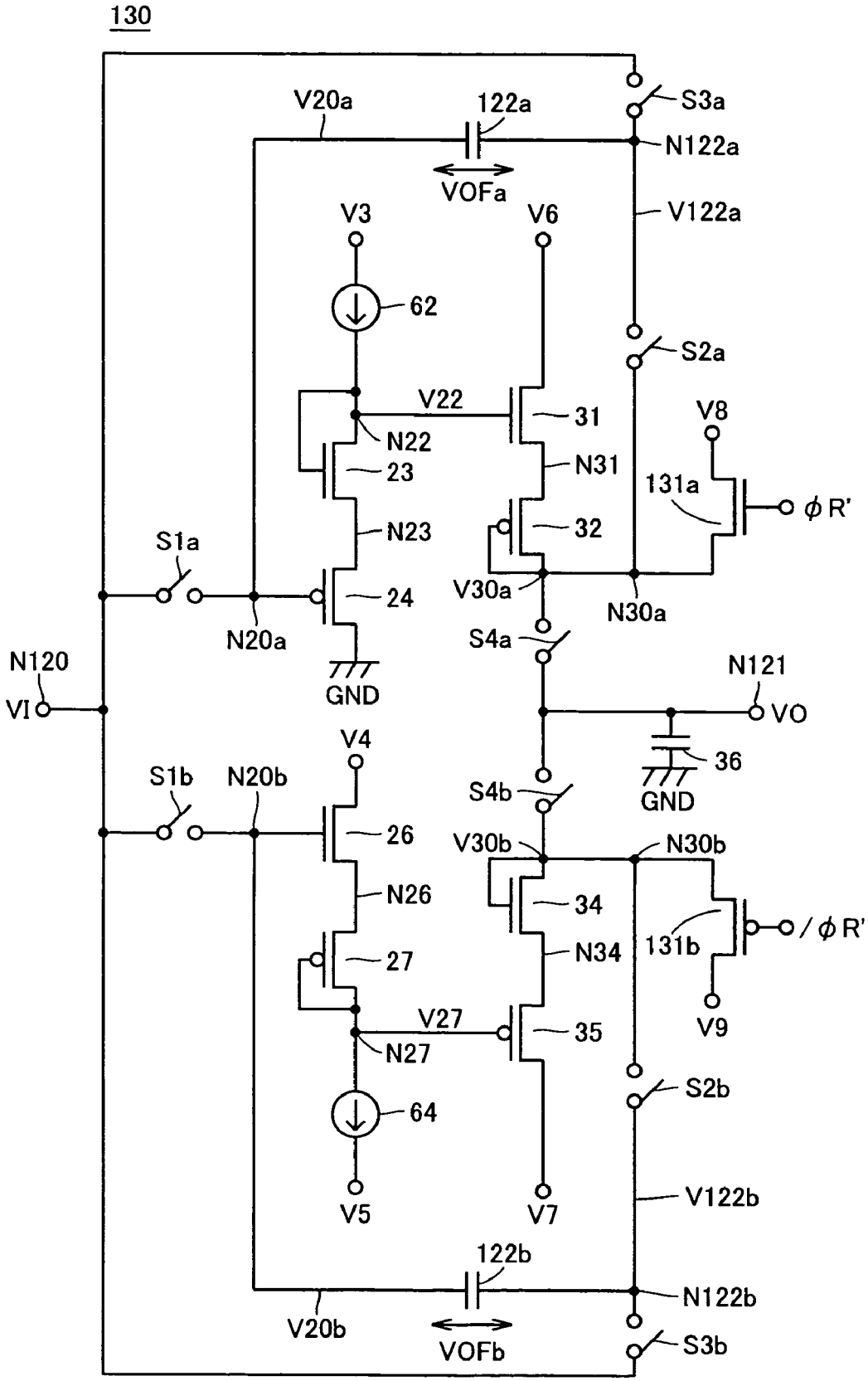
FIG. 39 is a circuit diagram showing another modification of the ninth embodiment.

A drive circuit 130 with the offset-compensating function shown in FIG. 39 is substantially the same as drive circuit 125 with the offset-compensating function in FIG. 35 except for that capacitors 126*a* and 126*b* are replaced with N- and P-type transistors 131*a* and 131*b*, respectively. N-type transistor 131*a* is connected between a line of an eighth power supply potential V8 and node N30*a*, and receives reset signal ϕR' on its gate. P-type transistor 131*b* is connected between node N30*b* and a line of a ninth power supply potential V9, and receives on its gate a complementary signal /ϕR' of reset signal ϕR'.

In an usual state, signal ϕR' and /ϕR' are at the "L" and "H" levels, respectively, and N- and P-type transistors 131*a* and 131*b* are both off. At time t3 in FIGS. 36 and 37, signal ϕR' attains the "H" level in a pulse-like fashion for a predetermined time, and signal /ϕR' attains the "L" level in a pulse-like fashion for the predetermined time. Thereby, N-type transistor 131*a* is turned on in a pulse-like fashion to lower potential V30*a* of node N30*a* to eighth power supply potential V8. Also, P-type transistor 131*b* is turned on in a pulse-like fashion to raise potential V30*b* of node N30*b* to ninth power supply potential V9. Thereafter, node N30*a* is charged to (VI−VOF) in the case illustrated in FIG. 36, and node N30*b* is discharged to (VO+VOF) in the case illustrated in FIG. 37. In this modification, noises do not occur on output potential VO even at time t8 in FIGS. 36 and 37. Each of signals ϕR' and /ϕR' is configured to have a pulse width of a minimum required value.

Figure 40:
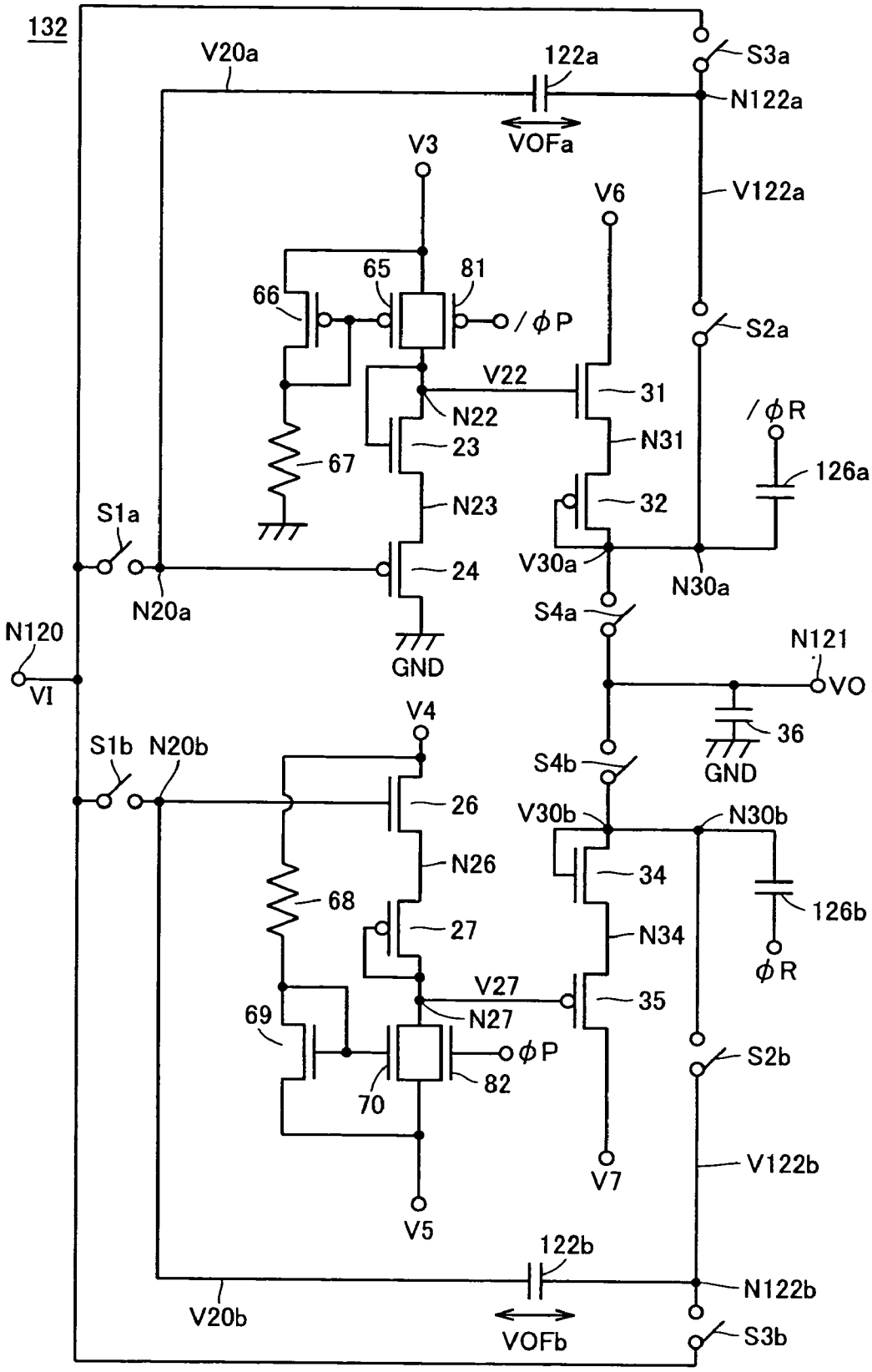
FIG. 40 is a circuit diagram showing still another modification of the ninth embodiment.

A drive circuit 132 with the offset-compensating function shown in FIG. 40 is substantially the same as drive circuit 80 in FIG. 20 except for that drive circuit 132 additionally includes an offset-compensating circuit formed of capacitors 122*a*, 122*b*, 126*a* and 126*b* as well as switches S1*a*-S4*a* and S1*b*-S4*b*. During a period between times t1 and t2 in FIGS. 36 and 37, signal /ϕP attains the "L" level in a pulse-like fashion, and signal ϕP attains the "H" level in a pulse-like fashion. In this modification, potentials V22 and V27 of nodes N22 and N27 rapidly reach the predetermined values so that the operation speed can be high.

Figure 41:
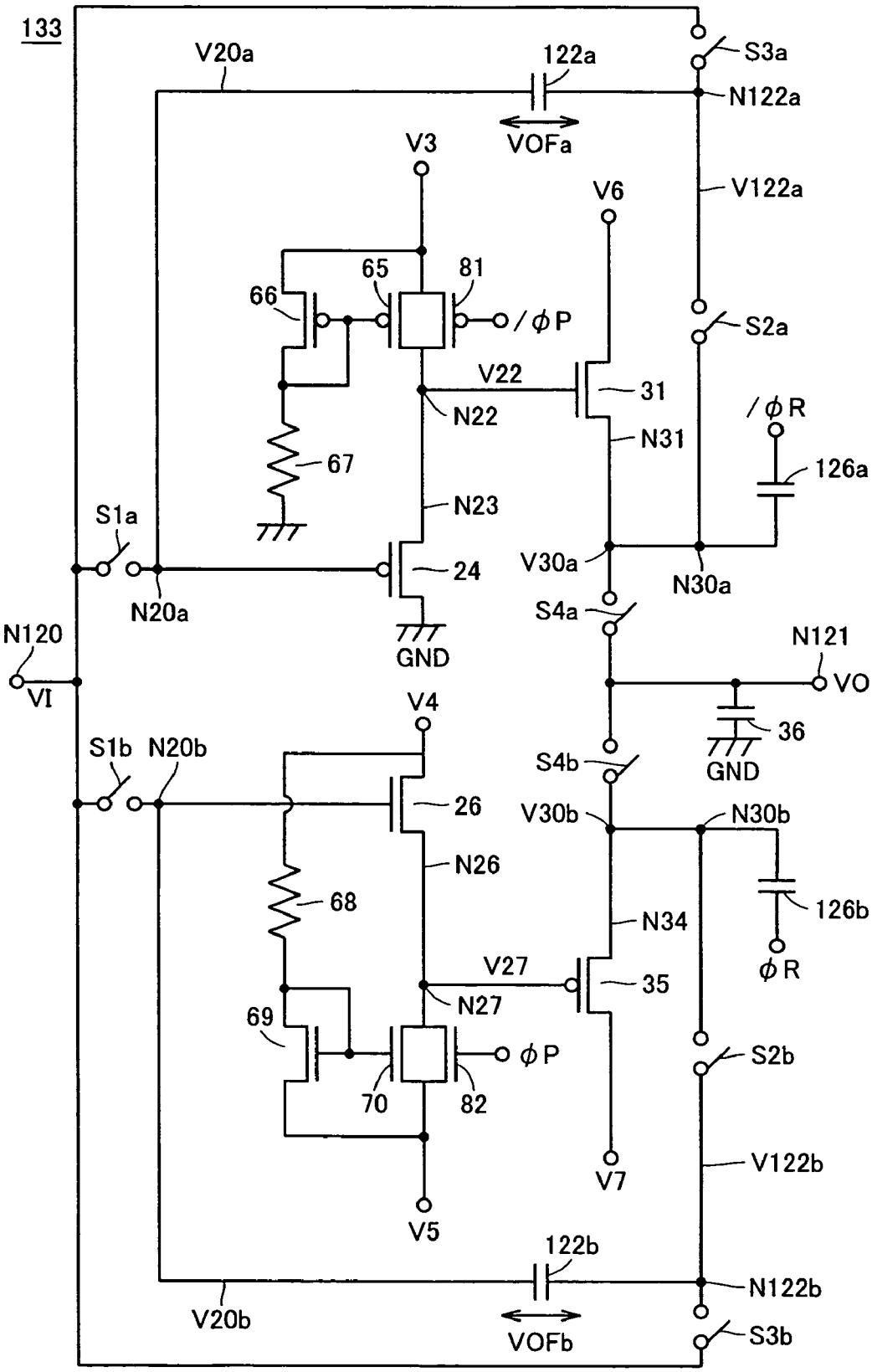
FIG. 41 is a circuit diagram showing yet another modification of the ninth embodiment.

A drive circuit 133 with the offset-compensating function shown in FIG. 41 is substantially the same as drive circuit 132 with the offset-compensating function except for that N-type transistors 23 and 34 as well as P-type transistors 27 and 32 are eliminated. This modification can reduce an area occupied by the circuit.

Figure 42:
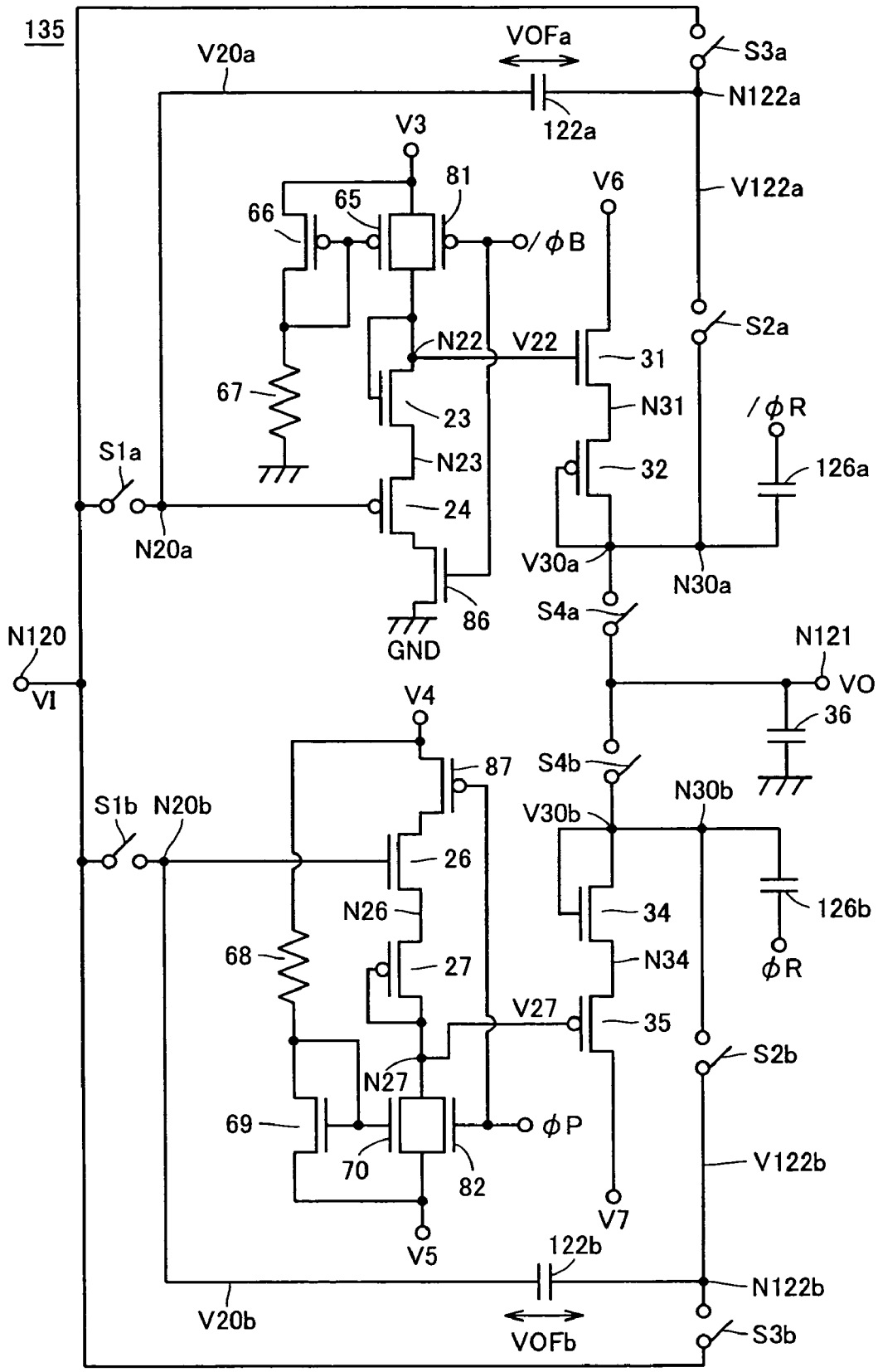
FIG. 42 is a circuit diagram showing further another modification of the ninth embodiment.

A drive circuit 135 with the offset-compensating function shown in FIG. 42 is substantially the same as drive circuit 85 shown in FIG. 22 except for that drive circuit 135 additionally includes an offset-compensating circuit formed of capacitors 122*a*, 122*b*, 126*a* and 126*b* as well as switches S1*a*-S4*a* and S1*b*-S4*b*. In this modification, when signals /ϕP and ϕP attain the "L" and "H" levels to turn on transistors 81 and 82, respectively, transistors 86 and 87 are simultaneously turned off so that flowing of a through-current is prevented, and current consumption can be small.

Figure 43:
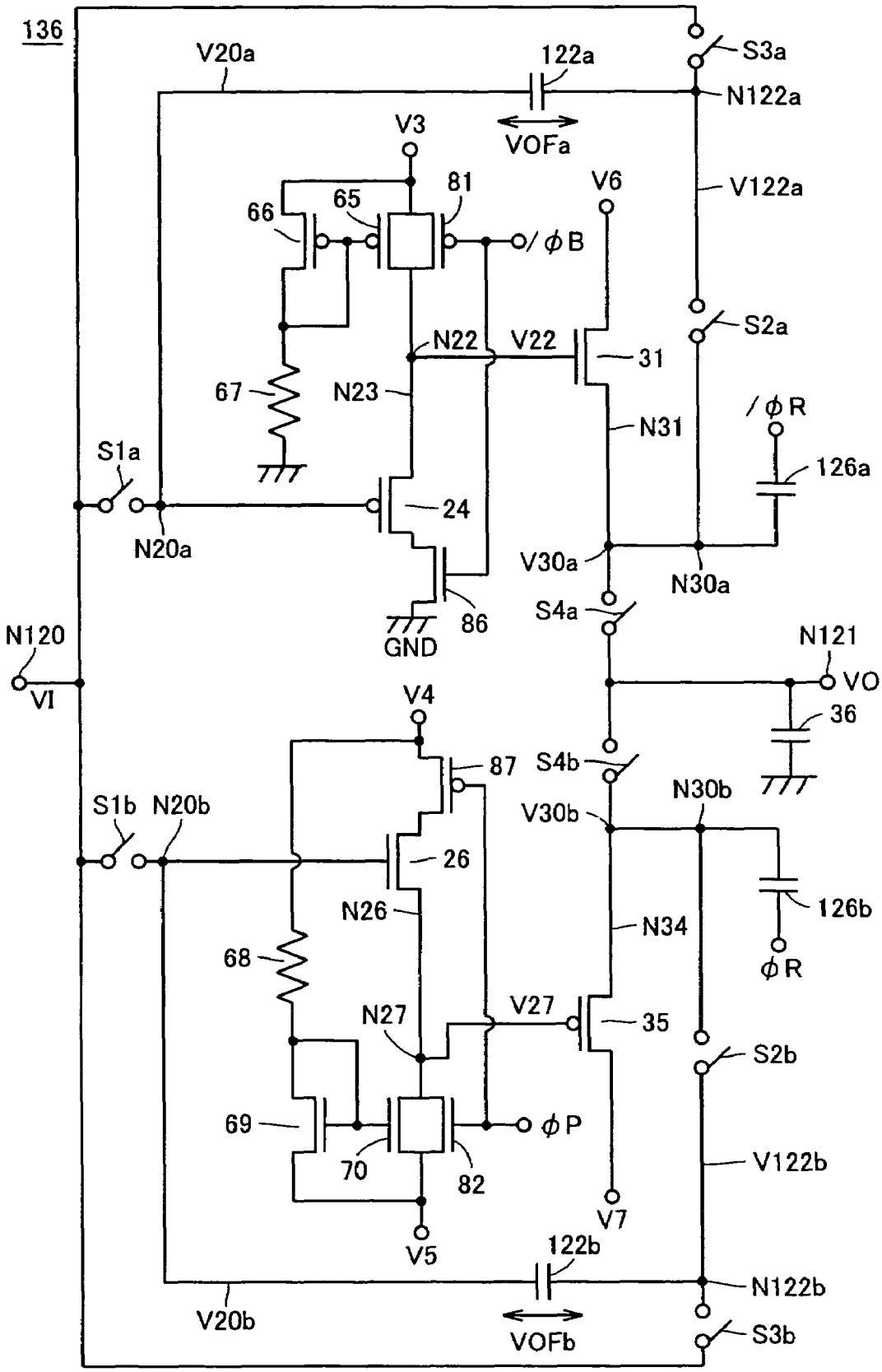
FIG. 43 is a circuit diagram showing a further modification of the ninth embodiment.

A drive circuit 136 with the offset-compensating function shown in FIG. 43 is substantially the same as drive circuit 135 with the offset-compensating function shown in FIG. 42 except for that N-type transistors 23 and 34 as well as P-type transistors 27 and 32 are eliminated. This modification can reduce an area occupied by the circuit.

Figure 44:
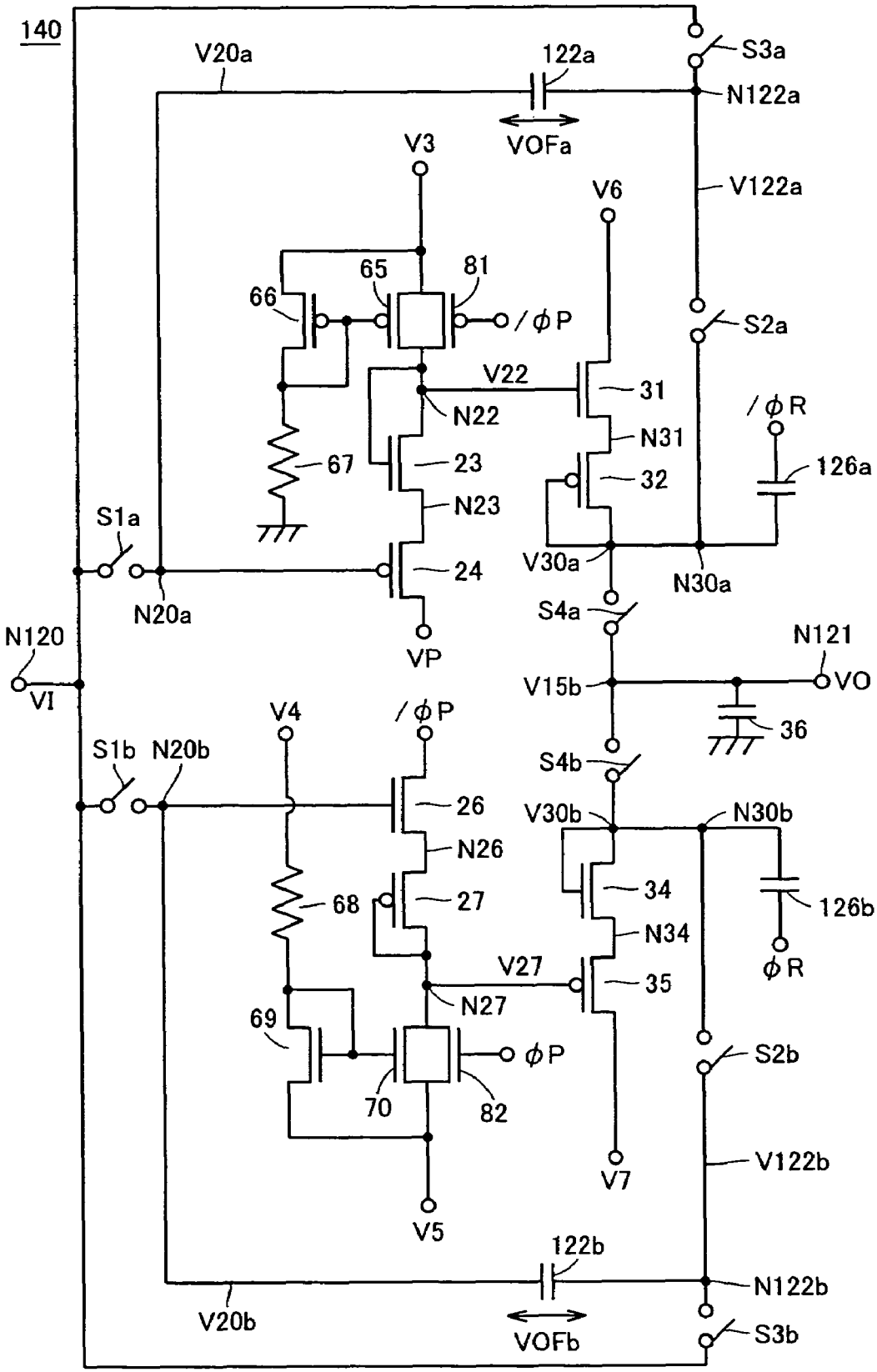
FIG. 44 is a circuit diagram showing a further modification of the ninth embodiment.

A drive circuit 140 with the offset-compensating function shown in FIG. 44 is substantially the same as drive circuit 90 in FIG. 24 except for that drive circuit 140 additionally includes an offset-compensating circuit formed of capacitors 122*a*, 122*b*, 126*a* and 126*b* as well as switches S1*a*-S4*a* and S1*b*-S4*b*. In this modification, when signal /ϕP attain the "L" level to turn on P-type transistor 81, a drain of P-type transistor 24 attains the "H" level. When signal ϕP attains the "H" level to turn on N-type transistor 82, a drain of N-type transistor 26 attains the "L" level. Therefore, flowing of a through-current can be prevented, and the power consumption can be small.

Figure 45:
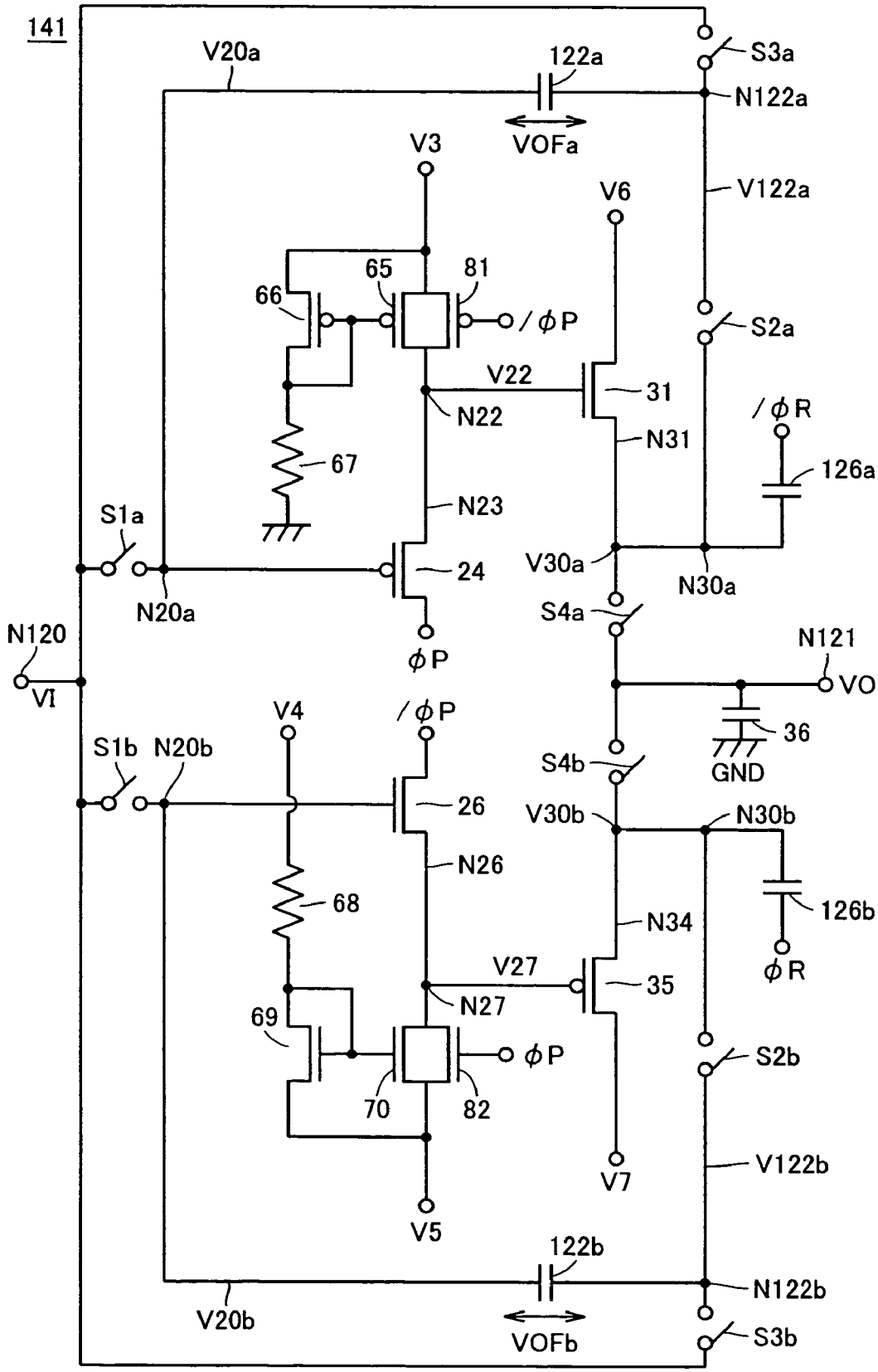
FIG. 45 is a circuit diagram showing a further modification of the ninth embodiment.

A drive circuit 141 with the offset-compensating function shown in FIG. 45 is substantially the same as drive circuit 140 with the offset-compensating function shown in FIG. 44 except for that N-type transistors 23 and 34 as well as P-type transistors 27 and 32 are eliminated. This modification can reduce an area occupied by the circuit.

Figure 46:
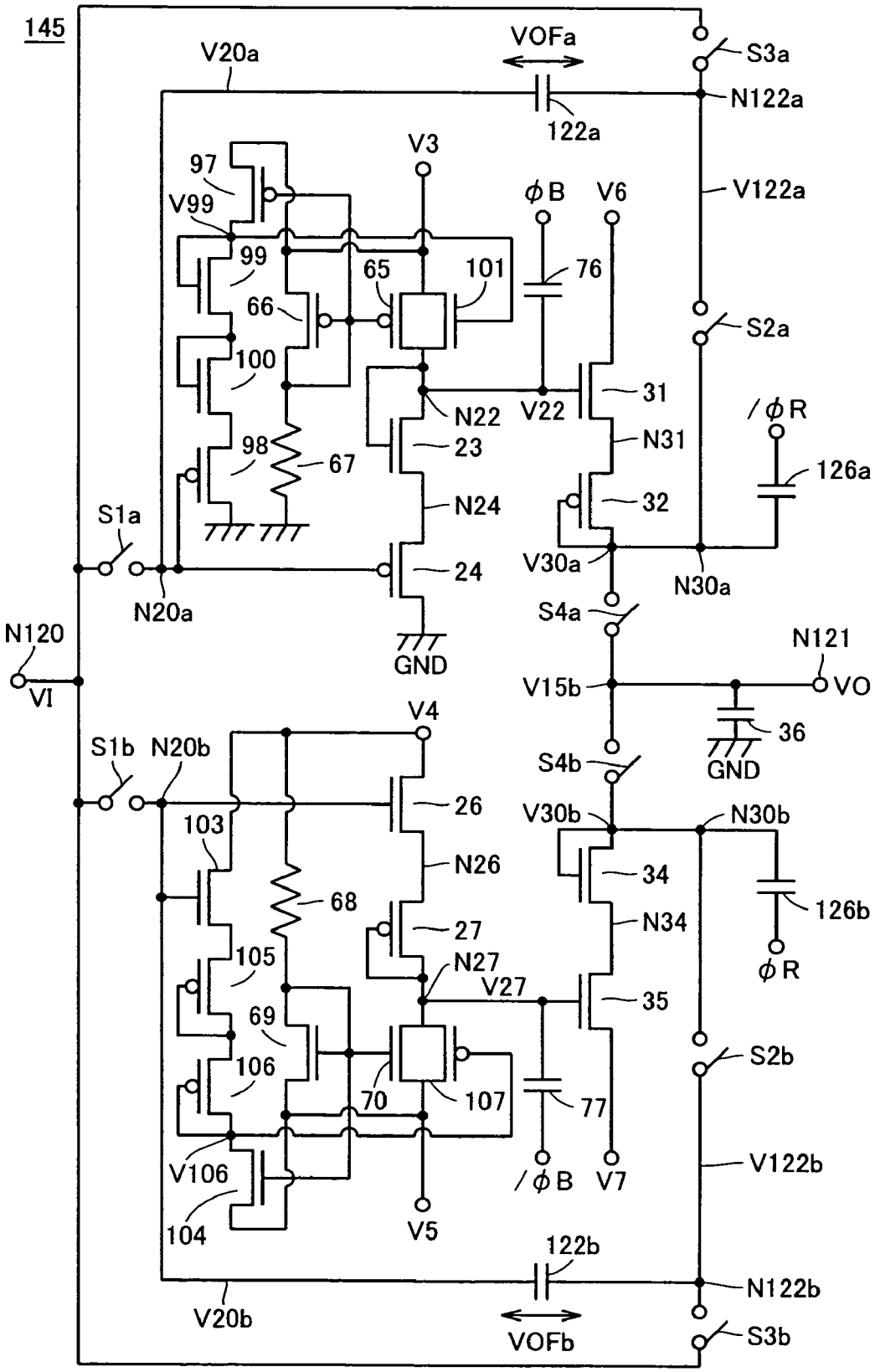
FIG. 46 is a circuit diagram showing a further modification of the ninth embodiment.

A drive circuit 145 with the offset-compensating function shown in FIG. 46 is substantially the same as drive circuit 95 shown in FIG. 26 except for that drive circuit 145 additionally includes an offset-compensating circuit formed of capacitors 122*a*, 122*b*, 126*a* and 126*b* as well as switches S1*a*-S4*a* and S1*b*-S4*b*. During a period between times t1 and t2 in FIGS. 36 and 37, signal ϕB attains the "H" level in a pulse-like fashion, and signal /ϕB attains the "L" level in a pulse-like fashion. In this modification, potentials V22 and V27 of nodes N22 and N27 rapidly reach the predetermined values so that the operation speed can be high.

Figure 47:
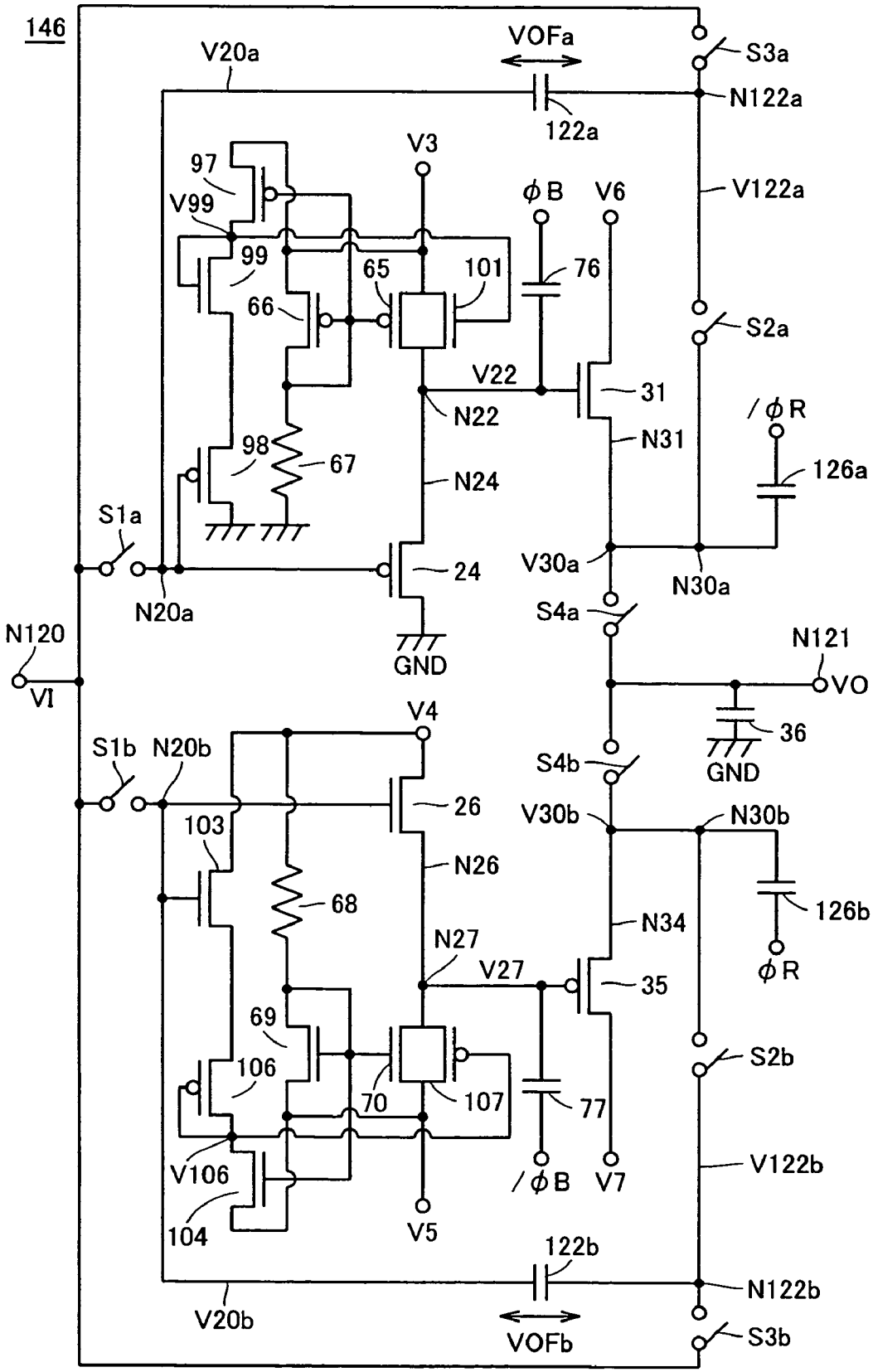
FIG. 47 is a circuit diagram showing a further modification of the ninth embodiment.

A drive circuit 146 with the offset-compensating function shown in FIG. 47 is substantially the same as drive circuit 145 with the offset-compensating function shown in FIG. 46 except for that N-type transistors 23, 34 and 100 as well as P-type transistors 27, 32 and 105 are eliminated. This modification can reduce an area occupied by the circuit.

Figure 48:
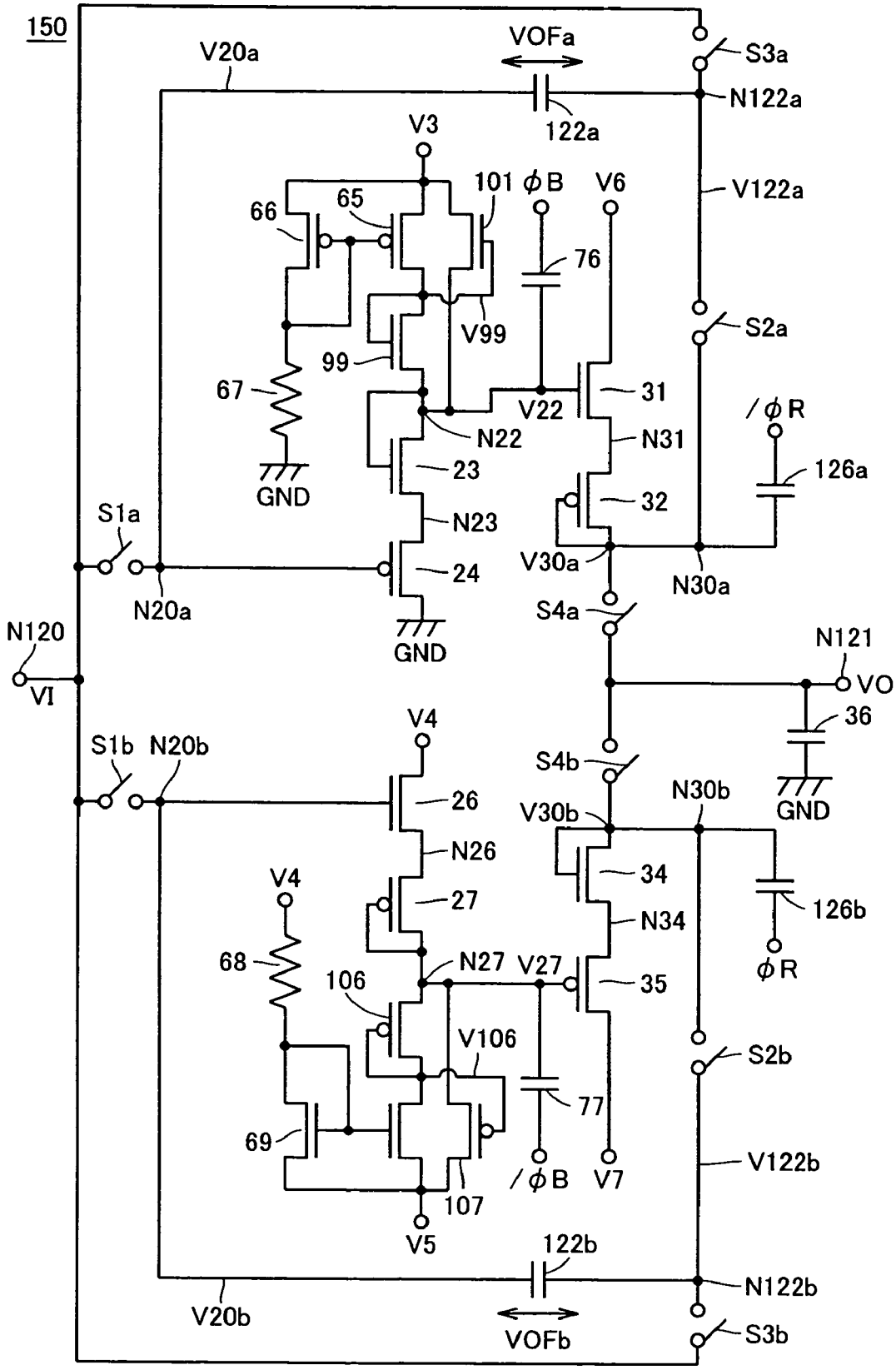
FIG. 48 is a circuit diagram showing a further modification of the ninth embodiment.

A drive circuit 150 with the offset-compensating function shown in FIG. 48 is substantially the same as drive circuit 110 shown in FIG. 29 except for that drive circuit 150 additionally includes an offset-compensating circuit formed of capacitors 122*a*, 122*b*, 126*a* and 126*b* as well as switches S1*a*-S4*a* and S1*b*-S4*b*. During a period between times t1 and t2 in FIGS. 36 and 37, signal ϕB attains the "H" level in a pulse-like fashion, and signal /ϕB attains the "L" level in a pulse-like fashion. In this modification, potentials V22 and V27 of nodes N22 and N27 rapidly reach the predetermined values so that the operation speed can be high.

Figure 49:
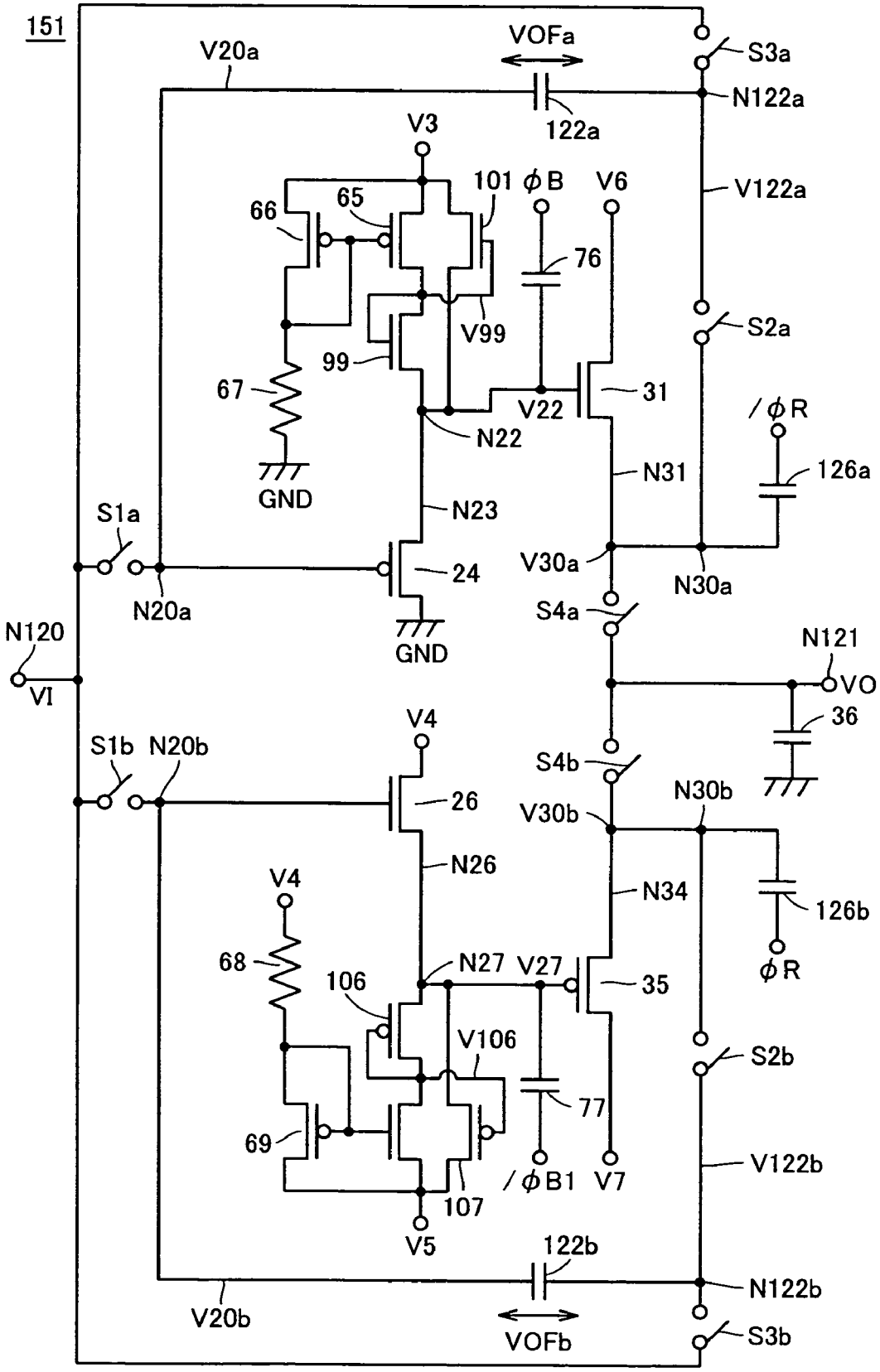
FIG. 49 is a circuit diagram showing a further modification of the ninth embodiment.

A drive circuit 151 with the offset-compensating function shown in FIG. 49 is substantially the same as drive circuit 150 with the offset-compensating function shown in FIG. 48 except for that N-type transistors 23 and 34 as well as P-type transistors 27 and 32 are eliminated. This modification can reduce an area occupied by the circuit.

Tenth Embodiment

Figure 50:
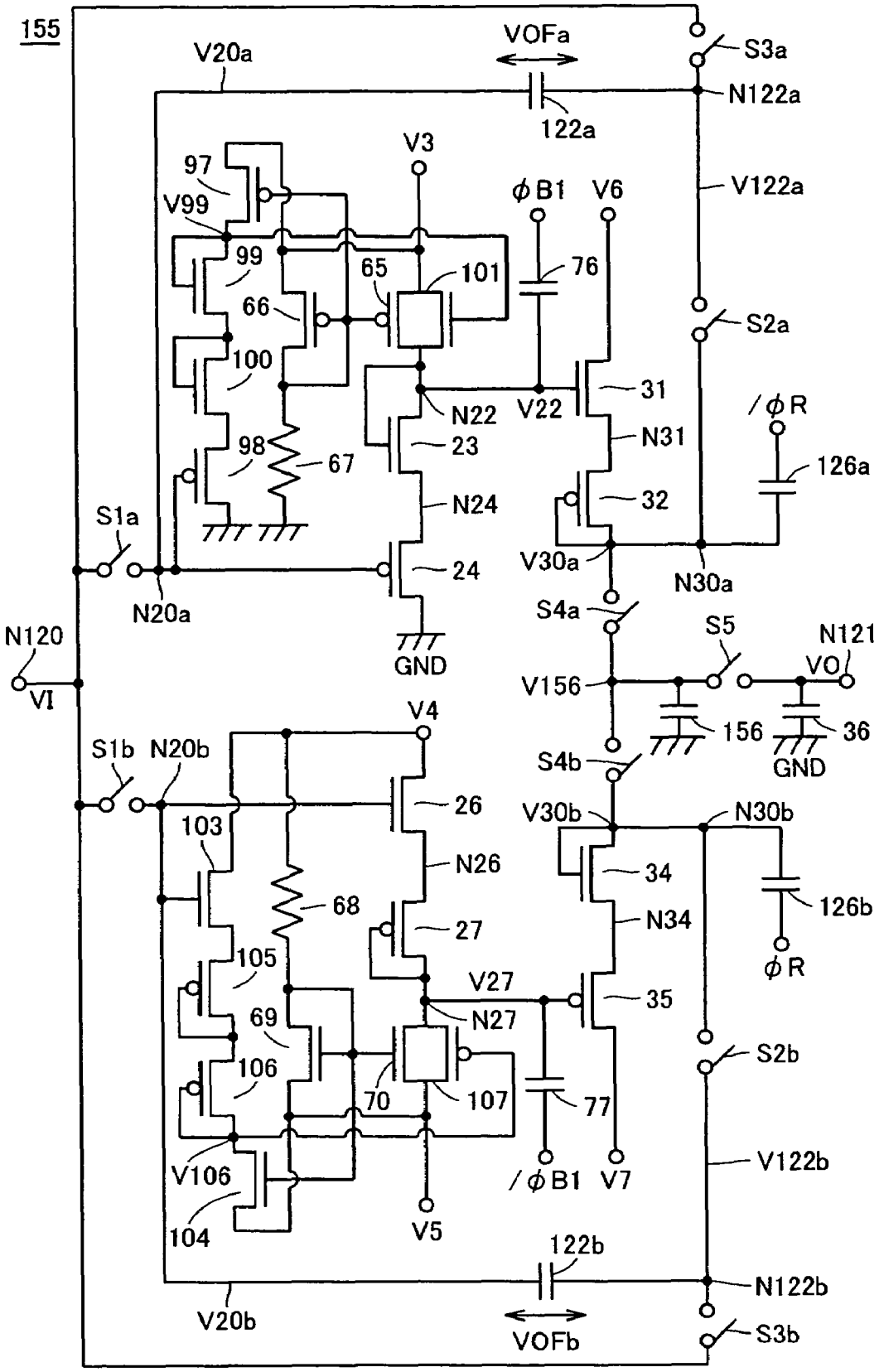
FIG. 50 is a circuit block diagram showing a structure of a drive circuit provided with an offset-compensating function and employed in a sample hold circuit according to a tenth embodiment of the invention.

FIG. 50 is a circuit diagram showing a structure of a drive circuit 155 with the offset-compensating function of a sample hold circuit according to a tenth embodiment of the invention. In FIG. 50, drive circuit 155 with the offset-compensating function differs from drive circuit 145 with the offset-compensating function shown in FIG. 46 in that a switch S5 and a capacitor 156 are additionally employed, and boost signal ϕB and /ϕB are replaced with boost signals ϕB1 and /ϕB1, respectively.

Switch S5 is connected between output node N121 and a node located between switches S4*a* and S4*b*. A capacitor 156 is connected between the line of ground potential GND and a node located between switches S4*a* and S4*b*. Capacitor 156 has a capacitance value smaller than that of the capacitance value of load capacitance 36.

Figure 51:
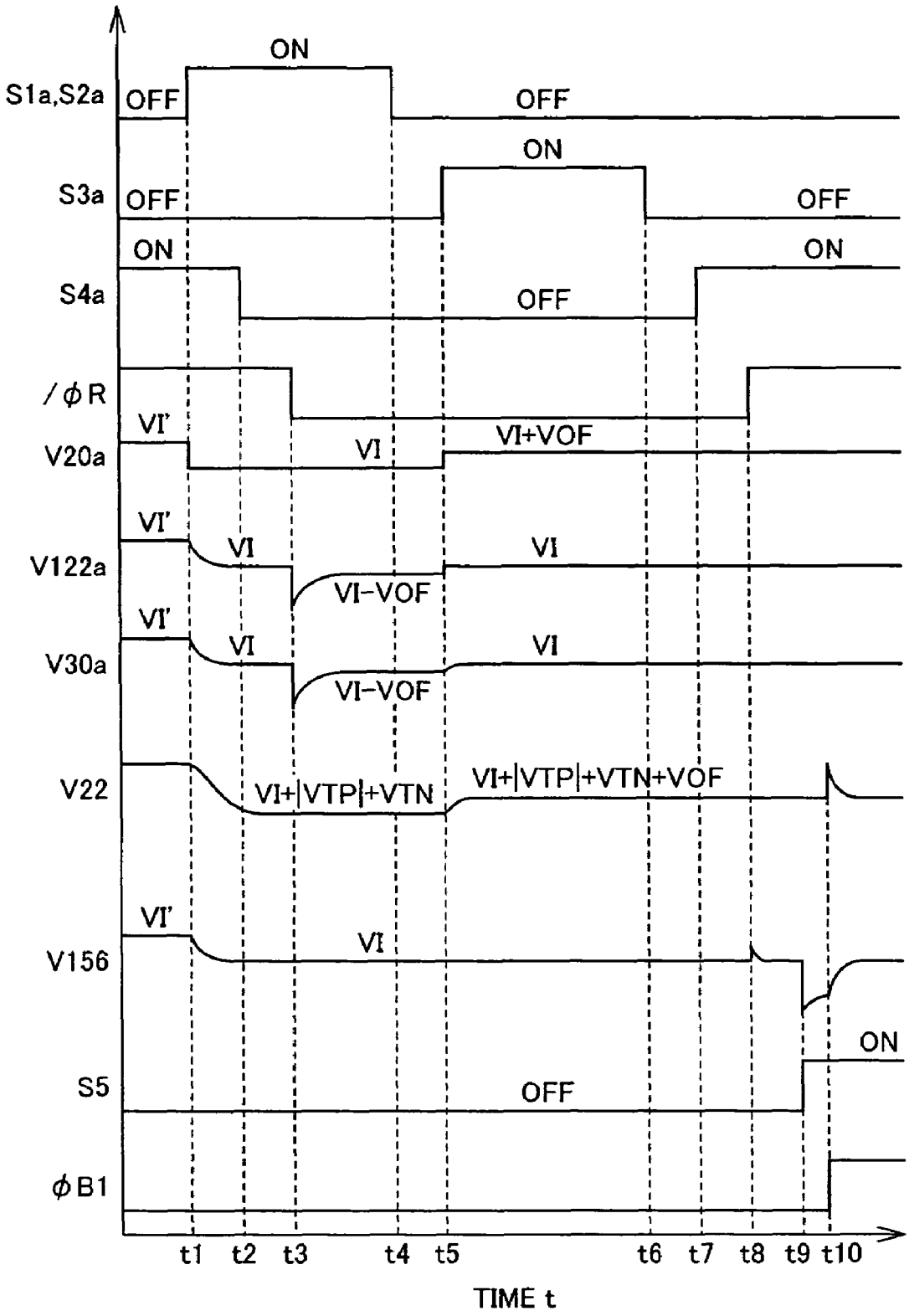
FIG. 51 is a time chart illustrating an operation of the drive circuit with the offset-compensating function shown in FIG. 50.

FIG. 51 is a time chart illustrating an operation of drive circuit 155 with the offset-compensating function shown in FIG. 50, and corresponds to FIG. 36. Likewise, only the operation of the circuits on the charging side will now be described. Until a time t9, as illustrated in FIG. 51, switch S5 is kept off and load capacitance 36 is electrically isolated. Therefore, potentials V22, V30*a* and V122*a* rapidly reach input potential VI between time t1 and t2.

When switch S5 is turned on at time t9, a potential V156 between switches S4*a* and S4*b* changes in accordance with potential VO of the data line connected to output node N121. FIG. 51 illustrates the case, in which potential VO of the data line was lower than V156, and potential V156 will gradually rise owning to supply of the current by transistors 31 and 32 after potential V156 lowers at time t9. At a subsequent time t10, signal ϕB1 rises from the "L" level to the "H" level, and potential V22 of node N22 rises in a pulse-like fashion so that the current flowing through N-type transistor 31 increases, and potential V156 of VO will rapidly reach input potential VI.

Figure 52:
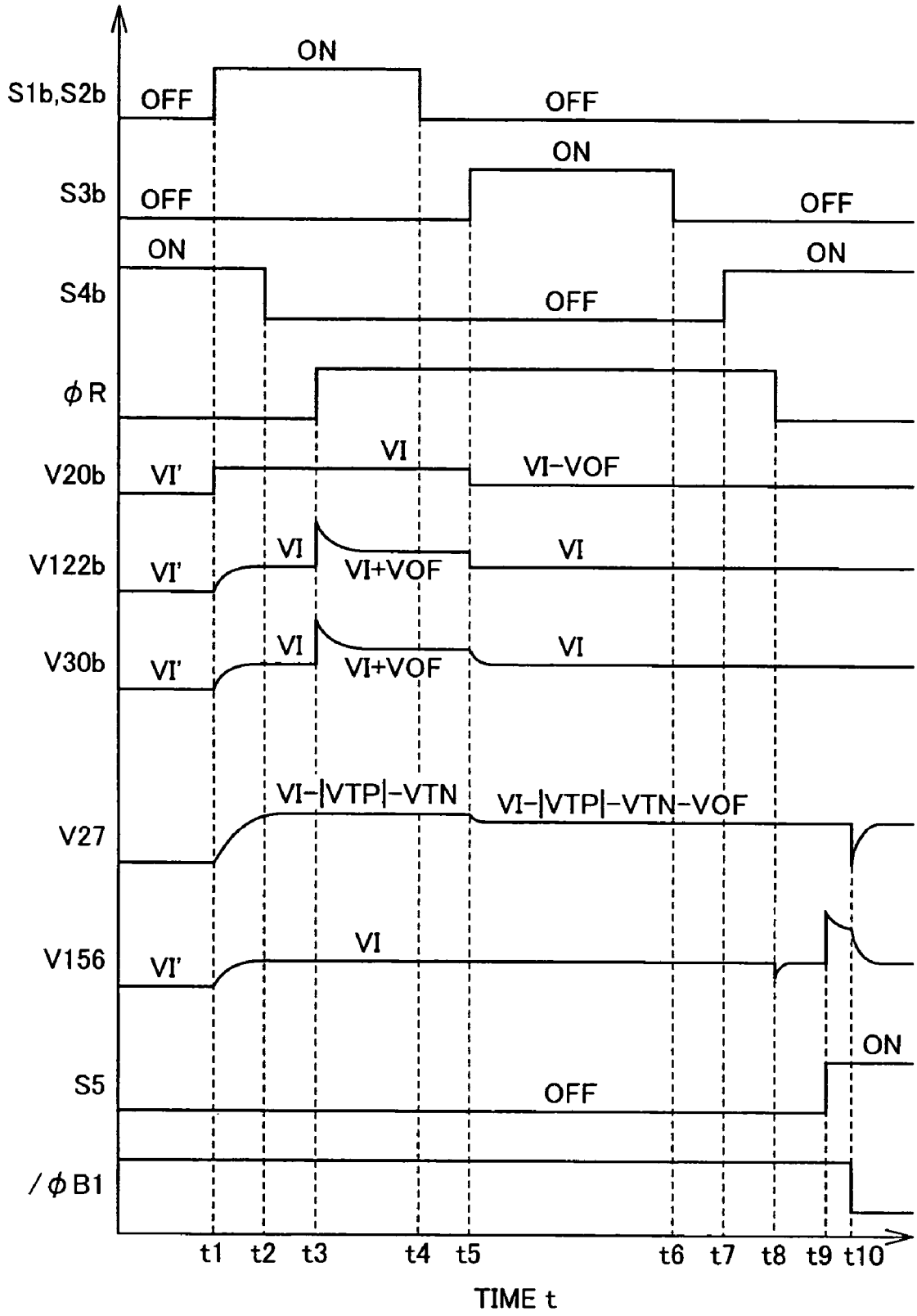
FIG. 52 is another time chart illustrating the operation of the drive circuit with the offset-compensating function shown in FIG. 50.

FIG. 52 is another time chart illustrating the operation of drive circuit 155 with the offset-compensating function shown in FIG. 50, and corresponds to FIG. 37. Likewise, only the operation on the discharging circuit side will now be described. Until time t9, switch S5 is off as illustrated in FIG. 52, and load capacitance 36 is electrically isolated so that potentials V27, V30*b* and V122*b* will rapidly reach potential VI between times t1 and t2.

When switch S5 is turned on at time t9, potential V156 between switches S4*a* and S4*b* changes in accordance with potential VO of the data line connected to output node N121. FIG. 52 illustrates the case, where potential VO of the data line was higher than V156, and potential VI 56 will gradually lower in accordance with discharging of the current by transistors 34 and 35 after potential V156 rises at time t9.

At subsequent time t10, signal /ϕB1 falls from the "H" level to the "L" level, and potential V27 of node N27 lowers in a pulse-like fashion so that the current flowing through P-type transistor 35 increases, and potential V156 of VO will rapidly reach input potential VI.

In this tenth embodiment, a high operation speed can be achieved even when load capacitance 36 has a large capacitance value.

Eleventh Embodiment

Figure 53:
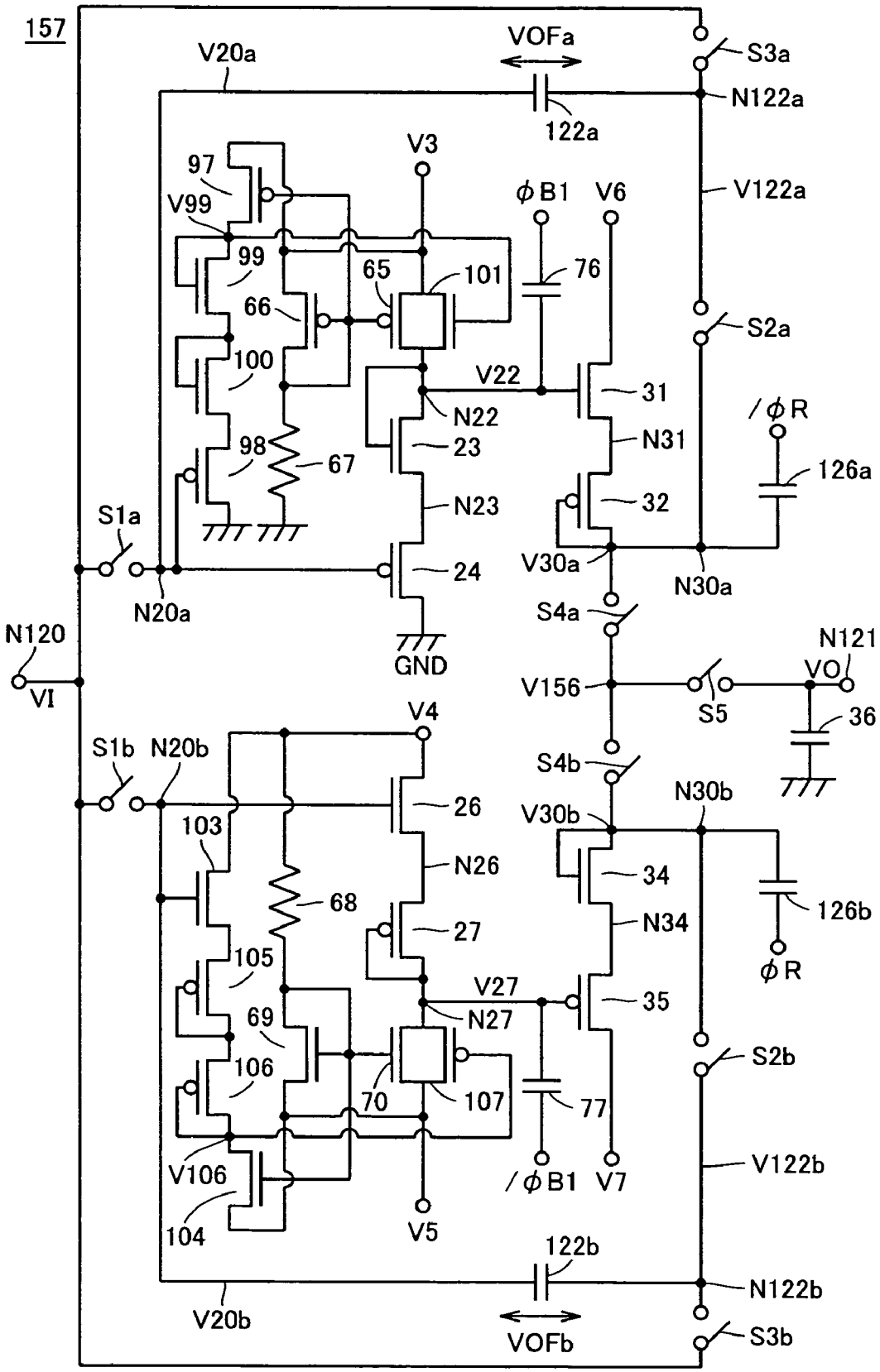
FIG. 53 is a circuit block diagram showing a structure of a drive circuit provided with an offset-compensating function and employed in a sample hold circuit according to an eleventh embodiment of the invention.

FIG. 53 is a circuit diagram showing a structure of a drive circuit 157 with the offset-compensating function according to an eleventh embodiment of the invention. Referring to FIG. 53, drive circuit 157 with the offset-compensating function differs from drive circuit 155 with the offset-compensating function shown in FIG. 50 in that capacitor 156 is eliminated, and also differs therefrom in the timing of on/off of switch S5 and the timing of level change of signals ϕB1 and /ϕB1.

Figure 54:
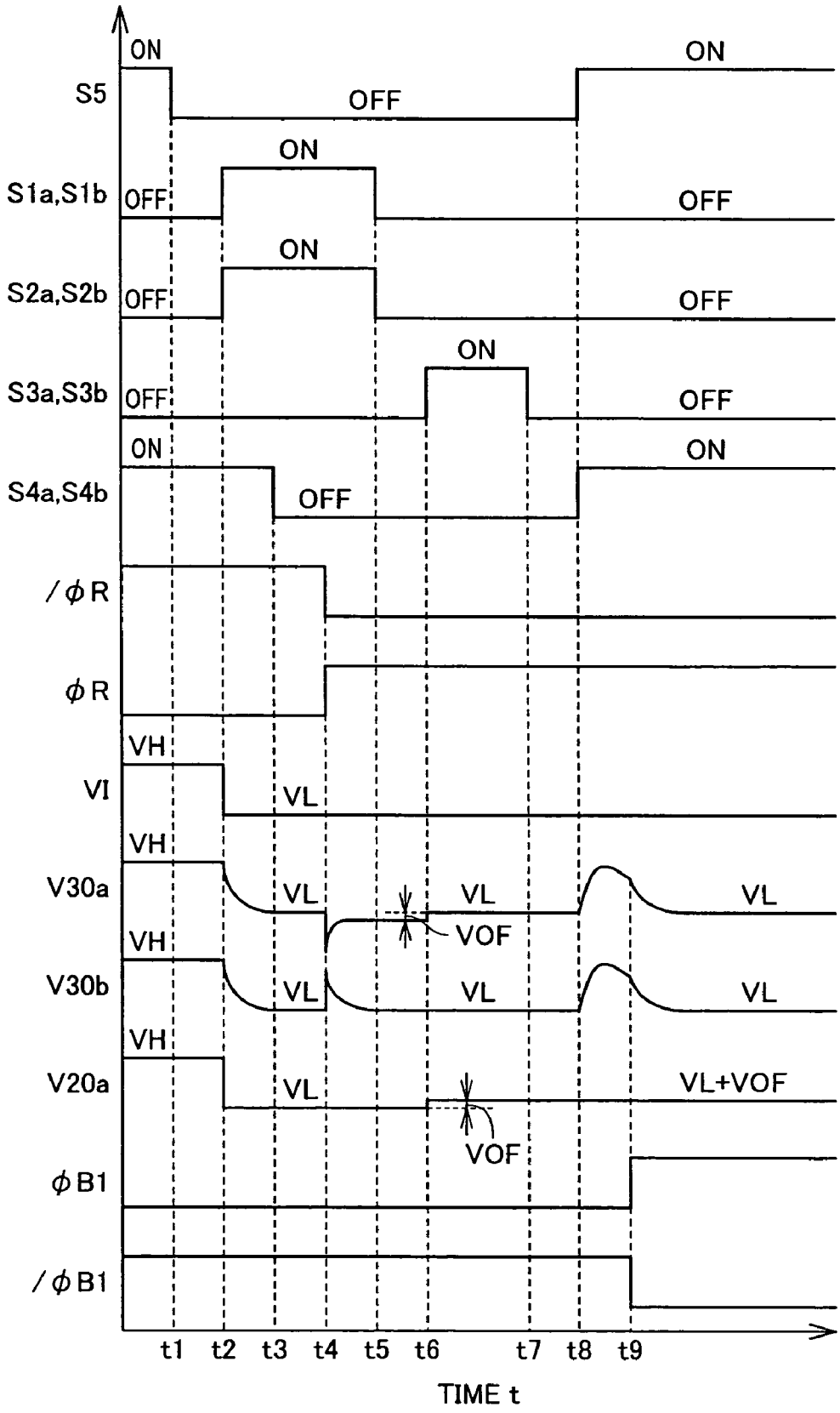
FIG. 54 is a time chart illustrating an operation of the drive circuit with the offset-compensating function shown in FIG. 53.

FIG. 54 is a time chart illustrating an operation of drive circuit 157 with the offset-compensating function shown in FIG. 53. It is now assumed that a threshold voltage VTN' of N-type transistor 31 is larger than threshold voltage VTN of N-type transistor 23 by VOF. In the initial state, switches S1*a*-S3*a* and S1*b*-S3*b* are off, switches S4*a*, S4*b* and S5 are off, and each of potentials V30*a*, V30*b* and V20*a* of nodes N30*a*, N30*b* and N20*a* is equal to the last input potential (VH in FIG. 54).

At time t1, switch S5 is turned off to isolate electrically the node between switches S30*a* and S30*b* from load capacitance 36. At time t2, switches S1*a*, S1*b*, S2*a* and S2*b* are turned on, and input potential VI is set to the present potential (VL in FIG. 54). As described above, all potentials V30*a*, V30*b* and V20*b* of nodes N30*a*, N30*b* and N20*b* become equal to VI=VL. Although threshold voltage VTN' of N-type transistor 31 is higher than threshold voltage VTN of the other N-type transistors by VOF, potentials V30*a* and V30*b* become equal to VI=VL. This is because the discharge circuit discharges nodes N30*a* and N30*b* until a state of VI=VL is achieved, but will no longer discharges them.

At time t3, switches S4*a* and S4*b* are turned off to isolate electrically the charging circuit and the discharging circuit. At time t4, reset signal /ϕR falls from the "H" level to the "L" level, and signal ϕR rises from the "L" level to the "H" level. Thereby, potential V30*a* of node N30*a* lowers from VL in a pulse-like fashion, and then becomes equal to (VL−VOF), and potential V30*b* of node N30*b* rises from VL in a pulse-like fashion, and then becomes equal to VL.

At time t5, switches S1*a*, S1*b*, S2*a* and S2*b* are turned off, and then switches S3*a* and S3*b* are turned off at time t6. Thereby, potential V20*a* of node N20*a* becomes equal to (VL+VOF) so that offset voltage VOF is canceled, and potential V30*a* of node N30*a* becomes equal to VI=VL.

At time t7, switches S3*a* and S3*b* are turned off, and the switches S4*a*, S4*b* and S5 are turned on at subsequent time t8. Thereby, potentials V30*a* and V30*b* of nodes N30*a* and N30*b* will gradually lower after temporary rising because load capacitance 36 has been charged to the last potential of VH. At time t9, signal ϕB1 rises from the "L" level to the "H" level, and signal /ϕB1 falls from the "H" level to the "L" level.

As described above, potential V22 of node N22 is raised through capacitor 76, and potential V27 of node N27 is lowered through capacitor 77. During this state, an operation of providing "L" level VL to output node N121 is performed, the on-resistance value of P-type transistor 35 is lower than the on-resistance value of N-type transistor 31 so that the level-lowering operation by V27 acts more strongly than the level-raising operation by V22. Therefore, potentials V30*a*, V30*b* and VO of nodes N30*a*, N30*b* and N121 rapidly lower and reach VL.

This eleventh embodiment can increase the operation speed.

Twelfth Embodiment

Figure 55:
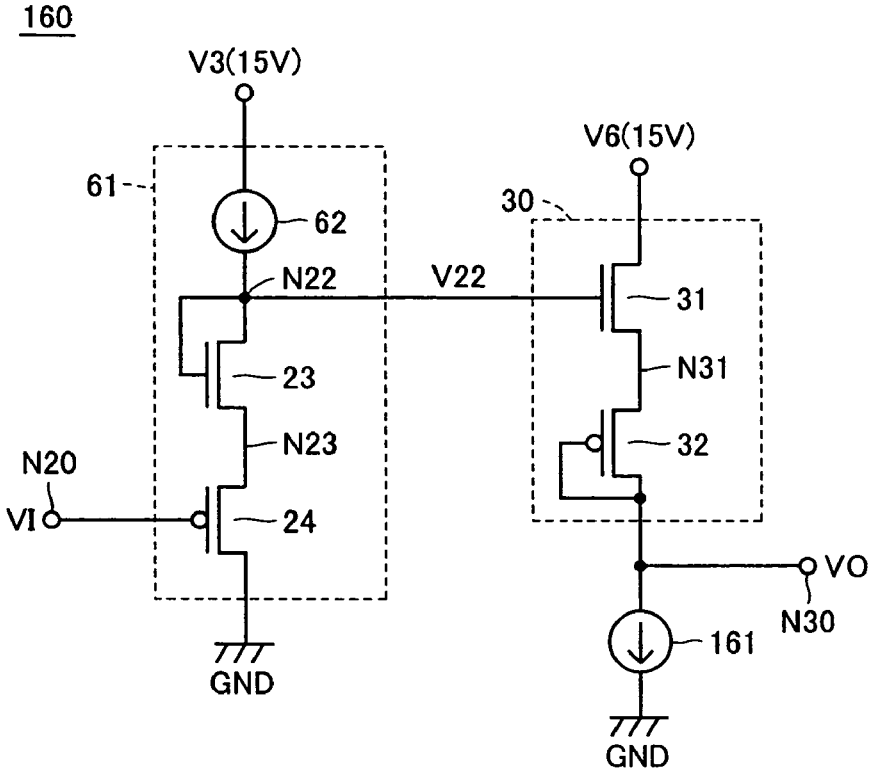
FIG. 55 is a circuit diagram showing a structure of a push-type drive circuit of a sample hold circuit according to a twelfth embodiment of the invention.

FIG. 55 is a circuit diagram showing a structure of a push-type drive circuit 160 of a sample hold circuit according to a twelfth embodiment of the invention. Referring to FIG. 55, push-type drive circuit 160 includes level shift circuit 61, pull-up circuit 30 and constant current supply 161. Level shift circuit 61 and pull-up circuit 30 are the same as those shown in FIG. 12.

Figure 56:
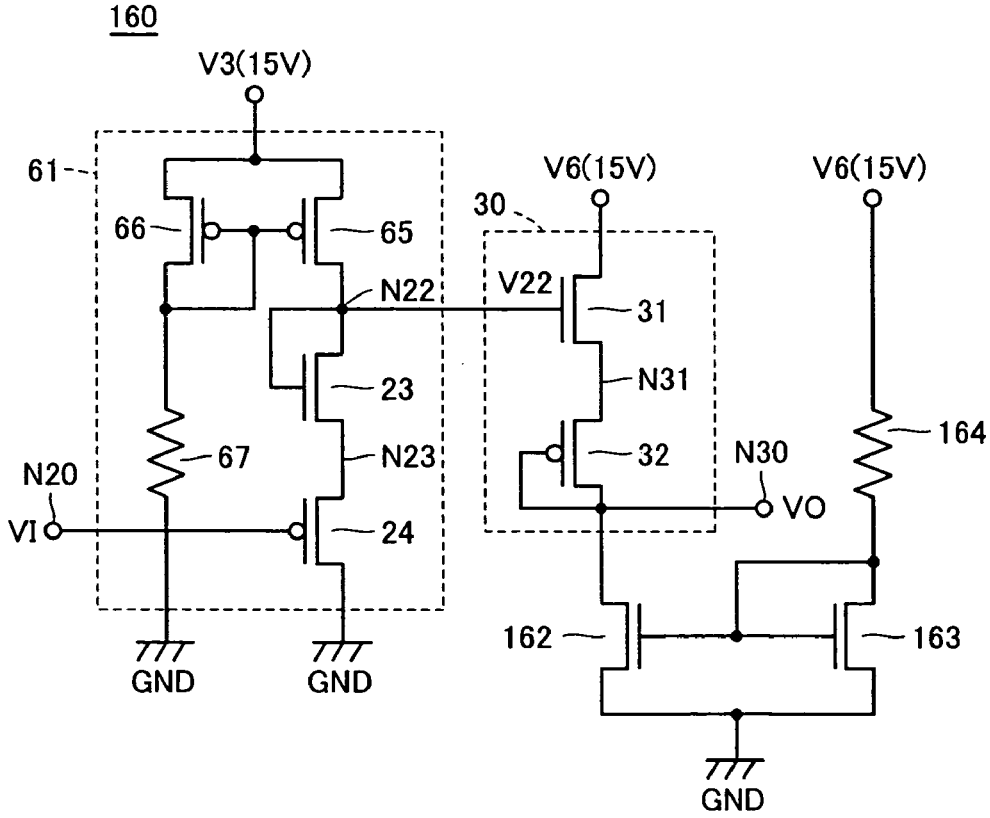
FIG. 56 is a circuit diagram showing more specifically a structure of the push-type drive circuit shown in FIG. 55.

More specifically, level shift circuit 61 includes constant current supply 62, N-type transistor 23 and P-type transistor 24, which are connected in series between the node of third power supply potential V3 of 15 V and the node of ground potential GND. As shown in FIG. 56, constant current supply 62 includes P-type transistors 65 and 66 as well as resistance element 67. P-type transistor 65 is connected between the node of third power supply potential V3 and the drain (node N22) of N-type transistor 23. P-type transistor 66 and resistance element 67 are connected in series between the node of third power supply potential V3 and the node of ground potential GND. Gates of P-type transistors 65 and 66 are both connected to the drain of P-type transistor 66. P-type transistors 65 and 66 form a current mirror circuit. P-type transistor 66 and resistance element 67 pass therethrough a constant current of a value corresponding to a resistance value of resistance element 67. P-type transistor 65 passes therethrough a constant current of a value corresponding to the value of the constant current flowing through P-type transistor 66. The gate of N-type transistor 23 is connected to its drain (node N22). N-type transistor 23 forms a diode element. The gate of P-type transistor 24 is connected to input node N20. Constant current supply 62 is configured to provide the current of a minimum value required for generating the threshold voltage in each of transistors 23 and 24.

Assuming that input node N20 has a potential (gradation potential) of VI, the P-type transistor has a threshold voltage of VTP and the N-type transistor has a threshold voltage of VTN, potential V23 of the source (node N23) of P-type transistor 24 and potential V22 of the drain (node N22) of N-type transistor 23 are equal to (VI+|VTP|) and (VI+|VTP|+VTN), respectively. Therefore, level shift circuit 61 provides potential V22 achieved by shifting the level of input potential VI by (|VTP|+VTN).

Pull-up circuit 30 includes N- and P-type transistors 31 and 32 connected in series between the node of sixth power supply potential V6 of 15 V and output node N30. The gate of N-type transistor 31 receives output potential V22 of level shift circuit 61. The gate of P-type transistor 32 is connected to its drain. P-type transistor 32 forms a diode element. Since sixth power supply potential V6 is set to operate N-type transistor 31 in a saturation region, N-type transistor 31 performs a so-called source-follower operation.

Constant current supply 161 is connected between output node N30 and the node of ground potential GND. Constant current supply 161 includes N-type transistors 162 and 163 as well as resistance element 164 as shown in FIG. 56. N-type transistor 162 is connected between output node N30 and the node of ground potential GND, and resistance element 164 and N-type transistor 163 are connected in series between the node of sixth power supply potential V6 and the node of ground potential GND. The gates of N-type transistors 162 and 163 are both connected to the drain of N-type transistor 163. N-type transistors 162 and 163 form a current mirror circuit. Resistance element 164 and N-type transistor 163 pass a constant current of a value corresponding to the resistance value of resistance element 164, and N-type transistor 162 pass a constant current of a value corresponding to the value of the constant current flowing through N-type transistor 163. Constant current supply 161 is configured to provide the current of a minimum value required for generating the threshold voltage in each of transistors 31 and 32.

Potential V31 of the source (node N31) of N-type transistor 31 becomes equal to (V22−VTN=VI+|VTP|), and potential VO of output node N30 becomes equal to (V31−|VTP|).

In this twelfth embodiment, since it is merely required to flow a through-current of the minimum value required for generating the threshold voltage of each of transistors 23, 24, 31 and 32, the current consumption can be small.

Figure 57:
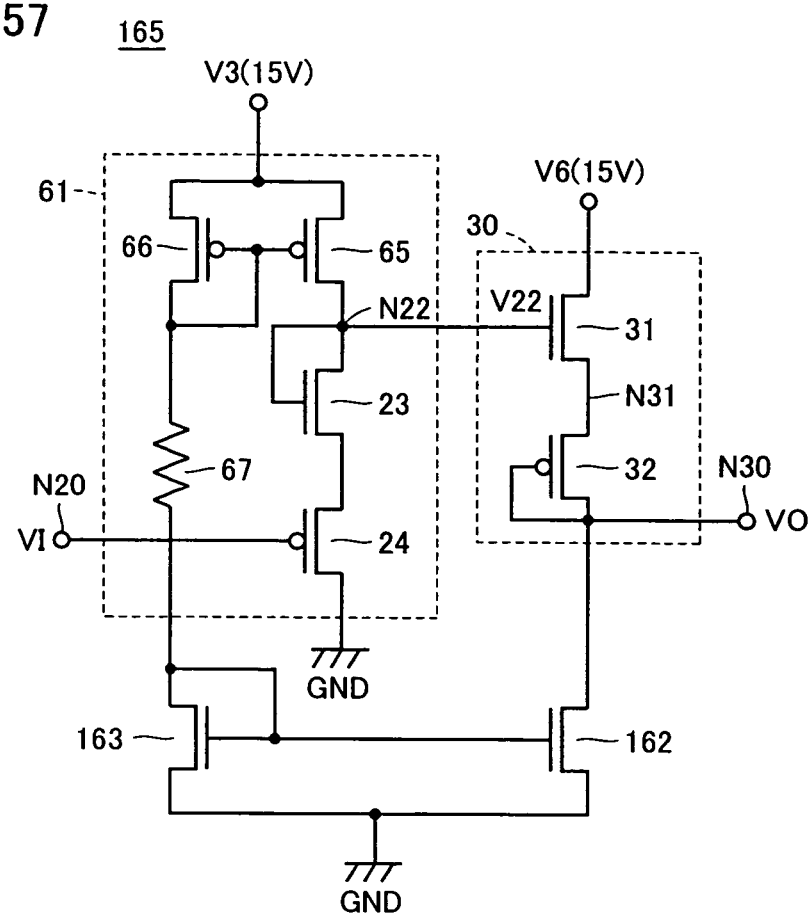
FIG. 57 is a circuit diagram showing a modification of the twelfth embodiment.

FIG. 57 is a circuit diagram showing a structure of a push-type drive circuit 165 according to a modification of the twelfth embodiment. Referring to FIG. 57, drive circuit 165 differs from drive circuit 160 shown in FIG. 56 in that resistance element 164 is eliminated, and resistance element 67 is shared by two constant current supplies 62 and 161. Resistance element 67 and N-type transistor 163 are connected in series between the source of P-type transistor 66 and the node of ground potential GND. The gate of N-type transistor 163 is connected to its drain. This modification can prevent generation of an offset voltage due to variations in resistance values of resistance elements 67 and 164.

Figure 58:
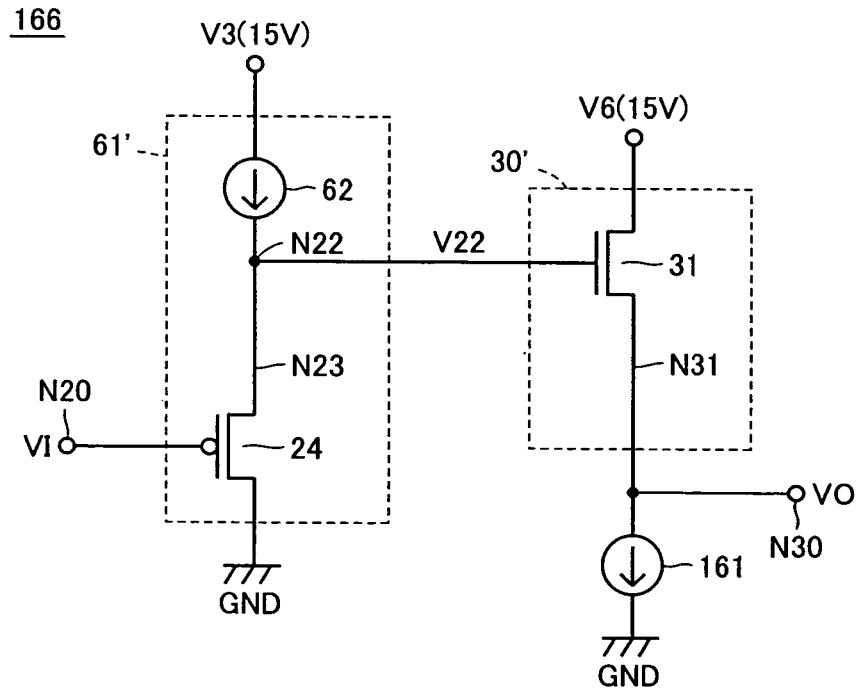
FIG. 58 is a circuit diagram showing another modification of the twelfth embodiment.

A push-type drive circuit 166 in FIG. 58 is substantially the same as push-type drive circuit 160 shown in FIG. 55 in that diode-connected transistors 23 and 32 are eliminated. Output potential VO is equal to (VI+|VTP|−VTN). However, |VTP| may be set nearly equal to VTN (|VTP|≈VTN), whereby VO becomes nearly equal to VI. Alternatively, consideration may be given to use the value of (|VTP|−VTN) as an offset value, whereby drive circuit 166 can be used similarly to drive circuit 160 in FIG. 55. In this modification, since transistors 23 and 32 are eliminated, an area occupied by the circuit can be small.

Each of constant current supplies 62 and 161 may be replaced with a resistance element, in which case the circuit structure can be simple.

Thirteenth embodiment

Figure 59:
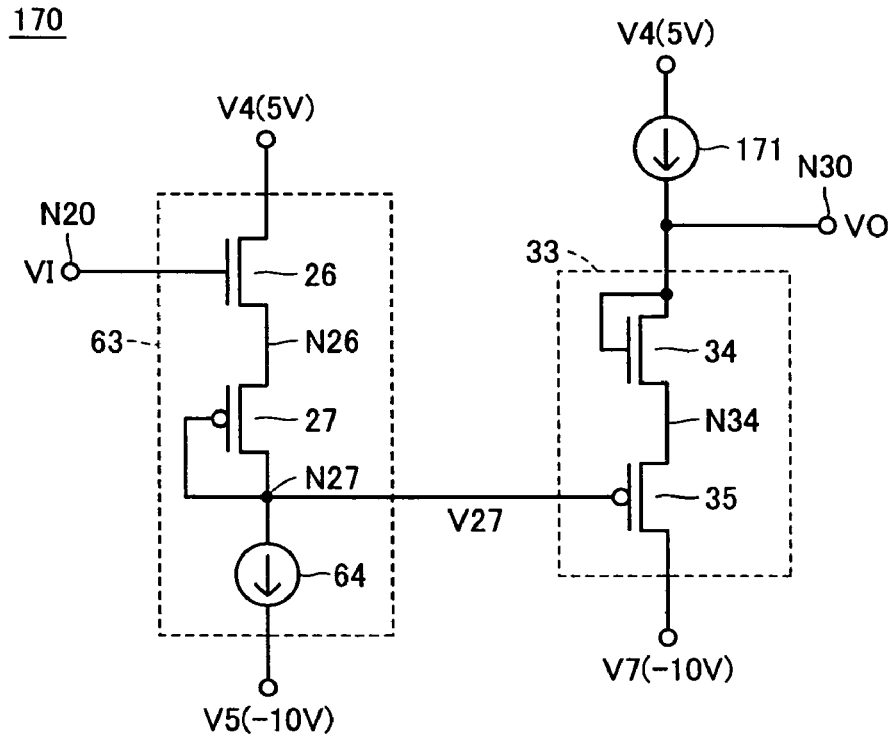
FIG. 59 is a circuit diagram showing a structure of a pull-type drive circuit of a sample hold circuit according to a thirteenth embodiment of the invention.

FIG. 59 is a circuit diagram showing a structure of a pull-type drive circuit 170 according to a thirteenth embodiment of the invention. In FIG. 59, drive circuit 170 includes level shift circuit 63, constant current supply 171 and pull-down circuit 33, Level shift circuit 63 and pull-down circuit 33 are the same as those shown in FIG. 12.

More specifically, level shift circuit 63 includes N-type transistor 26, P-type transistor 27 and constant current supply 64 connected in series between the node of fourth power supply potential V4 of 5 V and the node of fifth power supply potential V5 of −10 V. The gate of N-type transistor 26 receives potential VI of input node N20. The gate of P-type transistor 27 is connected to its drain (node N27). P-type transistor 27 forms a diode element. Constant current supply 64 is configured to provide the current of a minimum value required for generating the threshold voltage in each of transistors 26 and 27.

Potential V26 of the source (node N26) of N-type transistor 26 becomes equal to (VI−VTN). Potential V27 of the drain (node N27) of P-type transistor 27 becomes equal to (VI−VTN−|VTP|). Therefore, level shift circuit 63 provides potential V27 achieved by shifting the level of input potential VI by (−VTN−|VTP|).

Constant current supply 171 is connected between the node of fourth power supply potential V4 and output node N30. Pull-down circuit 33 includes P- and N-type transistors 35 and 34 connected in series between a node of seventh power supply potential V7 of −10V and output node N30. The gate of P-type transistor 35 receives output potential V27 of level shift circuit 63. The gate of N-type transistor 34 is connected to its drain. N-type transistor 34 forms a diode element. Since seventh power supply potential V7 is set to operate P-type transistor 35 in a saturation region, P-type transistor 35 performs a so-called source-follower operation. Constant current supply 171 is configured to provide the current of a minimum value required for generating the threshold voltage in each of transistors 34 and 35.

Potential V34 of source (node N34) of P-type transistor 35 is equal to (V27+|VTP|=VI−VTN). Potential VO of output node N30 is equal to (V34+VTN=VI).

In this thirteenth embodiment, since it is merely required to flow a through-current of the minimum value required for generating the threshold voltage of each of transistors 26, 27, 34 and 35, the current consumption can be small.

Figure 60:
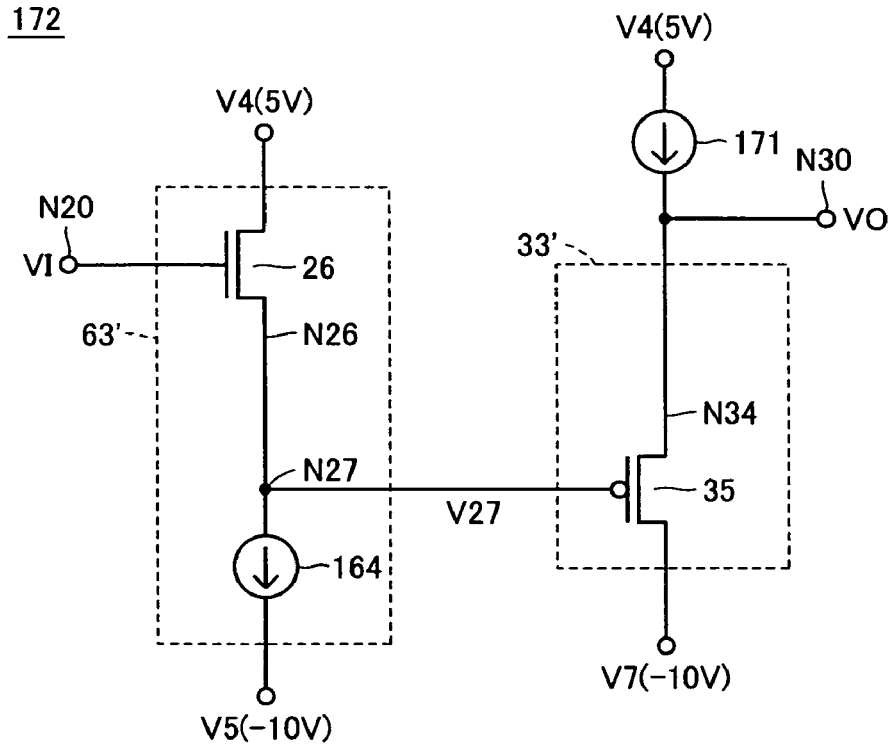
FIG. 60 is a circuit diagram showing a modification of the thirteenth embodiment.

FIG. 60 is a circuit diagram showing a structure of a pull-type drive circuit 172 according to a modification of the thirteenth embodiment. Referring to FIG. 60, pull-type drive circuit 172 is the same as pull-type drive circuit 170 shown in FIG. 59 except for that diode-connected transistors 27 and 34 are eliminated. Output potential VO becomes equal to (VI+|VTP|−VTN). However, |VTP| may be set nearly equal to VTN (|VTP|≈VTN), whereby VO becomes nearly equal to VI. Alternatively, consideration may be given to use a value of (|VTP|−VTN) as an offset value, whereby drive circuit 172 can be used similarly to drive circuit 170 in FIG. 59. In this modification, since transistors 27 and 34 are eliminated, an area occupied by the circuit can be small.

Each of constant current supplies 164 and 171 may be replaced with a resistance element, in which case the circuit structure can be simple.

Fourteenth Embodiment

Figure 61:
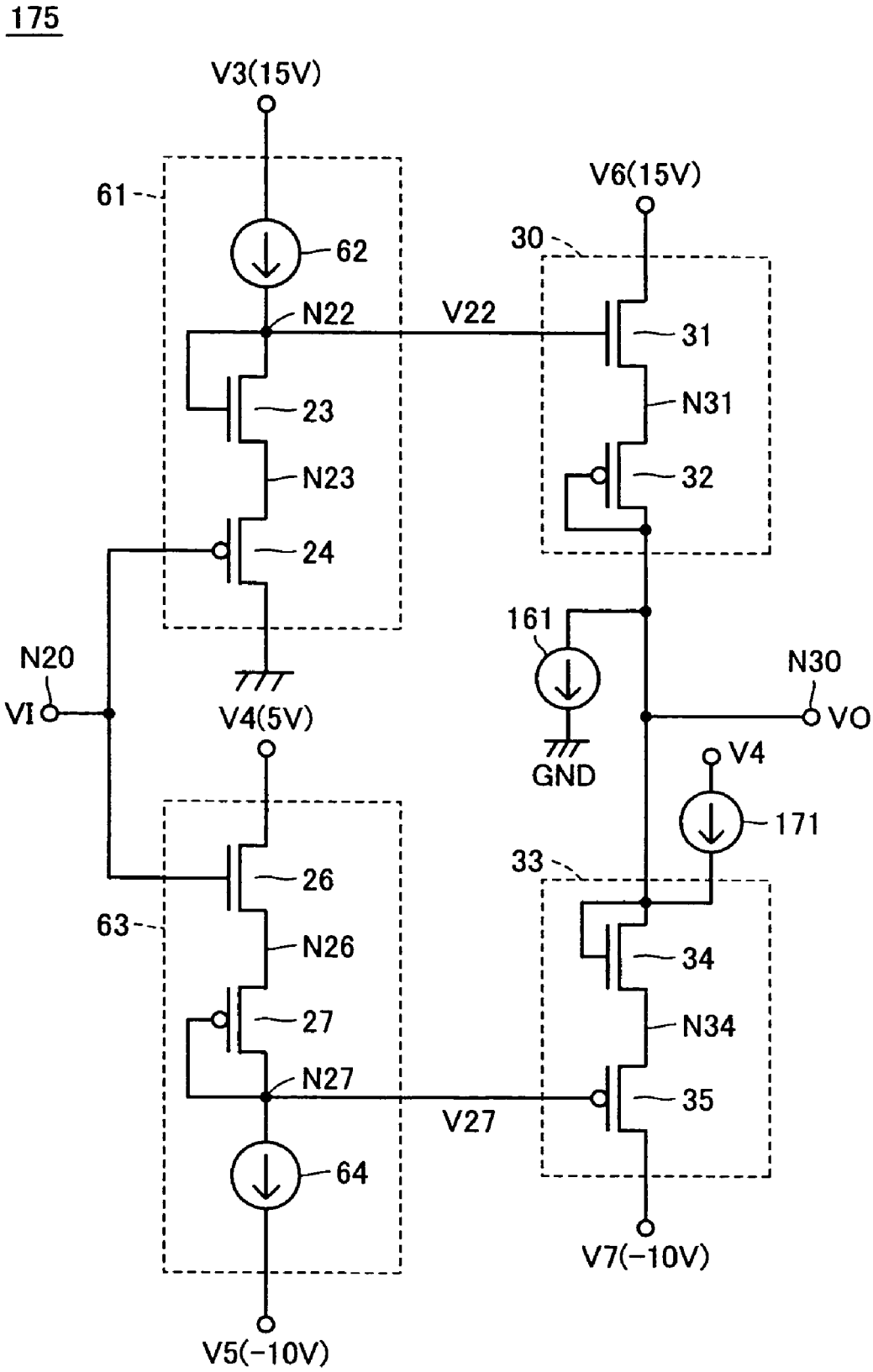
FIG. 61 is a circuit diagram showing a structure of a drive circuit of a sample hold circuit according to a fourteenth embodiment of the invention.

FIG. 61 is a circuit diagram showing a structure of a drive circuit 175 according to a fourteenth embodiment of the invention. In FIG. 61, drive circuit 175 is a combination of push-type drive circuit 160 in FIG. 55 and pull-type drive circuit 170 in FIG. 59. The gate of P-type transistor 24 of level shift circuit 61 and the gate of N-type transistor 26 of level shift circuit 63 receive potential VI of input node N20. The drain of P-type transistor 32 of pull-up circuit 30 and the drain of N-type transistor 34 of pull-down circuit 33 are both connected to output node N30.

When output potential VO is higher than input potential VI, transistors 31 and 32 of pull-up circuit 30 are turned off, and transistors 34 and 35 of pull-down circuit 33 are turned on so that output potential VO lowers. When output potential VO is lower than input potential VI, transistors 34 and 35 of pull-down circuit 33 are turned off and transistors 31 and 32 of pull-up circuit 30 are turned on so that output potential VO rises. Therefore, VO becomes equal to VI.

Drive circuit 175 is used as a push-type drive circuit, a pull-type drive circuit or a push-pull-type drive circuit. When drive circuit 175 is used as a push-type drive circuit, current drive capabilities of transistors 34 and 35 of pull-down circuit 33 are set to a level sufficiently smaller than that of the current drive capabilities of transistors 31 and 32 of pull-up circuit 30. When drive circuit 175 is used as a pull-type drive circuit, current drive capabilities of transistors 31 and 32 of pull-up circuit 30 are set to a level sufficiently smaller than that of the current drive capabilities of transistors 34 and 35 of pull-down circuit 33. When drive circuit 175 is used as a push-pull-type drive circuit, current drive capabilities of transistors 31 and 32 of pull-up circuit 30 are set to the same level as the current drive capabilities of transistors 34 and 35 of pull-down circuit 33.

This fourteenth embodiment can likewise provide drive circuit 175 of a small through-current, and can reduce power consumption.

Figure 62:
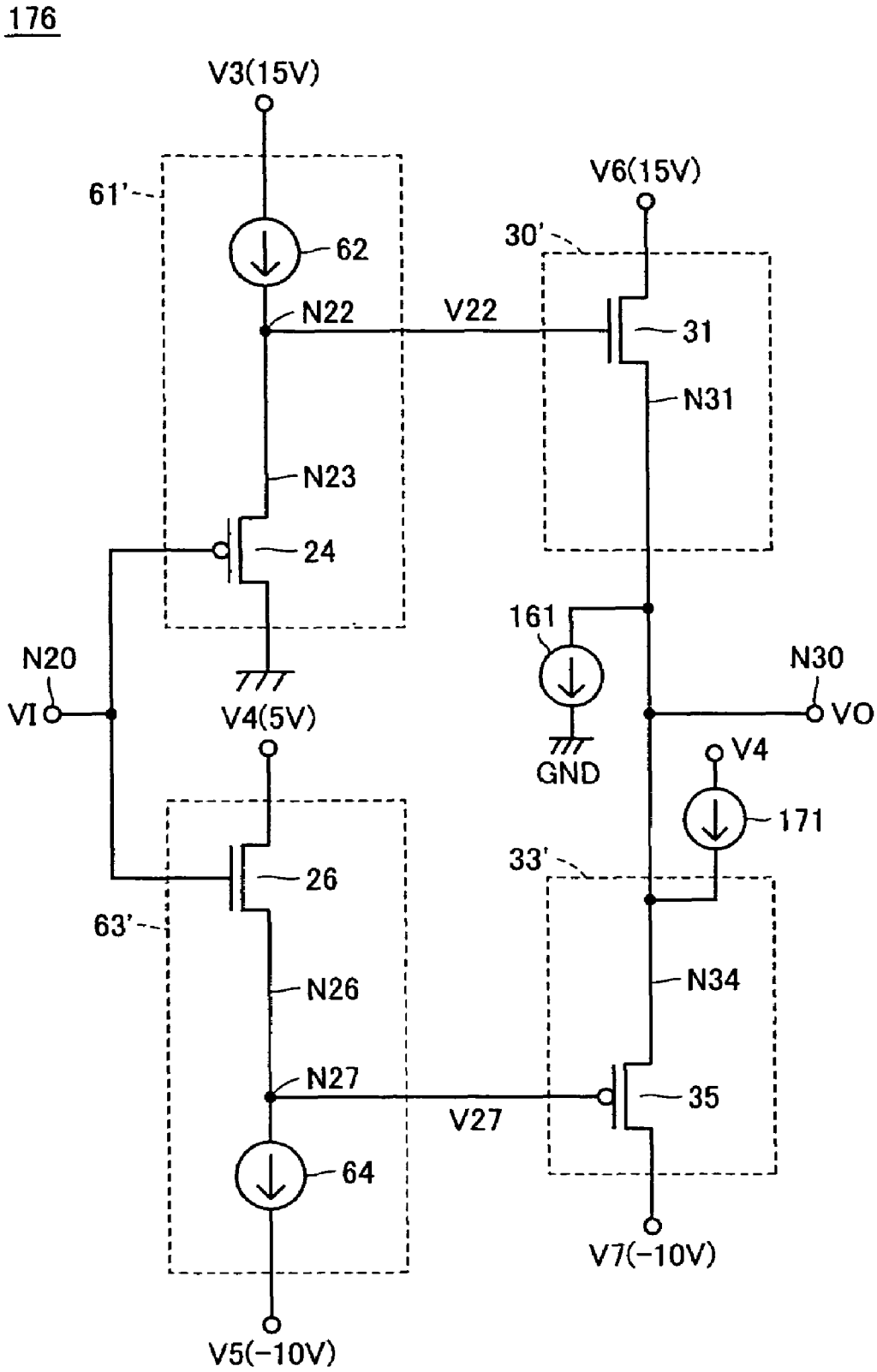
FIG. 62 is a circuit diagram showing a modification of the fourteenth embodiment.

FIG. 62 is a circuit diagram showing a structure of a drive circuit 176 according to a modification of the fourteenth embodiment. Referring to FIG. 62, drive circuit 176 is substantially the same as drive circuit 170 shown in FIG. 61 in that diode-connected transistors 23, 27, 32 and 34 are eliminated. Output potential VO is equal to (VI+|VTP|−VTN). However, |VTP| may be set nearly equal to VTN (|VTP|≈VTN), whereby VO becomes nearly equal to VI. Alternatively, consideration may be given to use a value of (|VTP|−VTN) as an offset value, whereby drive circuit 176 can be used similarly to drive circuit 175 in FIG. 61. In this modification, since transistors 23, 27, 32 and 34 are eliminated, an area occupied by the circuit can be small.

Figure 63:
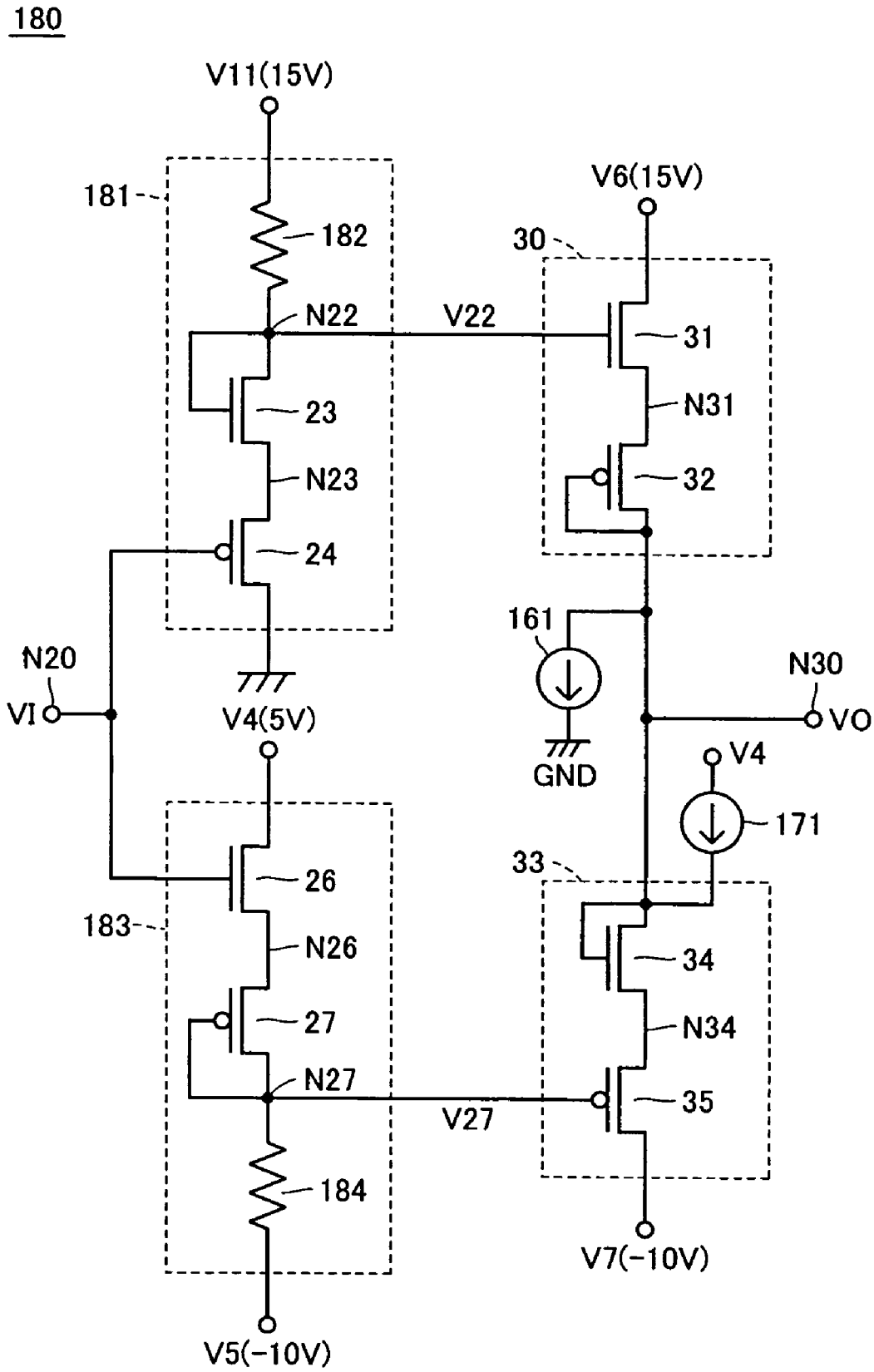
FIG. 63 is a circuit diagram showing another modification of the fourteenth embodiment.

FIG. 63 is a circuit diagram showing a structure of a drive circuit 180 according to another modification of the fourteenth embodiment. In FIG. 63, a drive circuit 180 is substantially the same as drive circuit 175 shown in FIG. 61 except for that level shift circuits 61 and 63 of drive circuit 175 in FIG. 61 are replaced with level shift circuits 181 and 183, respectively. Level shift circuit 181 is substantially the same as level shift circuit 61 except for that constant current supply 62 is replaced with a resistance element 182. Level shift circuit 183 is substantially the same as level shift circuit 63 except for that constant current supply 64 is replaced with a resistance element 184. Resistance elements 182 and 184 have resistance values, which are set to pass currents nearly equal to those supplied by constant current supplies 62 and 64, respectively. This modification can achieve the same effect as drive circuit 175 in FIG. 61.

Figure 64:
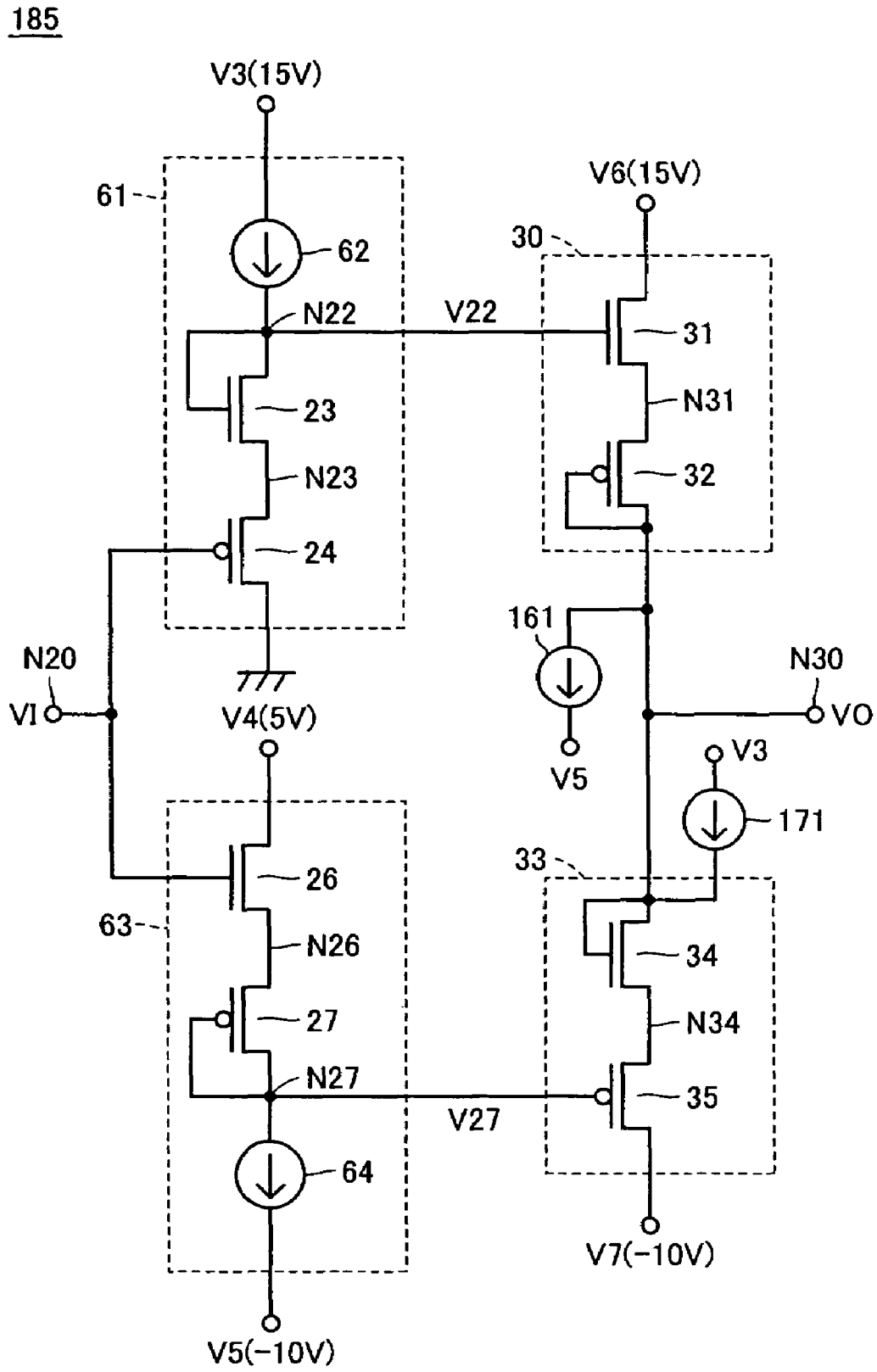
FIG. 64 is a circuit diagram showing still another modification of the fourteenth embodiment.
Figure 65:
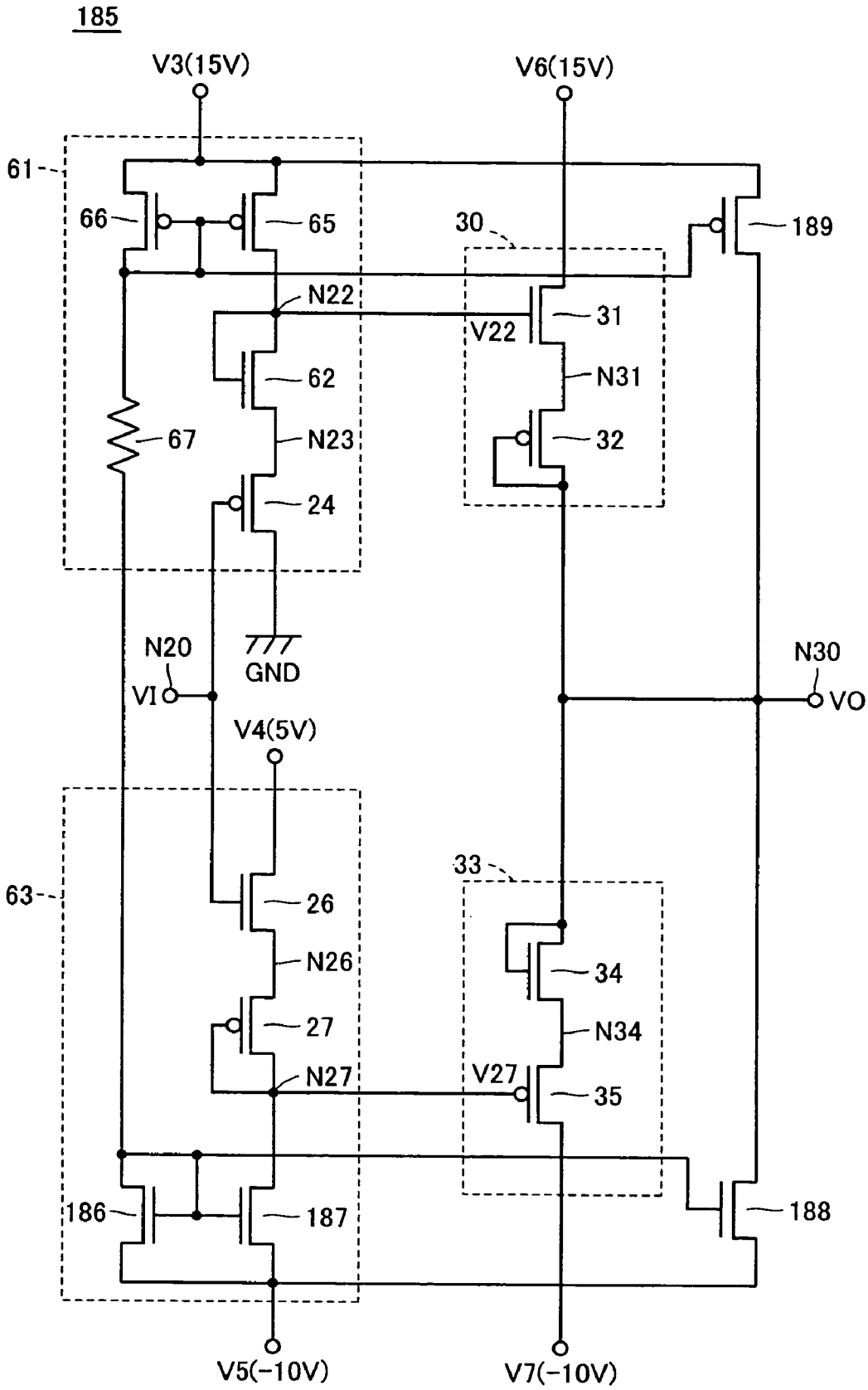
FIG. 65 is a circuit diagram showing more specifically a structure of a drive circuit shown in FIG. 64.

FIG. 64 is a circuit diagram showing a structure of a drive circuit 185 of still another modification of the fourteenth embodiment. Referring to FIG. 64, drive circuit 185 differs from drive circuit 175 shown in FIG. 61 in that constant current supply 161 is connected between output node N30 and the node of fifth power supply potential V5, and constant current supply 171 is connected between the node of third power supply potential V3 and output node N30.

Constant current supplies 62, 64, 161 and 171 are formed of resistance element 67, P-type transistors 65, 66 and 189, and N-type transistors 186-188. P-type transistor 66, resistance element 67 and N-type transistor 186 are connected in series between the node of third power supply potential V3 and the node of fifth power supply potential V5. The gate of P-type transistor 66 is connected to its drain. The gate of N-type transistor 186 is connected to its drain. Each of transistors 66 and 186 form a diode element.

P-type transistor 65 is connected between the node of third power supply potential V3 and node N22, and the gate thereof is connected to the gate of P-type transistor 66. P-type transistor 189 is connected between the node of third power supply potential V3 and output node N30, and the gate thereof is connected to the gate of P-type transistor 66. P-type transistors 66, 65 and 189 form a current mirror circuit. Each of P-type transistors 65 and 189 passes a current of a value corresponding to a current flowing through P-type transistor 66. P-type transistors 65 and 189 form constant current supplies 62 and 171, respectively.

N-type transistor 187 is connected between the node of fifth power supply potential V5 and node N27, and the gate thereof is connected to the gate of N-type transistor 186. N-type transistor 188 is connected between the node of fifth power supply potential V5 and output node N30, and the gate thereof is connected to the gate of N-type transistor 186. N-type transistors 186-188 form a current mirror circuit. Each of N-type transistors 187 and 188 passes a current corresponding to the current flowing through N-type transistor 186. N-type transistors 187 and 188 form constant current supplies 64 and 161, respectively. Structures and operations other than the above are the same as those of drive circuit 175 in FIG. 61, and therefore, description thereof is not repeated. This modification can achieve the same effect as drive circuit 175 in FIG. 61.

Fifteenth Embodiment

Figure 66:
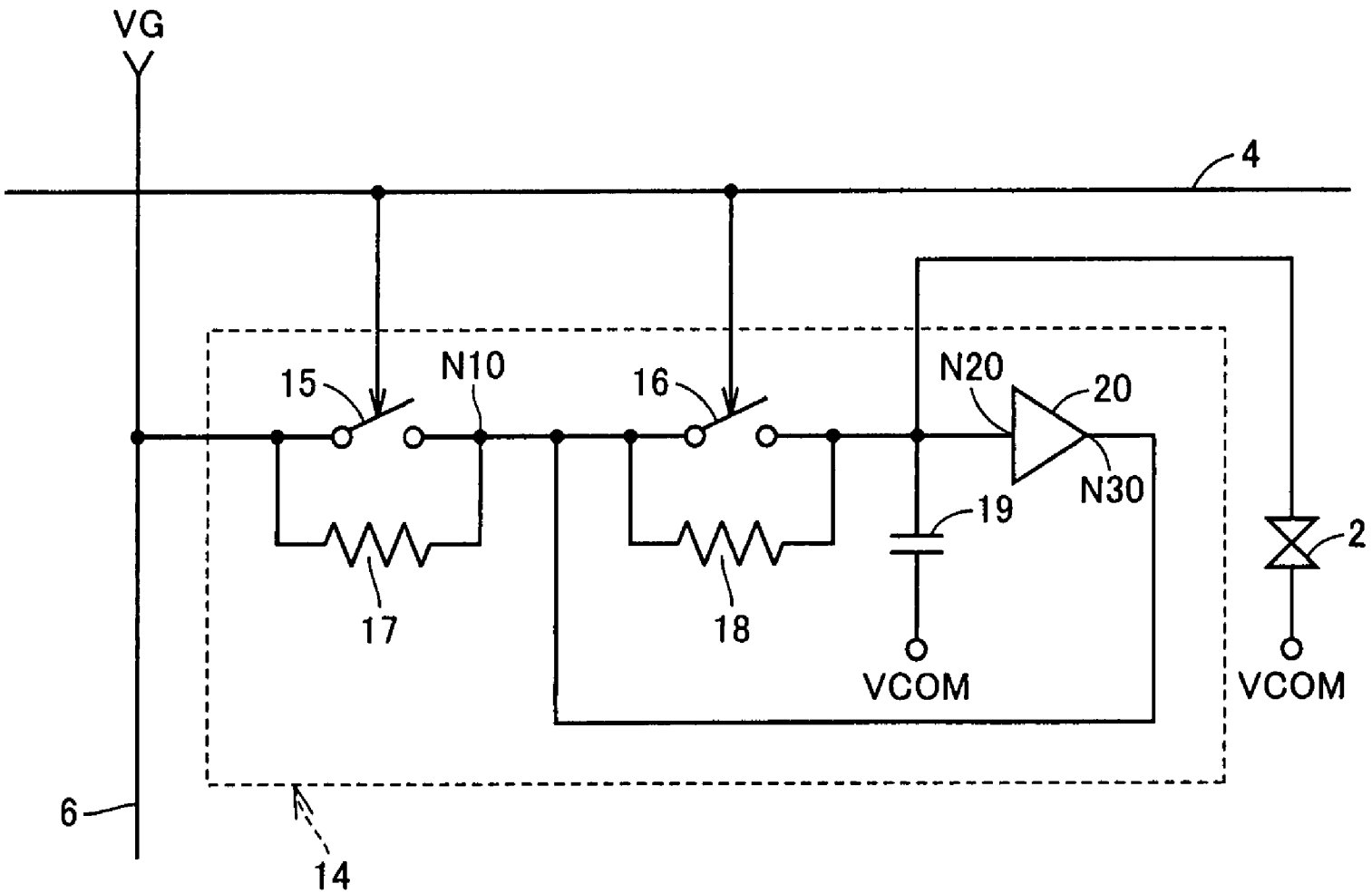
FIG. 66 is a circuit diagram showing a major portion of a color liquid crystal display device according to a fifteenth embodiment of the invention.

FIG. 66 is a circuit diagram showing a major portion of a color liquid crystal display device according to a fifteenth embodiment of the invention, and corresponds to FIG. 3. Referring to FIG. 66, this color liquid crystal display device differs from the color liquid crystal display device of the first embodiment in that one of the electrodes of liquid crystal cell 2 is connected to input node N20 instead of output node N30.

When a large potential difference is present between nodes N30 and N20, a leak current flows between nodes N30 and N20 through a parasitic resistance (resistance element 18) of switch 16 so that the potential of node N20 changes. However, if the potential difference between nodes N30 and N20 is similar to a usual offset voltage of drive circuit 20, the leak current between nodes N30 and N20 is small and substantially ignorable so that the potential of node N20 does not change. Therefore, a gradation potential VT of data line 6 is accurately applied to one of the electrodes of liquid crystal cell 2, and accurate light transmissivity can be achieved.

Drive circuit 20 may be replaced with one of the other drive circuits in the first to fourteenth embodiments, in which case the same effect can be naturally achieved. The drive circuit may have a simple structure not having the offset-compensating function.

Sixteenth Embodiment

Figure 67:
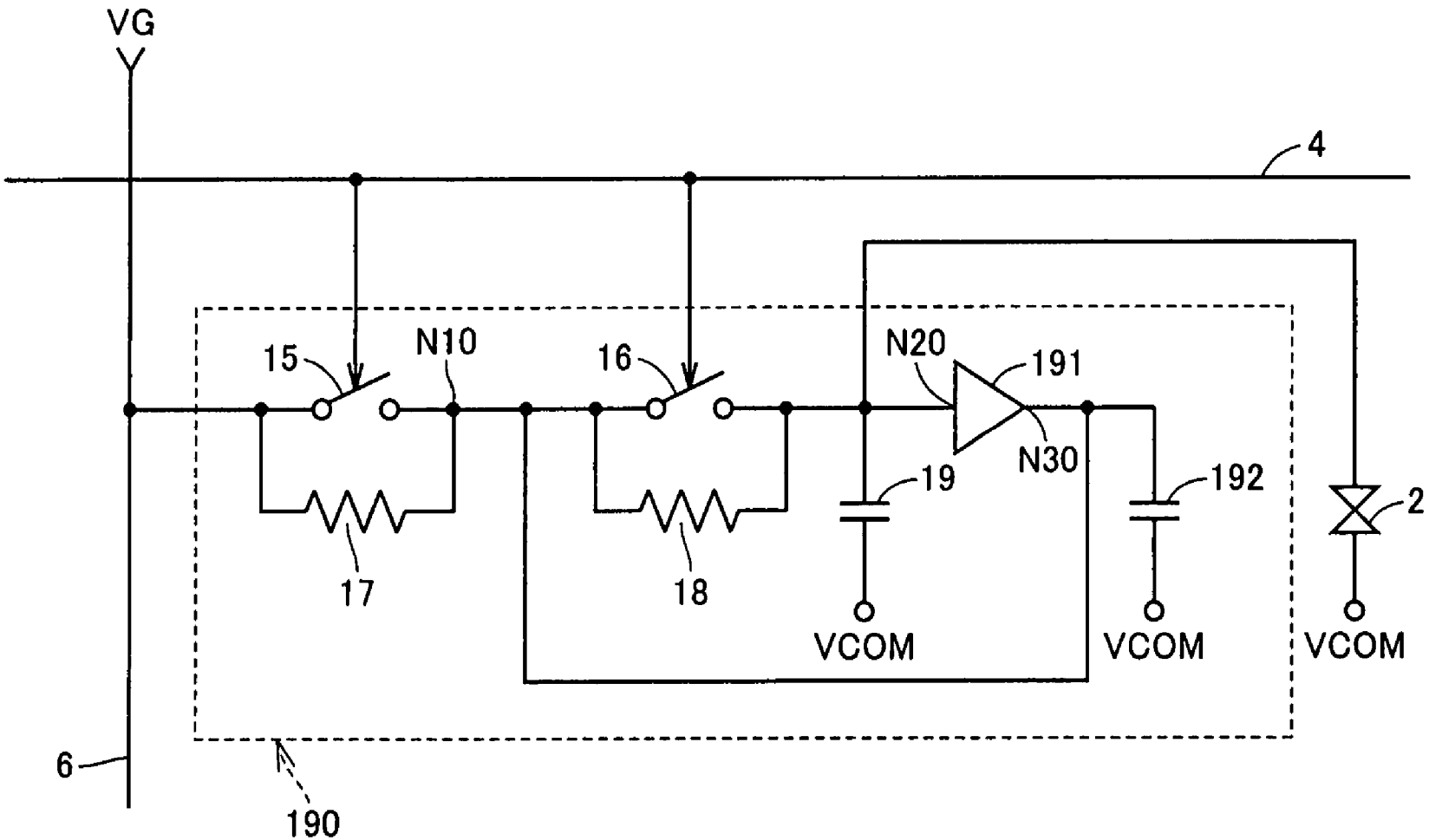
FIG. 67 is a circuit diagram showing a major portion of a color liquid crystal display device according to a sixteenth embodiment of the invention.

FIG. 67 is a circuit diagram showing a major portion of a color liquid crystal display device according to a sixteenth embodiment of the invention, and corresponds to FIG. 66. Referring to FIG. 67, the color liquid crystal display device differs from the color liquid crystal display device of the fifteenth embodiment in that sample hold circuit 14 is replaced with a sample hold circuit 190.

Figure 68:
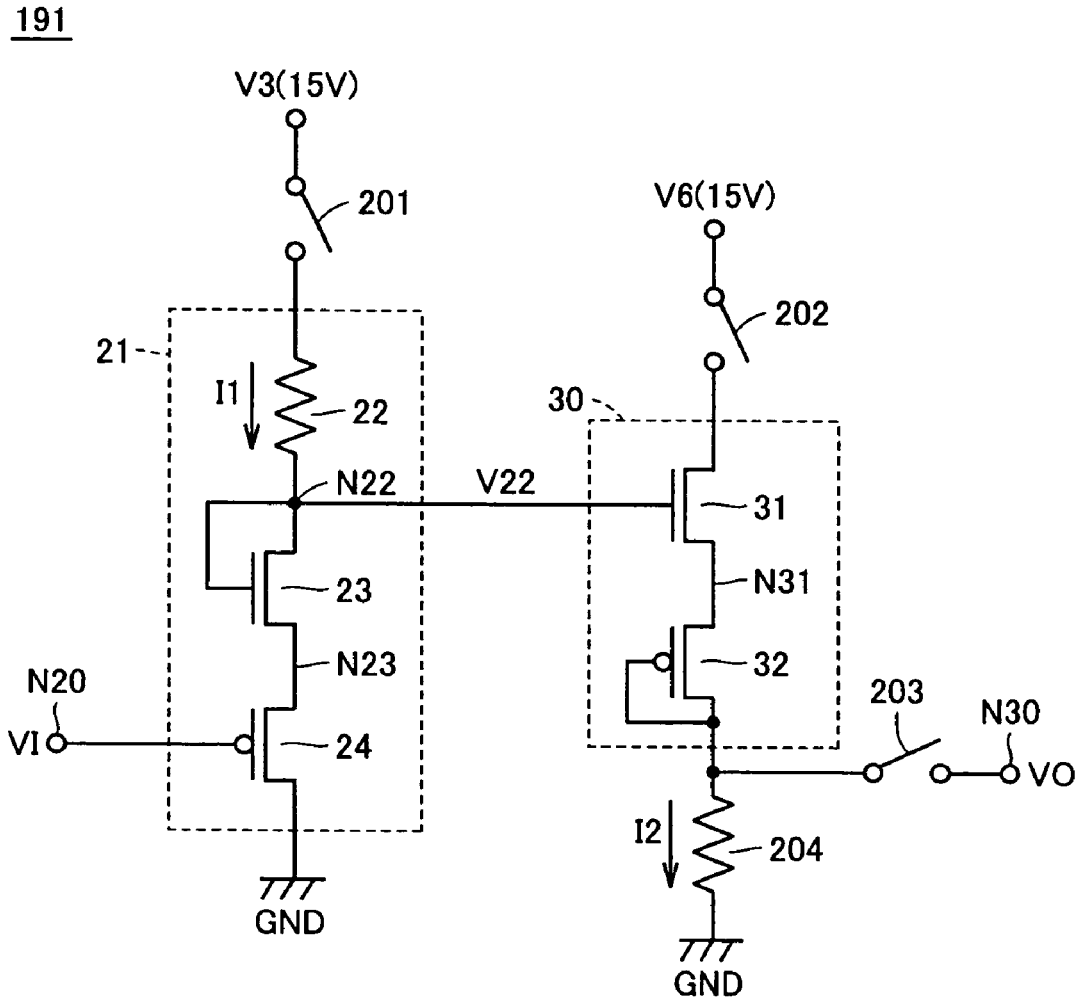
FIG. 68 is a circuit diagram showing a structure of a drive circuit shown in FIG. 67.

Sample hold circuit 190 is substantially the same as sample hold circuit 14 except for that drive circuit 20 is replaced with a push-type drive circuit 191, and a capacitor 192 is additionally employed. One of the electrodes of capacitor 192 is connected to output node N30 of push-type drive circuit 191, and the other electrode thereof receives common potential VCOM. Push-type drive circuit 191 includes, as shown in FIG. 68, level shift circuit 21, pull-up circuit 30, switches 201-203 and a resistance element 204. Structures and operations of level shift circuit 21 and pull-up circuit 30 other than the above are the same as those already described with reference to FIGS. 4 and 5.

One of the electrodes of switch 201 receive third power supply potential V3, and the other electrode is connected to node N22 through resistance element 22. One of the electrodes of switch 202 receives sixth power supply potential V6, and the other electrode is connected to the drain of N-type transistor 31. Switch 203 is connected between the drain of P-type transistor 32 and output node N30. Resistance element 204 is connected between the drain of P-type transistor 32 and the line of ground potential GND.

Figure 69:
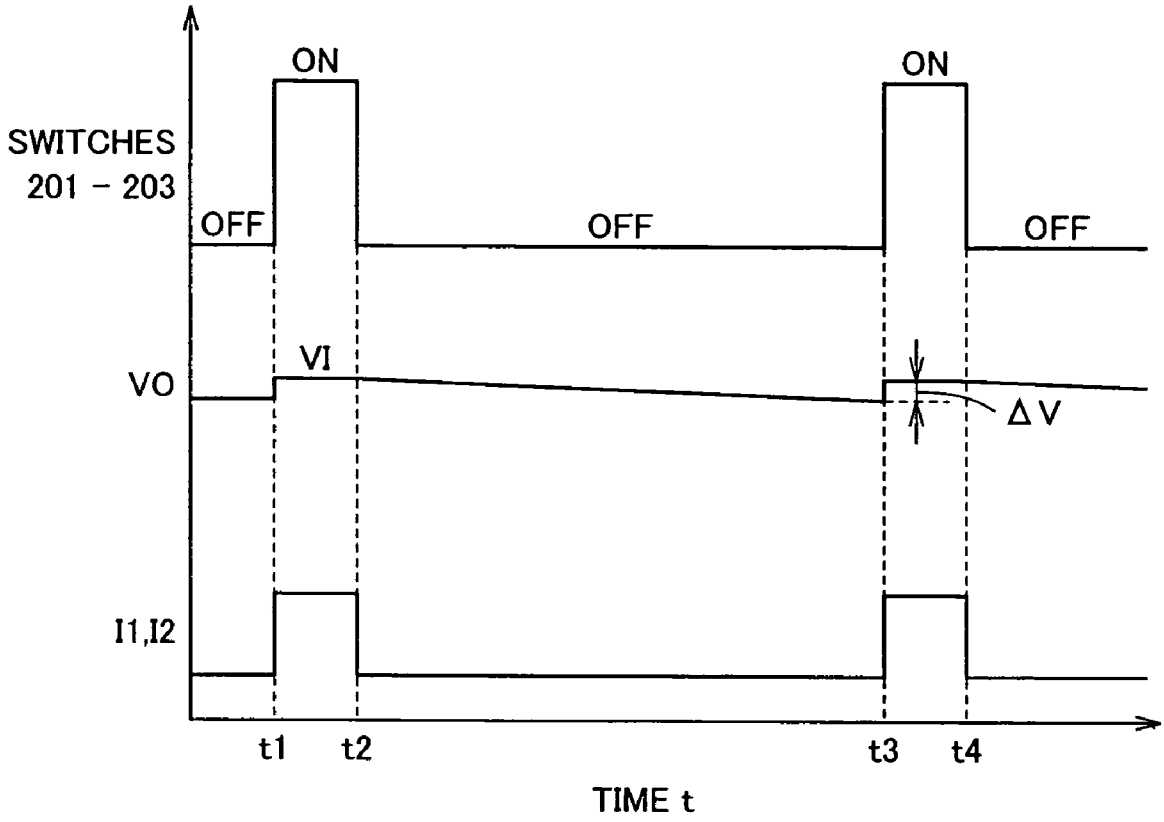
FIG. 69 is a time chart illustrating an operation of the drive circuit shown in FIG. 68.

FIG. 69 is a time chart showing an operation of push-type drive circuit 191. Switches 201-203 are turned on at predetermined intervals of (t3-t1) and, each time, are kept on for a predetermined time of (t2-t1). When switches 201-203 are turned on, currents I1 and I2 flow through resistance elements 22 and 204, respectively, so that capacitor 192 is charged to provide VO equal to VI. When switches 201-203 are off, the charges leak from capacitor 192 to, e.g., the data line so that potential VO gradually lowers. A ratio between the on-time and the off-time of switches 201 and 203 is set such that an amount ΔV of this lowering of potential VO may fall in an allowed range.

This sixteenth embodiment can achieve the same effect as the fifteenth embodiment. Further, the sixteenth embodiment can reduce the current consumption because the power supply of drive circuit 191 is intermittently turned on/off.

Switch 201 may be located in any position provided that it is connected in series to resistance element 22, N-type transistor 23 and P-type transistor 24. For example, the positions of switch 201 and resistance element 22 may be inverted. Also, switch 202 may be located in any position provided that it is connected in series to N-type transistor 31, P-type transistor 32 and resistance element 204.

Various embodiments of the sixteenth embodiment will now be described. A pull-type drive circuit 205 in FIG. 70 includes a level shift circuit 25, a pull-down circuit 33, switches 206-208 and a resistance element 209. The structures and operations of level shift circuit 25 and pull-down circuit 33 are the same as those already described with reference to FIGS. 4 and 5. One of the electrodes of switch 206 receives fifth power supply potential V5, and the other electrode is connected to node N27 through resistance element 28. One of electrodes of switch 207 receives seventh power supply potential V7, and the other electrode is connected to the drain of P-type transistor 35. Switch 208 is connected between the drain of N-type transistor 34 and output node N30. Resistance element 209 is connected between the drain of N-type transistor 34 and the line of fourth power supply potential V4. Switches 206-208 are turned on/off similarly to switches 201-203 shown in FIGS. 68 and 69. This modification can likewise reduce the power consumption.

Figure 70:
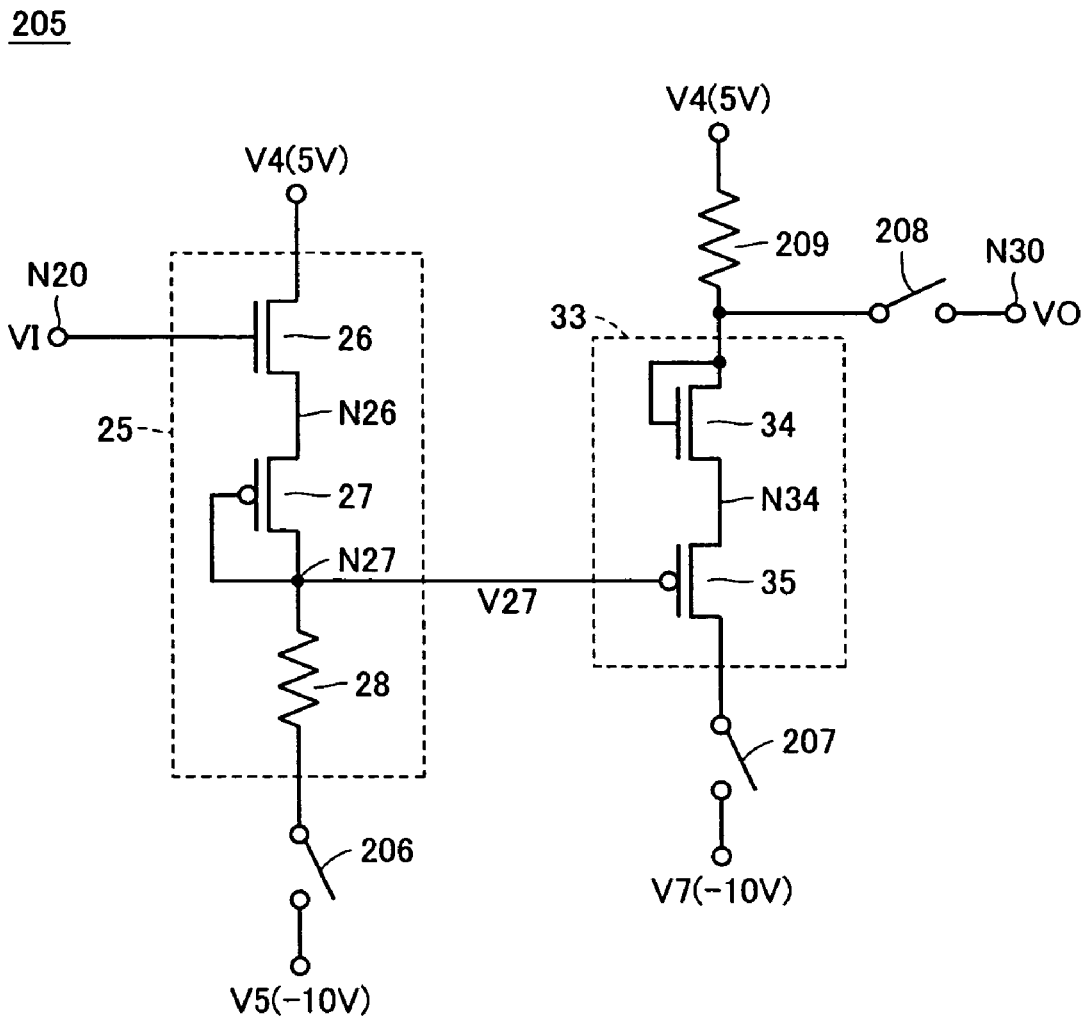
FIG. 70 is a circuit diagram showing a modification of the sixteenth embodiment.
Figure 71:
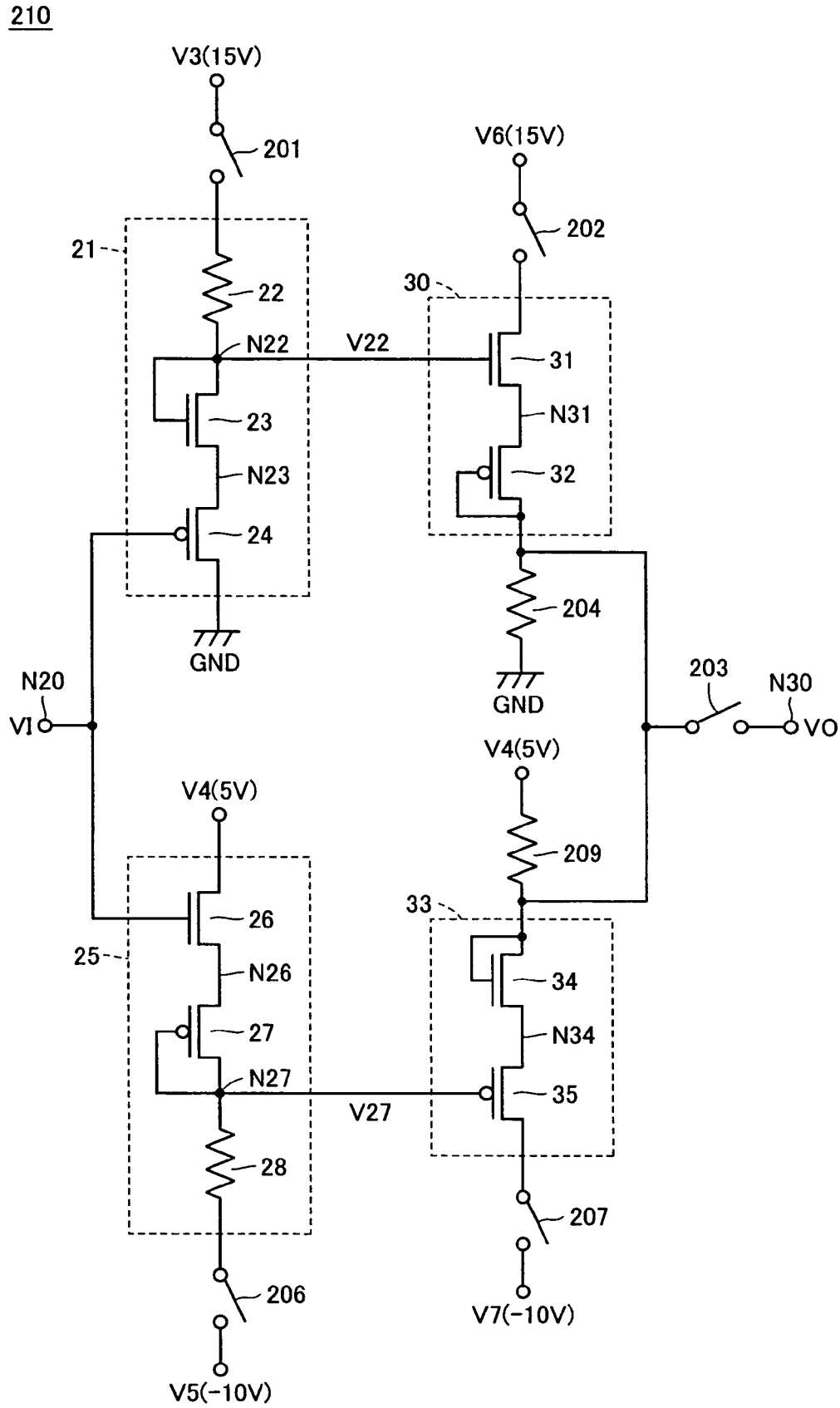
FIG. 71 is a circuit diagram showing another modification of the sixteenth embodiment.

A push-pull-type drive circuit 210 shown in FIG. 71 is formed of a combination of push-type drive circuit 191 in FIG. 68 and pull-type drive circuit 205 in FIG. 70. However, switch 208 is eliminated, and the drains of P- and N-type transistors 32 and 34 are both connected to output node N30 through switch 203. Switches 201-203, 206 and 207 are simultaneously turned on/off. This modification can likewise reduce the power consumption.

Figure 72:
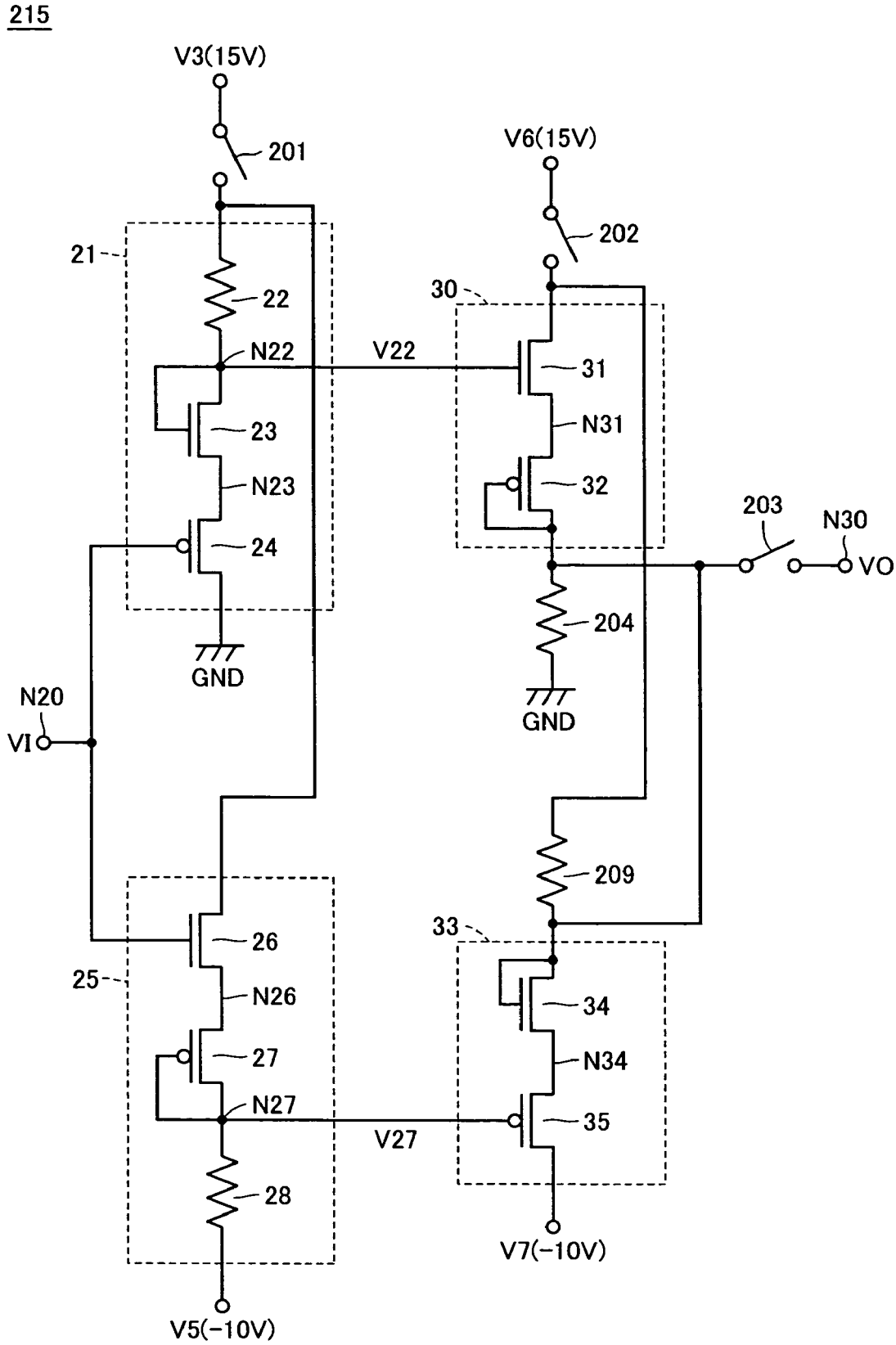
FIG. 72 is a circuit diagram showing still another modification of the sixteenth embodiment.

A push-pull-type drive circuit 215 in FIG. 72 is substantially the same as push-pull-type drive circuit 210 shown in FIG. 71 except for that switches 206 and 207 are eliminated, and switches 201 and 202 are shared by the push side and the pull side. The drain of N-type transistor 26 is connected to the node between switch 201 and resistance element 22. The drain of N-type transistor 34 is connected to the drain of N-type transistor 31 through resistance element 209. This modification can reduce the number of required switches.

Figure 73:
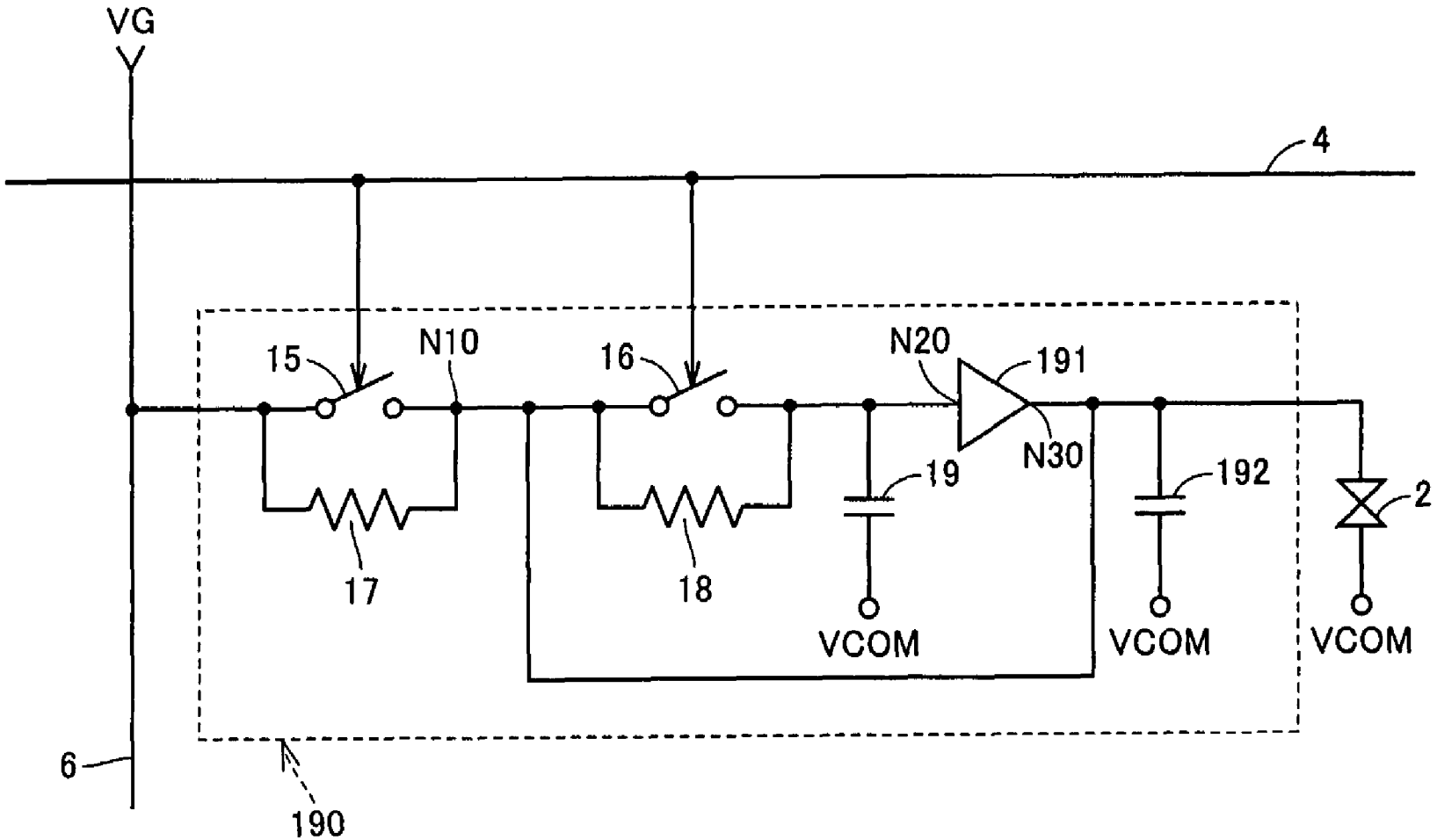
FIG. 73 is a circuit diagram showing yet another modification of the sixteenth embodiment.

In the color liquid crystal display device in FIG. 73, one of the electrodes of liquid crystal cell 2 is connected to output node N30 of push-type drive circuit 191. This modification can likewise reduce the power consumption.

Seventeenth Embodiment

Figure 74:
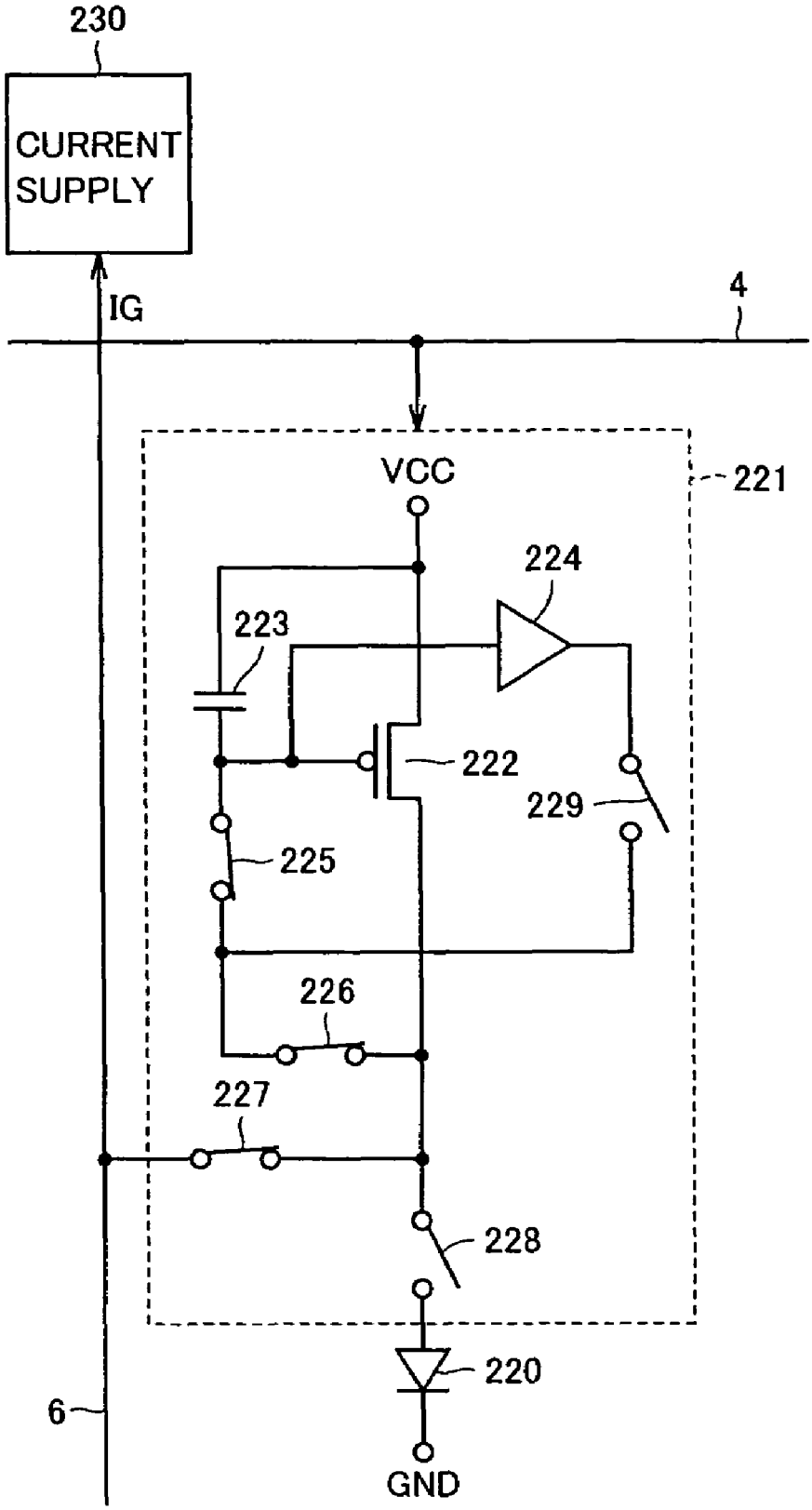
FIG. 74 is a circuit block diagram showing a major portion of an image display device according to a seventeenth embodiment of the invention.

FIG. 74 is a circuit diagram showing a major portion of an image display device according to a seventeenth embodiment of the invention. A whole structure of this image display device is substantially the same as that of the color liquid crystal display device in FIG. 1, but an EL element 220 and a sample hold circuit 221 are arranged at each of crossings between scanning lines 4 and data lines 6. A gradation potential generating circuit 10 and a drive circuit 13 of horizontal scanning circuit 8 in FIGS. 1 and 2 are replaced with a current supply 230, which supplies a gradation current IG at a level corresponding to an image signal to data line 6.

Sample hold circuit 221 includes a P-type transistor 222, a capacitor 223, a drive circuit 224 and switches 225-229. P-type transistor 222, switch 228 and EL element 220 are connected in series between the line of power supply potential VCC and the line of ground potential GND. Capacitor 223 is connected between a source and a gate of P-type transistor 222. Switches 225 and 226 are connected in series between the gate and a drain of P-type transistor 222. Switch 227 is connected between data line 6 and the drain of P-type transistor 222. Drive circuit 224 and switch 229 are connected between the gate of P-type transistor 222 and a node located between switches 225 and 226. Switches 225-229 are turned on/off by scanning line 4.

When scanning line 4 attains the selected level of "H", switches 225-227 are turned on, and switches 228 and 229 are turned off. Thereby, P-type transistor 222 is diode-connected by switches 225 and 226, and gradation current IG at the level corresponding to the image signal flows to current supply 230 from the line of power supply potential VCC through P-type transistor 222, switch 227 and data line 6. In this operation, the gate of P-type transistor 222 has the potential at the level corresponding to gradation current IG, and capacitor 223 is charged to bear a voltage equal to the source-gate voltage of P-type transistor 222.

When scanning line 4 falls to unselected level of "L", switches 225-227 are turned off, and switches 228 and 229 are turned on. Since the gate potential of P-type transistor 222 is held by capacitor 223, gradation current IG flows from the line of power supply potential VCC to the line of ground potential GND through P-type transistor 222, switch 228 and EL element 220, and EL element 220 emits light at brightness corresponding to gradation current IG.

In the above operation, drive circuit 224 holds the potential of the node located between switches 225 and 226 as the gate potential of P-type transistor 222 so that the gate potential of P-type transistor 222 is held constant, and EL element 220 continues the light emission at constant brightness.

If drive circuit 224 and switches 226 and 229 were not employed, a leak current would flow between the gate of P-type transistor 222 and data line 6 through parasitic resistances of switches 225 and 227 so that the gate potential of P-type transistor 222 would change, and the brightness of EL element 220 would change.

Eighteenth Embodiment

Figure 75:
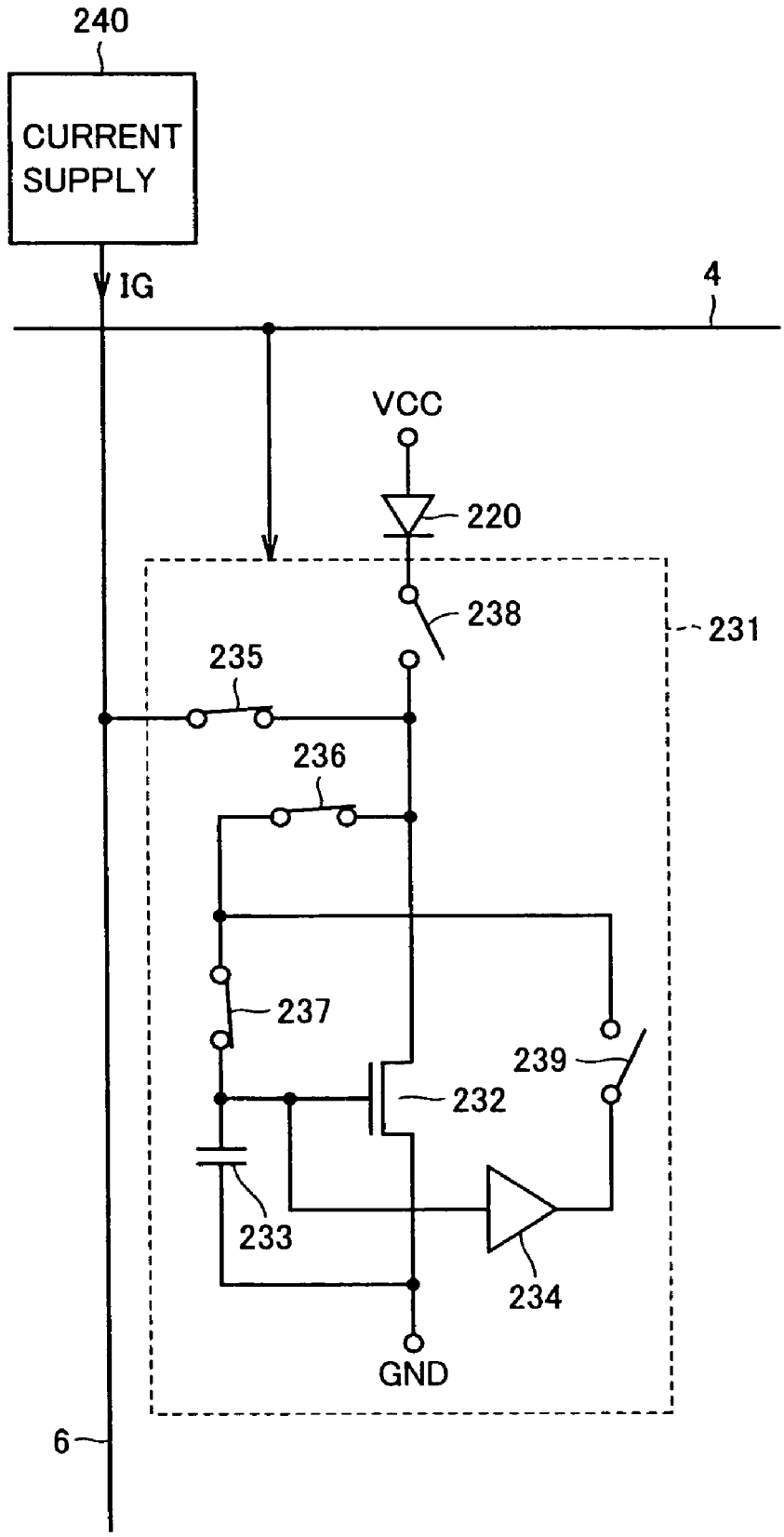
FIG. 75 is a circuit block diagram showing a major portion of an image display device according to an eighteenth embodiment of the invention.
Figure 76:
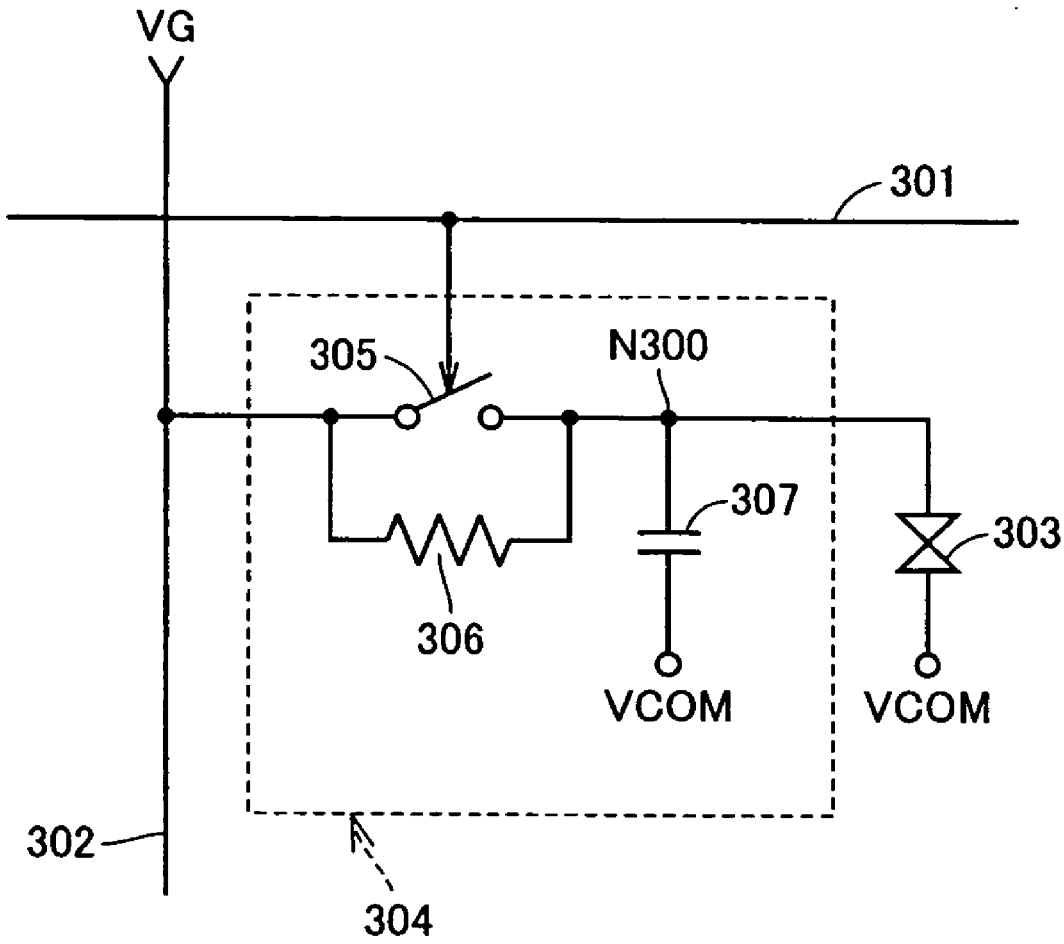
FIG.76 PRIOR ART
FIG. 76 is a circuit diagram showing a major portion of a conventional liquid crystal display device.

FIG. 75 is a circuit diagram showing a major portion of an image display device according to an eighteenth embodiment of the invention. A whole structure of this image display device is substantially the same as that of color liquid crystal display device in FIG. 1, but EL element 220 and a sample hold circuit 231 are arranged at each of the crossings between scanning lines 4 and data lines 6. Gradation potential generating circuit 10 and drive circuit 13 of horizontal scanning circuit 8 in FIGS. 1 and 2 are replaced with a current supply 240, which supplies gradation current IG at the level corresponding to the image signal to data line 6.

Sample hold circuit 231 includes an N-type transistor 232, a capacitor 233, a drive circuit 234 and switches 235-239. EL element 220, switch 238 and N-type transistor 232 are connected in series between the line of power supply potential VCC and the line of ground potential GND. Switch 235 is connected between data line 6 and the drain of N-type transistor 232. Switches 236 and 237 are connected in series between the a drain and a gate of N-type transistor 232. Capacitor 233 is connected between the gate and a source of N-type transistor 232. Drive circuit 234 and switch 239 are connected in series between the gate of N-type transistor 232 and a node located between switches 236 and 237. Switches 235-239 are turned on/off under control of scanning line 4.

When scanning line 4 is set to the selected level of "H", switches 235-237 are turned on, and switches 238 and 239 are turned off. Thereby, N-type transistor 232 is diode-connected by switches 236 and 237, and gradation current IG at the level corresponding to an image signal flows from current supply 240 to the line of ground potential GND through data line 6, switch 235 and N-type transistor 232. In this operation, the gate of N-type transistor 232 is at the level corresponding to gradation current IG, and capacitor 233 is charged to carry a gate-source voltage of N-type transistor 230.

When scanning line 4 falls to the unselected level of "L", switches 235-237 are turned off, and switches 238 and 239 are turned on. Since the gate potential of N-type transistor 232 is held by capacitor 233, gradation current IG flows from the line of power supply potential VCC to the line of ground potential GND through EL element 220, switch 238 and N-type transistor 232, and EL element 220 emits light at brightness corresponding to gradation current IG.

In this operation, drive circuit 234 holds the potential of the node between switches 236 and 237 as the gate potential of N-type transistor 232. Therefore, the gate potential of N-type transistor 232 is held constant, and EL element 220 emits light at constant brightness.

If drive circuit 234 and switches 236 and 239 are not employed, a leak current flows between the gate of N-type transistor 232 and data line 6 through parasitic capacitances of switches 235 and 237 so that the gate potential of N-type transistor 232 changes, and the brightness of EL element 220 changes.

Although the first to eighteenth embodiments have been described in connection with the active-matrix-type display device using liquid crystal cells 2 and EL elements 51 and 220, the invention can be naturally applied to any active-matrix-type display device using electric-optic conversion elements.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. A sample hold circuit for sampling an input potential, holding the sampled potential and outputting the same, comprising:

a first switching element receiving said input potential on one of its electrodes, and being turned on for a first period;

a second switching element connected at one of its electrodes to the other electrode of said first switching element, and being turned on for a second period;

a capacitor connected at one of its electrodes to the other electrode of said second switching element, and receiving on the other electrode a predetermined potential; and a drive circuit having an input node connected to the other electrode of said second switching element and an output node connected to the other electrode of said first switching element, and providing a potential corresponding to a potential of said input node to the output node, wherein said drive circuit includes:

a first current limiting element receiving a first power supply potential on one of its electrodes, a first transistor of a first conductivity type having a first electrode and an input node connected to the other electrode of said first current limiting element, a second transistor of a second conductivity type having a first electrode connected to the second electrode of said first transistor, a second electrode receiving a second power supply potential and an input electrode receiving an potential of said input node, a third transistor of the first conductivity type having a first electrode receiving a third power supply potential, and an input electrode connected to the other electrode of said first current limiting element, and a fourth transistor of the second conductivity type having a first electrode connected to the second electrode of said third transistor, and having a second electrode and an input electrode connected to said output node.

2. A sample hold circuit for sampling an input potential, holding the sampled potential and outputting the same, comprising:

a first switching element, having first and second electrodes, receiving said input potential on the first electrode, and being turned on for a first period;

a second switching element, having third and fourth electrodes, connected at the third electrode to the second electrode of said first switching element, and being turned on for a second period;

a first capacitor, having fifth and sixth electrodes, connected at the fifth electrode to the fourth electrode of said second switching element, and receiving on the sixth electrode a predetermined potential; and a drive circuit having an input node connected to the fourth electrode of said second switching element and an output node connected to the second electrode of said first switching element, and providing a potential corresponding to a potential of said input node to the output node wherein a power supply voltage of said drive circuit is intermittently supplied.

3. The sample hold circuit according to claim 1, wherein said first and second periods are the same period.

4. The sample hold circuit according to claim 1, wherein said first period contains said second period.

5. The sample hold circuit according to claim 1, wherein said drive circuit includes:

a first level shift circuit providing a potential achieved by shifting a level of a potential of said input node by a predetermined first voltage in a certain direction, and a second level shift circuit providing to said output node a potential achieved by shifting a level of an output potential of said first level shift circuit by a predetermined second voltage in a direction opposite to said certain potential direction.

6. The sample hold circuit according to claim 1, wherein said drive circuit includes:

a first current limiting element, having seventh and eighth electrodes, receiving a first power supply potential on the seventh electrode, and a first transistor of a first conductivity type having a ninth electrode connected to the eighth electrode of said first current limiting element, a tenth electrode receiving a second power supply potential and an input electrode receiving the potential of said input node, and said second level shift circuit includes a second transistor of a second conductivity type having an 11th electrode receiving a third power supply potential, a 12th electrode connected to said output node and an input electrode connected to the eighth electrode of said first current limiting element.

7. The sample hold circuit according to claim 6, wherein said drive circuit further includes:

a third transistor of a second conductivity type having a 13th electrode and an input electrode both connected to the eighth electrode of said first current limiting element, and having a 14th electrode connected to the ninth electrode of said first transistor, and a fourth transistor of the first conductivity type having a 15th electrode connected to the 12th electrode of said second transistor, and having a 16th electrode and an input electrode both connected to said output node.

8. The sample hold circuit according to claim 6, wherein said drive circuit further includes a second current limiting element connected between said output node and a line of a fourth power supply potential.

9. The sample hold circuit according to claim 8, wherein said first and second power supply potentials are equal to each other, and said second and fourth power supply potentials are equal to each other.

10. The sample hold circuit according to claim 8, wherein said first and second current limiting elements include first and second resistance elements, respectively.

11. The sample hold circuit according to claim 8, wherein said first current limiting element includes a third transistor of the second conductivity type receiving a first constant voltage on its input electrode, and said second current limiting element includes a fourth transistor of the first conductivity type receiving a second constant voltage on its input electrode.

12. The sample hold circuit according to claim 5, wherein said drive circuit further includes a pulse generating circuit changing a potential of a predetermined node between said first and second level shift circuits in said certain potential direction in a pulse-like fashion in response to the change of the potential of said input node in said certain potential direction.

13. The sample hold circuit according to claim 12, wherein said pulse generating circuit includes a second capacitor, having seventh and eighth electrodes connected at the seventh electrode to said predetermined node, and having a potential at the eighth electrode being changed in said certain potential direction in a pulse-like fashion in response to the change of the potential of said input node in said certain potential direction.

14. The sample hold circuit according to claim 12, wherein said pulse generating circuit includes a third switching element, having ninth and tenth electrodes receiving on the ninth electrode a first power supply potential, connected at the tenth electrode to said predetermined node, and being turned on in a pulse-like fashion in response to change of the potential of said input node in said certain potential direction.

15. The sample hold circuit according to claim 5, wherein said drive circuit further includes an offset-compensating circuit canceling an offset voltage.

16. The sample hold circuit according to claim 15, wherein the output potential of said second level shift circuit is connected to a second node instead of said output node; and said offset-compensating circuit includes:

a second capacitor having seventh and eighth electrodes, a first switching circuit applying the potential of said input node to the seventh electrode of said second capacitor and said first level shift circuit, and connecting the eighth electrode of said second capacitor to said predetermined node, a second switching circuit applying the potential of said input node to the other electrode of said second capacitor, and applying the potential of the seventh electrode of said second capacitor to said first level shift circuit instead of the potential of said input node, and a third switching circuit applying the potential of said second node to said output node.

17. The sample hold circuit according to claim 16, wherein said offset-compensating circuit further includes a pulse generating circuit changing the potential of said predetermined node in a potential direction opposite to said certain potential direction in a pulse-like fashion while said first switching circuit is applying said input potential to the seventh electrode of said second capacitor and connection is kept between the eighth electrode of said second capacitor and said predetermined node.

18. An image display device comprising the sample hold circuit according to claim 1; and a liquid crystal cell, having seventh and eighth electrodes, connected at the seventh electrode to an output node of said drive circuit, and receiving on the eighth electrode the predetermined potential.

19. An image display device comprising the sample hold circuit according to claim 1; and a liquid crystal cell, having seventh and eighth electrodes, connected at the seventh electrode to an input node of said drive circuit, and receiving on the eight electrode a common potential.

20. An image display device comprising:

the sample hold circuit according to claim 1;

a transistor having a seventh electrode connected to the first electrode of said first switching element, an input electrode connected to the fourth electrode of said second switching element, and a eighth electrode connected to the sixth electrode of said first capacitor;

a current supply connected to the seventh electrode of said transistor to pass a gradation current through said transistor during said first and second periods of the on-state of said first and second switching elements; and an light-emitting element connected between the seventh electrode of said transistor and a line of a power supply potential to emit light at brightness corresponding to the current flowing through said transistor after elapsing of said first and second periods.

* * * * *